US010907352B2

(12) United States Patent
Aschenbeck et al.

(10) Patent No.: US 10,907,352 B2
(45) **Date of Patent: *Feb. 2, 2021**

(54) SHINGLE SEALING ARRANGEMENTS

(71) Applicant: Owens Corning Intellectual Capital, LLC, Toledo, OH (US)

(72) Inventors: David P. Aschenbeck, Newark, OH (US); James E. Loftus, Newark, OH (US); Donn R. Vermilion, Newark, OH (US); Lawrence J. Grubka, Westerville, OH (US); Carmen Anthony LaTorre, Worthington, OH (US); Bert W. Elliott, Toledo, OH (US); Christopher Kasprzak, Holland, OH (US); Edward Richard Harrington, Jr., Toledo, OH (US); Christina Marie Wise, Granville, OH (US); William Edwin Smith, Pataskala, OH (US); Shu Situ-Loewenstein, Indianapolis, IN (US); Jonathan M. Verhoff, Granville, OH (US); Benjamin Barszcz, New Albany, OH (US); David Michael Ploense, Downers Grove, IL (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/731,543

(22) Filed: Dec. 31, 2019

(65) Prior Publication Data

US 2020/0131772 A1 Apr. 30, 2020

Related U.S. Application Data

(60) Continuation of application No. 15/783,366, filed on Oct. 13, 2017, now Pat. No. 10,538,918, which is a (Continued)

(51) Int. Cl.

| | |
|---|---|
| ***E04D 1/26*** | (2006.01) |
| ***E04D 1/34*** | (2006.01) |
| ***E04D 1/36*** | (2006.01) |

(52) U.S. Cl.

CPC ..... *E04D 1/26* (2013.01); *E04D 1/36* (2013.01); *E04D 1/34* (2013.01)

(58) Field of Classification Search

CPC .. E04D 1/26; E04D 1/28; E04D 1/265; E04D 2001/005; E04D 1/36; E04D 1/20;

(Continued)

(56) References Cited

U.S. PATENT DOCUMENTS

| | | | |
|---|---|---|---|
| 1,619,598 | A | 3/1927 | Cumfer |
| 1,634,465 | A | 7/1927 | Kelly |

(Continued)

FOREIGN PATENT DOCUMENTS

| | | |
|---|---|---|
| CA | 2450566 | 6/2004 |
| CA | 2697221 A1 | 9/2010 |

(Continued)

OTHER PUBLICATIONS

International Search Report and Written Opinion for PCT/US17/30990 dated Sep. 29, 2017.

(Continued)

*Primary Examiner* — Kyle J. Walraed-Sullivan

(74) *Attorney, Agent, or Firm* — Calfee, Halter & Griswold LLP

(57) ABSTRACT

An exemplary shingle includes at least one coated shingle sheet defining a headlap portion and a tab portion each having opposed upper and lower surfaces. A first line of adhesive is adhered to one of the upper surface of the headlap portion and the lower surface of the tab portion, and includes a first thermally activated adhesive material. A second line of adhesive is adhered to one of the upper (Continued)

surface of the headlap portion and the lower surface of the tab portion, and includes a second thermally activated adhesive material having a minimum activation temperature less than a minimum activation temperature of the first thermally activated adhesive material.

14 Claims, 41 Drawing Sheets

Related U.S. Application Data division of application No. 15/493,990, filed on Apr. 21, 2017, now Pat. No. 10,358,824.

(60) Provisional application No. 62/332,601, filed on May 6, 2016.

(58) Field of Classification Search
CPC ... E04D 5/148; E04D 5/02; E04D 2001/3435; E04D 2001/3455; E04D 2001/3458; E04D 2001/347; E04D 2001/3479; E04B 2103/04
USPC ..... 52/518, 519, 560, 543, 553
See application file for complete search history.

(56) References Cited

U.S. PATENT DOCUMENTS 1,799,293 A 4/1931 French
2,024,861 A 12/1935 Honigbaum
2,027,029 A 1/1936 Eckert
2,210,209 A 8/1940 Kirschbraun
2,235,212 A 3/1941 Herscovitz
2,241,058 A 5/1941 Lanier
2,300,488 A 11/1942 Cuno
2,472,100 A 6/1949 Fair, Jr.
2,666,402 A 1/1954 Clarvoe
2,667,131 A 1/1954 Clarvoe et al.
2,672,831 A 3/1954 Fink et al.
2,863,405 A 12/1958 Leibrook et al.
3,003,288 A 10/1961 Leibrook et al.
3,050,908 A 8/1962 Schenk
3,138,897 A 6/1964 McCorkle
3,180,783 A 4/1965 Walker et al.
3,217,870 A 11/1965 Davis et al.
3,247,631 A 4/1966 Lovness
3,252,257 A 5/1966 Price et al.
3,407,556 A 10/1968 Leibrook
3,434,259 A 3/1969 Corbin
3,484,267 A 12/1969 Sadler
3,667,184 A 6/1972 Merrill et al.
3,765,972 A 10/1973 Wesp
3,813,280 A 5/1974 Olszyk et al.
3,819,552 A 6/1974 Glanville et al.
3,852,934 A 12/1974 Kirkhuff
3,903,340 A 9/1975 Shepherd
3,943,677 A 3/1976 Carothers
4,055,453 A 10/1977 Tajima et al.
4,068,027 A 1/1978 Van Ornum
4,079,561 A 3/1978 Vallee
4,185,436 A 1/1980 Vallee
4,218,857 A 8/1980 Vallee
4,404,783 A 9/1983 Freiborg
4,449,341 A 5/1984 Taglianetti et al.
4,470,237 A 9/1984 Lincoln et al.
4,559,267 A 12/1985 Freshwater et al.
4,567,079 A 1/1986 Canfield et al.
4,580,389 A 4/1986 Freiborg
4,588,634 A 5/1986 Pagen et al.
4,595,636 A 6/1986 Wiercinski et al.
4,600,635 A 7/1986 Wiercinski et al.
4,601,935 A 7/1986 Metcalf et al.
4,634,622 A 1/1987 Jenkins et al.
4,637,191 A 1/1987 Smith
4,738,884 A 4/1988 Algrim et al.
4,755,545 A 7/1988 Lalwani
4,778,831 A 10/1988 Kemper
4,824,880 A 4/1989 Algrim et al.
4,856,251 A 8/1989 Buck
4,910,059 A 3/1990 Sancaktar
4,923,913 A 5/1990 Chich et al.
4,992,315 A 2/1991 Zickell et al.
5,239,802 A 8/1993 Robinson
5,488,807 A 2/1996 Terrenzio et al.
5,502,937 A 4/1996 Wilson
5,563,217 A 10/1996 Davis et al.
5,577,361 A 11/1996 Grabek, Jr.
5,578,671 A 11/1996 Welna
5,620,794 A * 4/1997 Burkart ..... B29C 65/76 428/343
5,671,577 A 9/1997 Todd
5,799,459 A 9/1998 Covert
5,799,460 A 9/1998 Jensen
5,822,943 A 10/1998 Frankoski et al.
5,921,041 A 7/1999 Egri
5,950,387 A 9/1999 Stahl et al.
5,951,796 A 9/1999 Murray
5,974,750 A 11/1999 Landin et al.
6,014,847 A 1/2000 Phillips
6,083,592 A 7/2000 Chich
6,110,846 A 8/2000 Brzozowski et al.
6,128,874 A 10/2000 Olson et al.
6,130,268 A 10/2000 Murray
6,172,145 B1 1/2001 Drieskens et al.
6,173,546 B1 1/2001 Schafer
6,199,338 B1 3/2001 Hudson et al.
6,341,462 B2 1/2002 Kiik et al.
6,360,506 B1 3/2002 Graae
6,403,711 B1 6/2002 Yang et al.
6,471,812 B1 10/2002 Thompson et al.
6,506,466 B1 1/2003 Sieber et al.
6,557,315 B2 5/2003 Tremblay
6,753,362 B2 6/2004 Khan et al.
6,769,215 B1 8/2004 Carkner
6,794,449 B2 9/2004 Fisher
6,852,185 B2 * 2/2005 Sanger ..... E04D 1/34 156/71
6,874,289 B2 4/2005 Koch
6,920,730 B2 * 7/2005 Becker ..... B32B 38/1808 52/518
6,924,015 B2 8/2005 Zanchetta et al.
6,936,329 B2 8/2005 Kiik et al.
7,018,699 B2 3/2006 Dykhoff
7,025,000 B1 4/2006 Wong et al.
7,424,793 B1 9/2008 Shriver
7,781,046 B2 8/2010 Kalkanoglu et al.
7,851,051 B2 12/2010 DeJarnette et al.
7,856,775 B2 12/2010 Stahl, Jr.
8,266,861 B2 9/2012 Koch et al.
D670,008 S 10/2012 Jenkins
8,297,020 B1 10/2012 Swanson
D674,515 S 1/2013 Jenkins
8,512,508 B2 8/2013 Fensel et al.
8,519,024 B2 8/2013 Kreh
8,535,786 B2 9/2013 Schroer et al.
8,567,601 B2 10/2013 Turek et al.
8,607,519 B2 12/2013 Hilburn
8,607,521 B2 12/2013 Belt et al.
8,613,165 B2 12/2013 Bleil et al.
8,623,164 B2 1/2014 Belt et al.
8,793,946 B2 8/2014 Stahl, Jr. et al.
8,898,963 B1 12/2014 Amatruda et al.
8,898,987 B1 12/2014 Amatruda et al.
8,915,037 B2 12/2014 Jenkins
8,978,316 B2 3/2015 Malpas
9,016,013 B2 4/2015 Stahl, Jr. et al.
9,021,760 B2 5/2015 Kiik et al.
9,097,020 B2 8/2015 Grubka et al.
9,151,055 B2 10/2015 Grubka
9,242,432 B1 1/2016 Harrington, Jr. et al.
9,399,871 B2 7/2016 Leitch et al.
RE46,177 E * 10/2016 Vermilion ..... E04D 1/26
9,657,478 B2 5/2017 Belt et al.

(56) References Cited

U.S. PATENT DOCUMENTS

| | | | |
|---|---|---|---|
| 2001/0001404 | A1 | 5/2001 | Starr |
| 2002/0001673 | A1 | 1/2002 | Phillips |
| 2003/0040241 | A1 | 2/2003 | Kiik et al. |
| 2003/0207101 | A1 | 11/2003 | Huege et al. |
| 2004/0009319 | A1 | 1/2004 | Zanchetta et al. |
| 2004/0111996 | A1 | 6/2004 | Heronerne |
| 2004/0148896 | A1 | 8/2004 | Koch et al. |
| 2004/0172908 | A1 | 9/2004 | Swann |
| 2004/0206035 | A1 | 10/2004 | Kandalgaonkar |
| 2004/0224114 | A1 | 11/2004 | Patel |
| 2005/0102941 | A1 | 5/2005 | Barr |
| 2005/0204675 | A1 | 9/2005 | Snyder et al. |
| 2005/0210806 | A1 | 9/2005 | Guerra |
| 2005/0252136 | A1 | 11/2005 | Hardin |
| 2005/0252141 | A1 | 11/2005 | Kerkar et al. |
| 2006/0026908 | A1 | 2/2006 | Gregori et al. |
| 2006/0179767 | A1 | 8/2006 | Miller et al. |
| 2006/0265989 | A1 | 11/2006 | Geary |
| 2006/0265990 | A1 | 11/2006 | Kalkanoglu et al. |
| 2007/0042158 | A1 | 2/2007 | Belt et al. |
| 2007/0068108 | A1 | 3/2007 | Kiik et al. |
| 2007/0204540 | A1 | 9/2007 | Stahl et al. |
| 2007/0251162 | A1 | 11/2007 | Schmid |
| 2007/0261337 | A1 | 11/2007 | Whitaker et al. |
| 2007/0266665 | A1 | 11/2007 | Todd et al. |
| 2008/0134612 | A1 | 6/2008 | Koschitzky |
| 2009/0057458 | A1 | 3/2009 | Fast et al. |
| 2009/0139175 | A1 | 6/2009 | Todd et al. |
| 2009/0158685 | A1 | 6/2009 | Swanson |
| 2009/0223159 | A1 | 9/2009 | Colon |
| 2010/0178827 | A1 | 7/2010 | Thai et al. |
| 2010/0196647 | A1 | 8/2010 | Bryson et al. |
| 2010/0236178 | A1 | 9/2010 | Loftus et al. |
| 2010/0236478 | A1 | 9/2010 | Miyashita et al. |
| 2010/0239807 | A1 | 9/2010 | Grubka et al. |
| 2010/0275534 | A1 | 11/2010 | Ruskin et al. |
| 2011/0005158 | A1 | 1/2011 | Kailey et al. |
| 2011/0033685 | A1 | 2/2011 | Folkersen |
| 2011/0061326 | A1 | 3/2011 | Jenkins |
| 2011/0072752 | A1 | 3/2011 | Aschenbeck et al. |
| 2011/0232220 | A1 | 9/2011 | Belt et al. |
| 2011/0283646 | A1 | 11/2011 | Vermilion et al. |
| 2012/0174517 | A1 | 7/2012 | Jenkins |
| 2013/0025225 | A1 | 1/2013 | Vermilion et al. |
| 2013/0025771 | A1 | 1/2013 | Vermilion et al. |
| 2013/0065020 | A1 | 3/2013 | Loftus et al. |
| 2013/0125494 | A1 | 5/2013 | Jenkins |
| 2013/0177728 | A1 | 7/2013 | Grubka et al. |
| 2014/0260047 | A1 | 9/2014 | Jenkins et al. |
| 2014/0283474 | A1 | 9/2014 | Jenkins |
| 2015/0086793 | A1 | 3/2015 | Kreysler et al. |
| 2015/0089895 | A1 | 4/2015 | Leitch |
| 2015/0096662 | A1 | 4/2015 | Jenkins |
| 2015/0240495 | A1 | 8/2015 | Vermilion et al. |
| 2015/0240496 | A1 | 8/2015 | Grubka et al. |
| 2015/0259920 | A1 | 9/2015 | Hassan et al. |
| 2015/0285426 | A1 | 10/2015 | Shaw |
| 2015/0326172 | A1 | 11/2015 | Koehler |
| 2016/0145868 | A1 | 5/2016 | Duque et al. |
| 2016/0145869 | A1 | 5/2016 | Leitch et al. |
| 2016/0145870 | A1 | 5/2016 | Leitch et al. |
| 2017/0058528 | A1 | 3/2017 | Verhoff et al. |
| 2017/0145271 | A1 | 5/2017 | Loftus et al. |
| 2017/0306627 | A1 | 10/2017 | Grubka et al. |
| 2017/0314271 | A1 | 11/2017 | Sutton et al. |
| 2017/0321423 | A1 | 11/2017 | Aschenbeck et al. |
| 2018/0030732 | A1 | 2/2018 | Duque et al. |
| 2019/0161970 | A1* | 5/2019 | Strickland ..... E04D 1/26 |

FOREIGN PATENT DOCUMENTS

| | | |
|---|---|---|
| CA | 2832322 | 4/2015 |
| CA | 2697221 C | 6/2017 |
| KR | 10-2011067685 | 6/2011 |
| KR | 10-1114278 | 2/2012 |

OTHER PUBLICATIONS

Office Action in U.S. Appl. No. 15/493,990 dated Nov. 16, 2017.
Dffice Action in U.S. Appl. No. 15/493,990 dated Jun. 29, 2018.
Office Action in U.S. Appl. No. 15/493,990 dated Nov. 20, 2018.
Notice of Allowance in U.S. Appl. No. 15/493,990 dated Mar. 13, 2019.
Office Action in U.S. Appl. No. 15/783,366 dated Dec. 12, 2017.
Office Action in U.S. Appl. No. 15/783,366 dated Aug. 14, 2018.
Office Action in U.S. Appl. No. 15/783,366 dated Feb. 6, 2019.
Office Action in U.S. Appl. No. 15/783,366 dated May 17, 2019.
Notice of Allowance in U.S. Appl. No. 15/783,366 dated Sep. 6, 2019.

* cited by examiner

SHINGLE SEALING ARRANGEMENTS

CROSS-REFERENCE TO RELATED APPLICATIONS

This application is a continuation of U.S. application Ser. No. 15/783,366, filed Oct. 13, 2017, which is a divisional of U.S. application Ser. No. 15/493,990, filed Apr. 21, 2017, now U.S. Pat. No. 10,358,824, which claims priority to and any other benefit of U.S. Provisional Patent Application No. 62/332,601, filed May 6, 2016, the entire contents of which are incorporated by reference herein.

BACKGROUND

Asphalt-based roofing materials, such as roofing shingles, roll roofing and commercial roofing, are installed on the roofs of buildings to provide protection from the elements, and to give the roof an aesthetically pleasing look. Typically, the roofing material is constructed of a substrate such as a glass fiber mat or an organic felt, an asphalt coating on the substrate, and a surface layer of granules embedded in the asphalt coating. A common method for the manufacture of asphalt shingles is the production of a continuous sheet of granule covered, asphalt coated material followed by a shingle cutting operation which cuts the material into individual shingles having normally covered (i.e., by a subsequently laid course of shingles) headlap portions and normally exposed tab portions.

A conventional single layer tabbed shingle 10, as shown in FIGS. 1 and 1A, includes a single asphalt coated shingle sheet 11 defining a continuous headlap portion 17 and a slotted or discontinuous tab portion 18. As shown in FIG. 1A, the shingle sheet 11 includes a substrate layer 12 (e.g., fiberglass mat), upper and lower asphalt coating layers 13, 14 (generally formed from layers of hot, melted asphalt) adhered to the substrate layer 12, a layer of granules 15 (e.g., ceramic roofing grade granules of a variety of different particle sizes and colors) adhered to the upper asphalt coating 13 to define an upper surface 10*a* of the shingle, and a layer of backdust 16 (e.g., pulverized sand, talc, mica, calcium carbonate, or ground recycled glass) adhered to the lower asphalt coating 14 to define a lower surface 10*b* of the shingle 10.

A conventional two-layer or laminated shingle 20, as shown in FIGS. 2 and 2A, includes an asphalt coated overlay sheet 21 having a continuous headlap portion 27 and a tabbed or slotted tab portion 28 adhered to an upper surface of an asphalt coated underlay sheet 31 to define a tab portion 38 of the shingle 20. The overlay and underlay sheets 21, 31 each include a substrate layer 22, 32, upper and lower asphalt coating layers 23, 33, 24, 34 adhered to the substrate layer, a layer of granules 25, 35 adhered to at least the exposed portions of the upper asphalt coating 23, 33 to define an upper surface 20*a* of the shingle, and a layer of backdust 26, 36 adhered to at least the exposed portions of the lower asphalt coating 24, 34 to define a lower surface 20*b* of the shingle 20. The overlay and underlay sheets 21, 31 may be adhered to each other by the abutting portions of the hot melt asphalt coating layers 24, 33 (with these portions free of granules to allow for adhesion), or by a post-applied pattern of adhesive 29*a* (e.g., asphalt adhesive).

During a typical shingle manufacturing process, a pattern of adhesive is applied to the shingle, either on the upper surface of the headlap portion (as shown at 19*a* in FIG. 1 and at 29 in FIGS. 2 and 2A) or on the lower surface of the tab portion (as shown at 19*b* in FIGS. 1 and 1A and at 39 in FIGS. 2 and 2A), so that the headlap portions of a lower course of shingles on a roof will adhere to the tab portions of a subsequently laid course of shingles on the roof. The resulting adhesive bond helps to prevent wind uplift of the shingles on the roof.

Self-sealing asphalt shingles are typically packaged, shipped, and stored in a bundle of stacked shingles. To prevent adhesion of a shingle's adhesive pattern to an adjacent shingle, a removable release tape or strip may be applied to the line of adhesive, or alternatively, the portion of the adjacent shingle in facing alignment with the adhesive pattern may be provided with a non-stick surface to allow for easy separation of the shingles.

SUMMARY

In an exemplary embodiment of the present application, a shingle includes at least one coated shingle sheet defining a headlap portion and a tab portion each having opposed upper and lower surfaces. A first line of adhesive is adhered to one of the upper surface of the headlap portion and the lower surface of the tab portion, and includes a first thermally activated adhesive material. A second line of adhesive is adhered to one of the upper surface of the headlap portion and the lower surface of the tab portion, and includes a second thermally activated adhesive material having a minimum activation temperature less than a minimum activation temperature of the first thermally activated adhesive material.

In another exemplary embodiment of the present application, a shingle includes at least one coated shingle sheet defining a headlap portion and a tab portion each having opposed upper and lower surfaces. A line of adhesive is adhered to one of the upper surface of the headlap portion and the lower surface of the tab portion. The line of adhesive includes a polymeric foam material defining a first thickness of the line of adhesive. The polymeric foam material is configured such that the line of adhesive is compressible from the first thickness to a second thickness that is less than 25% of the first thickness when the shingle is subjected to a compressive force of 6 psi, and subsequently expandable to a third thickness that is at least 75% of the first thickness when the compressive force is removed from the shingle.

In certain embodiments, at least one of the first line of adhesive or the second line of adhesive comprises an antioxidant in an amount of up to about 2% by weight of the adhesive. In other embodiments, only one type or line of adhesive, which may be any of the adhesives described herein, is used on the shingle and an antioxidant in an amount of up to about 2% by weight of the adhesive is used in the adhesive.

In certain embodiments, at least one of the first line of adhesive or the second line of adhesive comprises an inert material in an amount of about 10% to about 70% by weight of the adhesive. In other exemplary embodiments, only one type or line of adhesive, which may be any of the adhesives described herein, is used on the shingle and the adhesive comprises an inert material in an amount of about 10% to 70% by weight of the adhesive.

In one exemplary embodiment of the present application, a shingle includes at least one coated shingle sheet defining a headlap portion and a tab portion each having opposed upper and lower surfaces. A bead of a first sealant is applied to the lower surface of the tab portion. The first sealant is formulated to seal at a temperature of less than 70° F. A bead of a second sealant is applied to the lower surface of the tab portion and positioned proximate to a front edge of the tab portion. The second sealant comprises a thermally activated adhesive having a minimum activation temperature of at least 70° F. The bead of the first sealant is sized and positioned with respect to the bead of the second sealant such that when the shingle is placed on an underlying planar surface with the bead of the first sealant facing the underlying planar surface, the bead of the first sealant does not contact the underlying surface.

In one exemplary embodiment of the present application, a shingle includes at least one coated shingle sheet defining a headlap portion and a tab portion each having opposed upper and lower surfaces. A bead of a first sealant having a first width is applied to the lower surface of the tab portion. The first sealant is formulated to seal at a temperature of less than 70° F. A bead of a second sealant having a second width is applied to the bead of the first sealant. The second sealant comprises a thermally activated adhesive having a minimum activation temperature of at least 70° F. The first width of the bead of the first sealant is greater than the second width of the bead of the second sealant. With this arrangement of sealants, when the shingle is placed on an underlying planar surface with the bead of the first sealant facing the underlying surface, the bead of the first sealant does not contact the underlying planar surface. In certain embodiments, the shingle includes a channel on the upper surface of the headlap portion. In certain embodiments, the channel is at least partially formed by a reinforcement material.

In one exemplary embodiment of the present application, a shingle includes at least one coated shingle sheet defining a headlap portion and a tab portion each having opposed upper and lower surfaces. A bead of a first sealant having a first height is applied to the lower surface of the tab portion. The first sealant is formulated to seal at a temperature of less than 70° F. A bead of a second sealant having a second height is applied to the lower surface of the tab portion. The second sealant comprises a thermally activated adhesive having a minimum activation temperature of at least 70° F. The first height of the bead of the first sealant is less than the second height of the bead of the second sealant. With this arrangement of sealants, when the shingle is placed on an underlying planar surface with the bead of the first sealant facing the underlying planar surface, the bead of the first sealant does not contact the underlying planar surface. In certain embodiments, the shingle includes a channel on the upper surface of the headlap portion. In certain embodiments, the channel is at least partially formed by a reinforcement material.

In one exemplary embodiment of the present application, a shingle includes at least one coated shingle sheet defining a headlap portion and a tab portion each having opposed upper and lower surfaces. The shingle includes a channel on the upper surface of the headlap portion. A bead of a first sealant is applied to the channel. The first sealant is formulated to seal at a temperature of less than 70° F. A bead of a second sealant is applied to the lower surface of the tab portion. The second sealant comprises a thermally activated adhesive having a minimum activation temperature of at least 70° F. When the shingle is in an installed position, the bead of the first sealant of an underlying shingle contacts and seals to the bead of the second sealant of an overlying shingle. In certain embodiments, the channel is at least partially formed by a reinforcement material.

In one exemplary embodiment of the present application, a shingle includes at least one coated shingle sheet defining a headlap portion and a tab portion each having opposed upper and lower surfaces. The shingle includes a channel on the upper surface of the headlap portion. A bead of a first sealant is applied to the channel. The first sealant is formulated to seal at a temperature of less than 70° F. A bead of a second sealant is also applied to the channel. The second sealant comprises a thermally activated adhesive having a minimum activation temperature of at least 70° F. When the shingle is in an installed position, at least one of the bead of the first sealant and the bead of the second sealant of an underlying shingle contacts and seals to the lower surface of the tab portion of an overlying shingle. In certain embodiments, the channel is at least partially formed by a reinforcement material.

In one exemplary embodiment of the present application, a shingle includes at least one coated shingle sheet defining a headlap portion and a tab portion each having opposed upper and lower surfaces. The shingle includes a channel on the upper surface of the headlap portion. A bead of a first sealant is applied to the lower surface of the tab portion. The first sealant is formulated to seal at a temperature of less than 70° F. A bead of a second sealant is applied to the lower surface of the tab portion. The second sealant comprises a thermally activated adhesive having a minimum activation temperature of at least 70° F. When the shingle is in an installed position, the bead of the first sealant and the bead of the second sealant of an overlying shingle contacts the channel of an underlying shingle, and at least one of the bead of the first sealant and the bead of the second sealant of the overlying shingle seals to the reinforcement material of the underlying shingle. In certain embodiments, the channel is at least partially formed by a reinforcement material.

In one exemplary embodiment of the present application, a shingle includes at least one coated shingle sheet defining a headlap portion and a tab portion each having opposed upper and lower surfaces. An encapsulated sealant is applied to one of the upper surface of the headlap portion and the lower surface of the tab portion.

In one exemplary embodiment of the present application, a shingle includes at least one coated shingle sheet defining a headlap portion and a tab portion each having opposed upper and lower surfaces. An encapsulated two-part reactive sealant is applied to one of the upper surface of the headlap portion and the lower surface of the tab portion. The encapsulated two-part reactive sealant comprises a first reactive sealant component encapsulated within a first shell, and a second reactive sealant component encapsulated within a second shell.

In one exemplary embodiment of the present application, a shingle includes at least one coated shingle sheet defining a headlap portion and a tab portion each having opposed upper and lower surfaces. The shingle includes a channel on the upper surface of the headlap portion. A bead of a first reactive sealant component is applied to the lower surface of the tab portion and a bead of a second reactive sealant component is applied to the channel. When the shingle is in an installed position, the bead of the first reactive sealant component of an overlying shingle contacts and reacts with the bead of the second reactive sealant component of an underlying shingle to form an adhesive that seals the overlying shingle to the underlying shingle. In certain embodiments, the channel is at least partially formed by a reinforcement material.

In one exemplary embodiment of the present application, a shingle includes at least one coated shingle sheet defining a headlap portion and a tab portion each having opposed upper and lower surfaces. A bead of sealant is applied to the lower surface of the tab portion and positioned proximate to a front edge of the tab portion. The shingle has an area of reduced thickness on the headlap portion. When a pair of shingles are stacked together, the area of reduced thickness on the headlap portions of the shingles are in facing alignment and in contact with the bead of sealant on the lower surface of the tab portions of the shingles. The area of reduced thickness flexes to protect the bead of sealant from flattening.

DETAILED DESCRIPTION

Figure 1:
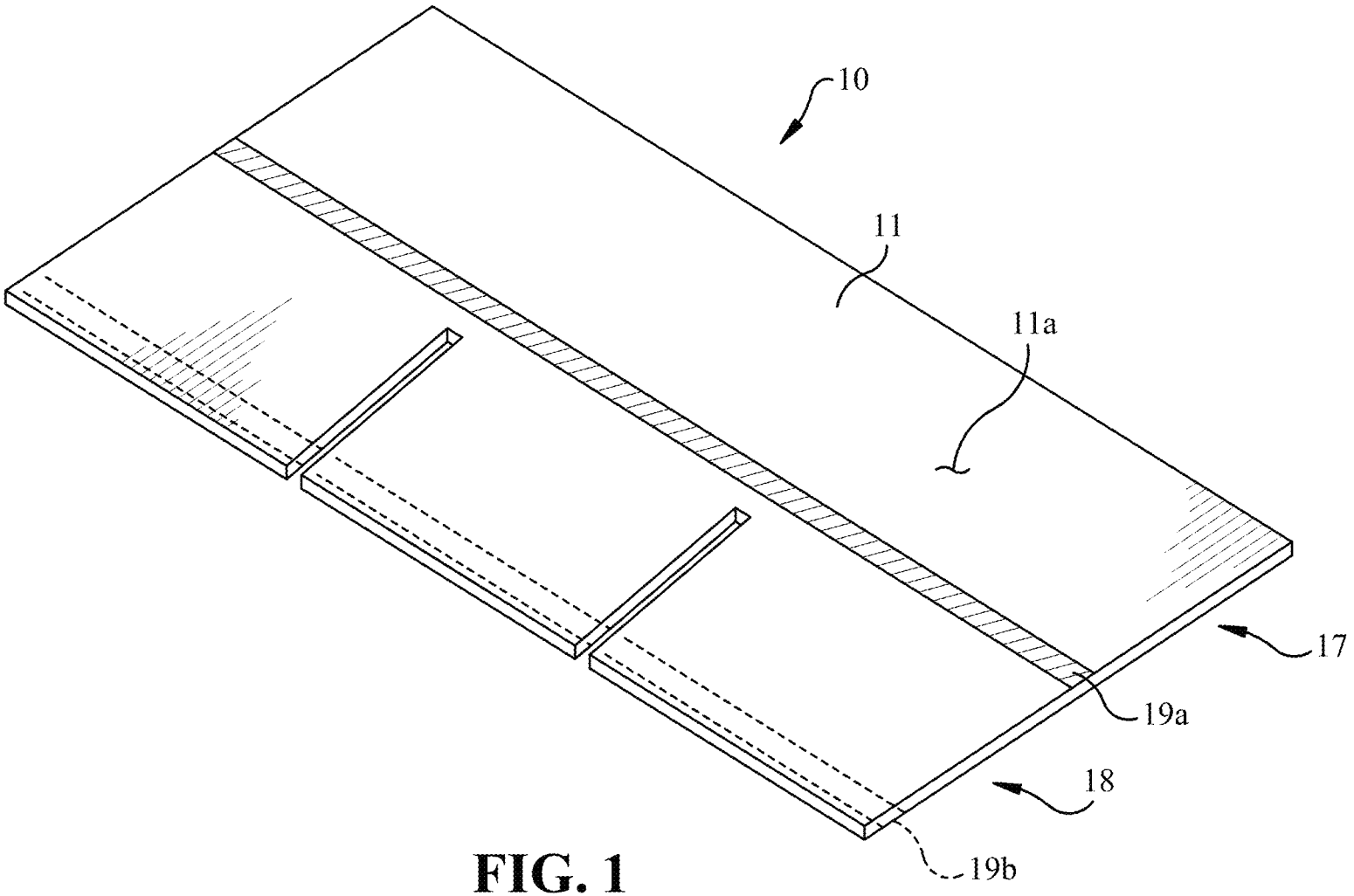
FIG. 1 (Prior Art)
FIG. 1 is an upper perspective view of an exemplary embodiment of a single layer shingle.

In the embodiments herein, the invention of the present application is discussed for use with roofing shingles. However, it should be understood that the invention of the present application may be used with any type of roofing material, such as, for example, roll roofing and commercial roofing. Also, some of the embodiments disclosed herein are illustrated with single layer shingles and some of the embodiments disclosed herein are illustrated with multi-layer (e.g., two-layer, three-layer, four-layer) or laminated shingles. However, all of the concepts disclosed herein can be used with single layer or multi-layer/laminated shingles (i.e., concepts disclosed with respect to single layer shingles can be practiced with multi-layer/laminated shingles and concepts disclosed with respect to multi-layer/laminated shingles can be practiced with single layer shingles). Furthermore, while the embodiments described herein may refer to asphalt coated shingle sheets, the general inventive concepts described herein equally apply to shingle sheets coated with a non-asphalt material, such as polymer-based coatings, to shingle sheets that are only partially coated with asphalt or a non-asphalt material, and to shingle sheets where a portion of the sheet is coated with asphalt and a portion of the sheet is coated with a non-asphalt material. Also, the term "shingle sheet" is meant to refer to both single layer shingles and multi-layer/laminated shingles. Furthermore, the terms "adhesive" and "sealant" are used interchangeably herein.

The present application contemplates arrangements of adhesives or sealants applied to a shingle to improve adhesion to an adjacent shingle (e.g., of a previously applied course of shingles, or of a subsequently applied course of shingles). The general inventive concepts also contemplate solutions to problems associated with cold-weather installation of shingles, modification of shingle adhesives to improve tack retention and aid in cold-weather installation, among others.

A conventional adhesive arrangement for bonding adjacent shingles includes a bead or line of heat sensitive or thermally activated adhesive applied to the upper surface of the headlap portion or to the lower surface of the tab portion, with the heat sensitive adhesive being activated to permanently bond the abutting lower tab and upper headlap surfaces of the shingles when the shingles are exposed to a minimum activation temperature of the adhesive, for example, due to warmer ambient temperatures and/or direct sun exposure. Exemplary heat sensitive adhesives include filled asphalt, which typically has a minimum activation temperature of about 135° F., and polymer modified asphalt, which may have a minimum activation temperature between about 70° F. and about 100° F.

A variety of issues can arise when installing shingles in colder temperatures. In colder temperatures (e.g., during winter months, in colder climates, or in shaded settings), newly installed shingles may not be exposed to temperatures sufficient to fully activate the heat sensitive adhesive for a period of several months, and the traditional asphalt coating that bonds the granules to the mat becomes stiffer and somewhat brittle. The unactivated adhesive and the more brittle asphalt shingle coating leave the installed shingles weakly bonded to each other, and more susceptible to wind uplift, cracking, tearing, or stripping of the shingles from the roof. Because of this, shingles are often only installed during months wherein the average temperature coincides with the activation temperature of the shingle adhesive and at temperatures where the asphalt coating that bonds the granules to the mat is not brittle.

In addition, adhesives having a lower activation temperature often have a corresponding lowered softening point. This can cause the adhesive bead to "flatten out" on the shingle surface—resulting in less surface contact when the shingles are contacted with one another during installation. Thus, there is a need to balance lowered activation temperature with both bead height and flattening in shingle adhesives when seeking to achieve a bond at a lowered temperature. One solution is to use alternative heat sensitive, pressure sensitive, or thermally activated adhesives for colder temperature application, having a minimum activation temperature of less than about 70° F. to effect a bond between the adjacent shingles in these colder temperature setting. Examples of heat sensitive adhesives having lower activation temperatures include modified asphalt, polymer modified asphalt, butyl-based adhesives, acrylic-based adhesives, ethylene vinyl acetate adhesives, natural rubber-based adhesives, nitrile-based adhesives, and silicone rubber-based adhesives. In certain embodiments, a polymer modified asphalt sealant may also include fillers to stiffen the bead. In certain embodiments, the amount of filler is up to 40% (i.e., 0-40% by weight) and in certain instances can be increased to up to 50-60% by weight to accommodate use in a variety of temperatures. Those of skill in the art will understand that the adhesives discussed herein may be combined and rearranged to form one or more of the individual lines (or beads) of adhesive discussed in the individual aspects of the present application.

While these lower activation temperature adhesives provide a bond at lower temperatures, these adhesives typically have an internal strength or creep strength that is significantly lower than that of the corresponding higher activation temperature adhesives. As such, shingles adhered to each other with a lower activation temperature adhesive may be more susceptible to wind uplift in high wind conditions, may be unable to pass the ASTM D3161 two hour wind test, and/or may require greater amounts of adhesive (e.g., over a greater surface area) to maintain adhesion.

According to an aspect of the present application, a shingle may be provided with a first line of adhesive formed from a thermally activated adhesive material having a lower activation temperature (e.g., below 100° F., below 70° F., or between about 0° F. and about 40° F.) for initially bonding adjacent shingles in lower temperature conditions, and a second line of adhesive formed from a thermally activated adhesive material having a higher activation temperature (e.g., between about 80° F. and about 140° F., or between about 70° F. and about 100° F.) for subsequently bonding the adjacent shingles in eventual higher temperature conditions.

In addition to difficulties associated with matching ambient temperature and activation temperatures of adhesives, in many situations, adhesives suffer from reduced tack after original application. That is, when a shingle is first manufactured the adhesive, whether low activation temperature adhesive or high activation temperature, has an initial tackiness (or "tack"). In many instances, the tack of the shingle degrades or decreases at a rapid pace. Often, shingles will have little or no tack within hours after manufacturing. This, lack of tack can prevent or reduce the initial adhesion of the shingle. Good initial tack is important for the long term adhesion of a shingle and the first 24 to 72 hours after installation is critical to the ultimate success of the roof with regards to wind resistance. Improvements in initial tack help to achieve longer lasting bonds, especially when the shingle is installed on cloudy days or at lower temperature. One contributor to tack loss is oxidation of the surface of the adhesive. It has surprisingly been discovered that adhesives including an amount of an antioxidant have a greater retention of tack, often days or weeks after initial manufacturing.

According to an aspect of the present application, a shingle may be provided with one or more lines of adhesive, at least some of the adhesive comprising an antioxidant in an amount of up to about 2% by weight of the adhesive. In certain embodiments, a shingle comprises a line of adhesive, the adhesive comprising an antioxidant in an amount of up to about 1% by weight of the adhesive. In certain embodiments, a shingle comprises a line of adhesive, the adhesive comprising an antioxidant in an amount of up to about 0.5% by weight of the adhesive, including up to about 0.4% by weight of the adhesive, including up to about 0.3% by weight of the adhesive, including up to about 0.2% by weight of the adhesive, and including up to about 0.1% by weight of the adhesive. In certain embodiments, a shingle comprises a line of adhesive, the adhesive comprising an antioxidant in an amount of 0.1% to 1% by weight of the adhesive, including from 0.1% to 0.5%, from 0.1% to 0.4%, from 0.1% to 0.3%, and also including from 0.1% to 0.2% by weight of the adhesive. When referring to weight of the adhesive, it is intended that the weight percentage refer to the liquid portion of the adhesive, i.e., prior to addition of fillers in the adhesive mixture. Any antioxidant known to those of skill in the art and suitable for use in the construction industry may be included in the adhesive compositions. One particularly suitable antioxidant is pentaetythritol tetrakis (3-(3,5-di-tertbutyl-4-hydroxyphenyl)propionate sold under the name IRGANOX 1010.

Figure 3:
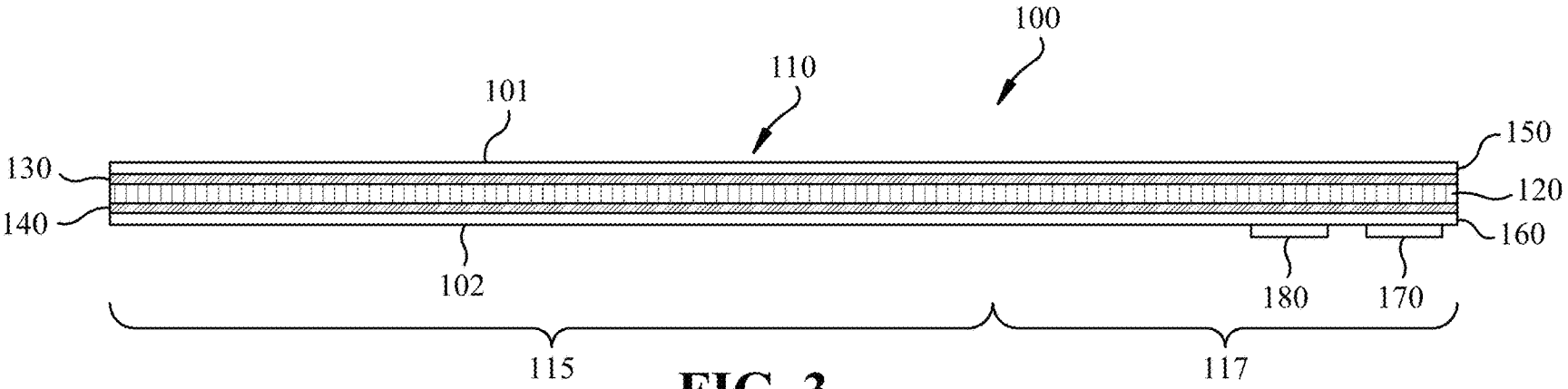
FIG. 3 is a cross-sectional side view of an exemplary embodiment of a single layer shingle.
Figure 3A:
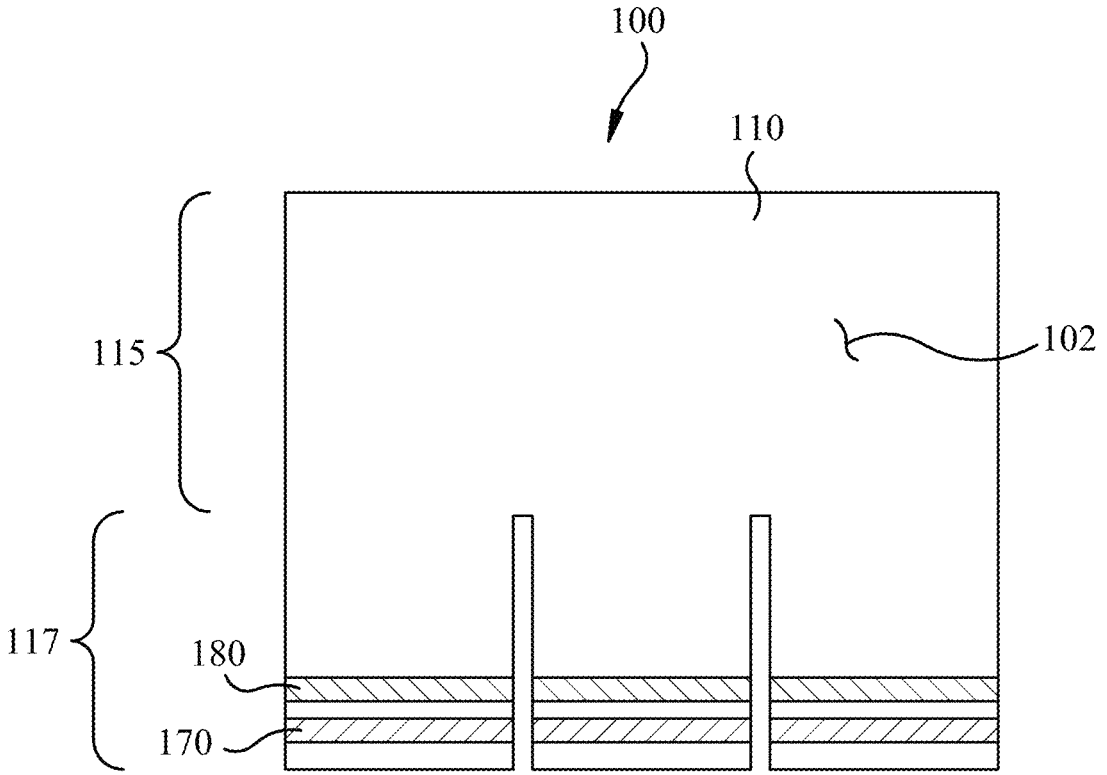
FIG. 3A is a bottom view of the shingle of FIG. 3.

FIGS. 3 and 3A illustrate an exemplary single layer shingle 100 (which may, but need not, be similar to the single layer shingle 10 of FIG. 1) having a first, lower activation temperature line of adhesive 170 and a second, higher activation temperature line of adhesive 180, in accordance with an exemplary embodiment of the present application. As shown, the shingle 100 includes a shingle sheet 110 defining a continuous rear headlap portion 115 and a slotted or discontinuous front tab portion 117. The shingle sheet 110 includes a substrate layer 120, upper and lower asphalt coating layers 130, 140 adhered to the substrate layer, a layer of granules 150 adhered to the upper asphalt coating 130 to define an upper surface 101 of the shingle, and a layer of backdust 160 adhered to the lower asphalt coating 140 to define a lower surface 102 of the shingle 100.

Figure 4:
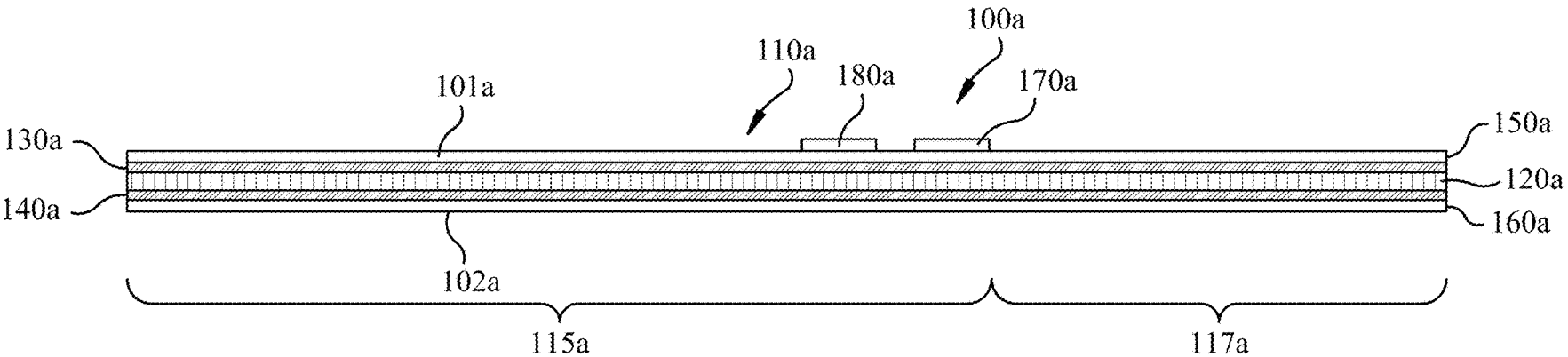
FIG. 4 is a cross-sectional side view of another exemplary embodiment of a single layer shingle.
Figure 4A:
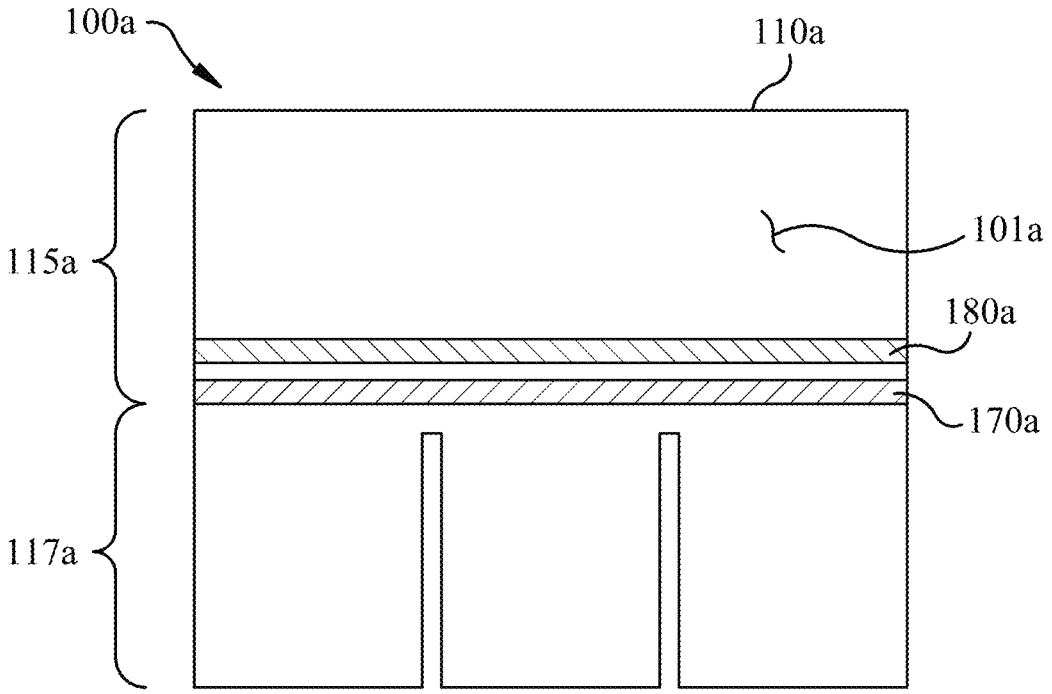
FIG. 4A is a top view of the shingle of FIG. 4.
Figure 5:
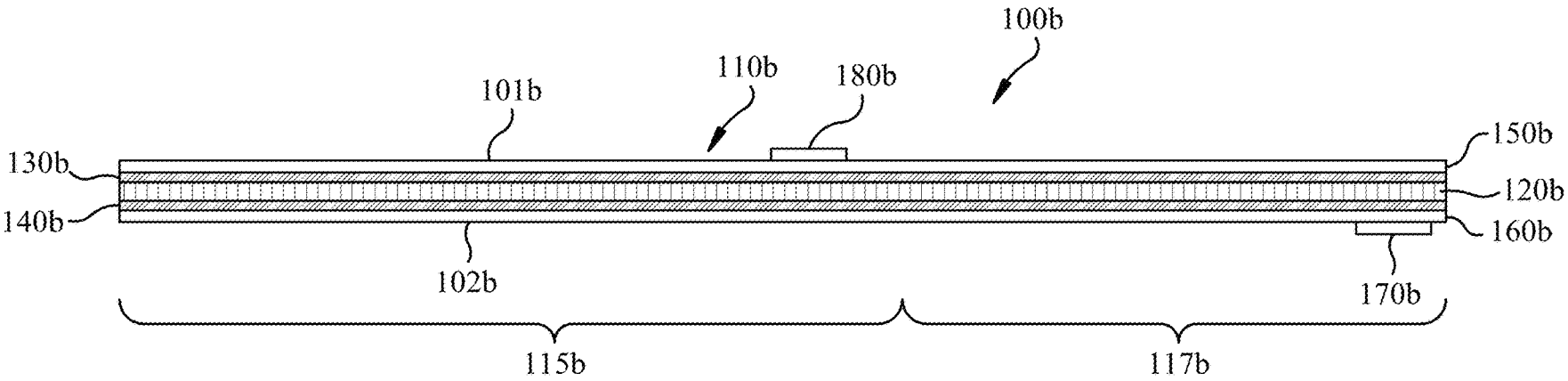
FIG. 5 is a cross-sectional side view of another exemplary embodiment of a single layer shingle.

The first and second lines of adhesive may be applied to the shingle in a variety of configurations. In the illustrated embodiment of FIGS. 3 and 3A, the first and second lines of adhesive 170, 180 are disposed on the lower surface 102 of the shingle tab portion 117, for adhesion to an upper surface of a headlap portion of an underlying shingle. In other embodiments, as shown in FIGS. 4 and 4A, a first, lower activation temperature line of adhesive 170*a* and a second, higher activation temperature line of adhesive 180*a* are disposed on an upper surface 101*a* of the shingle headlap portion 115*a*, for adhesion to a lower surface of a tab portion of an overlying shingle. In still other embodiments, as shown in FIG. 5, one of the first and second lines of adhesive 170*b*, 180*b* may be disposed on the lower surface 102*b* of the shingle tab portion 117*b*, and the other of the first and second lines of adhesive 170*b*, 180*b* may be disposed on the upper surface 101*b* of the shingle headlap portion 115*b*.

Figure 8:
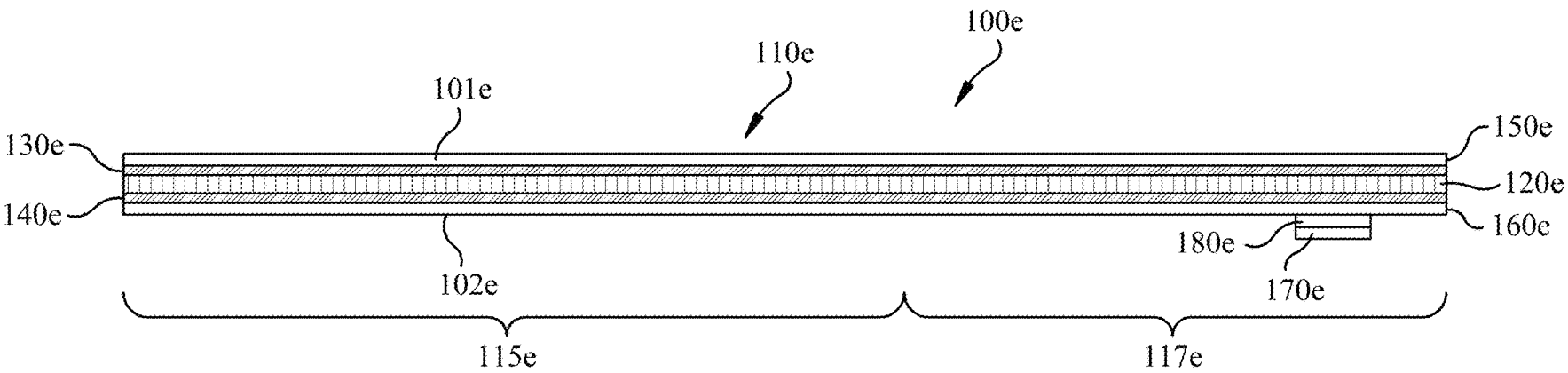
FIG. 8 is a cross-sectional side view of another exemplary embodiment of a single layer shingle.
Figure 6:
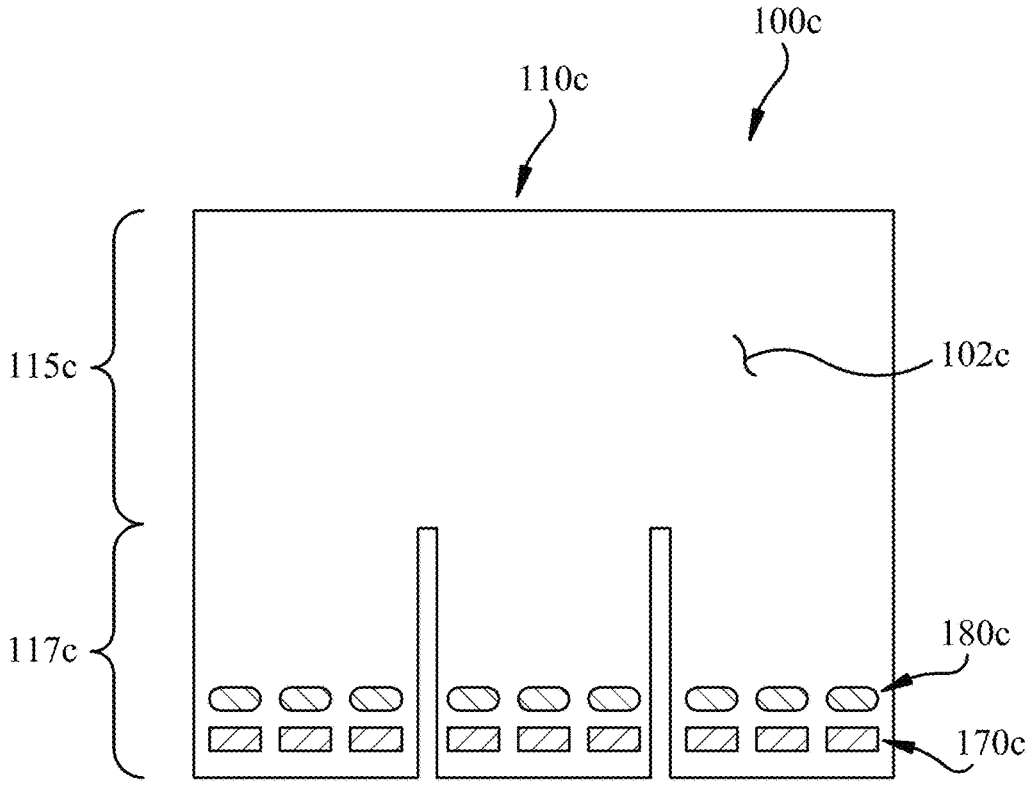
FIG. 6 is a bottom view of another exemplary embodiment of a single layer shingle.
Figure 7:
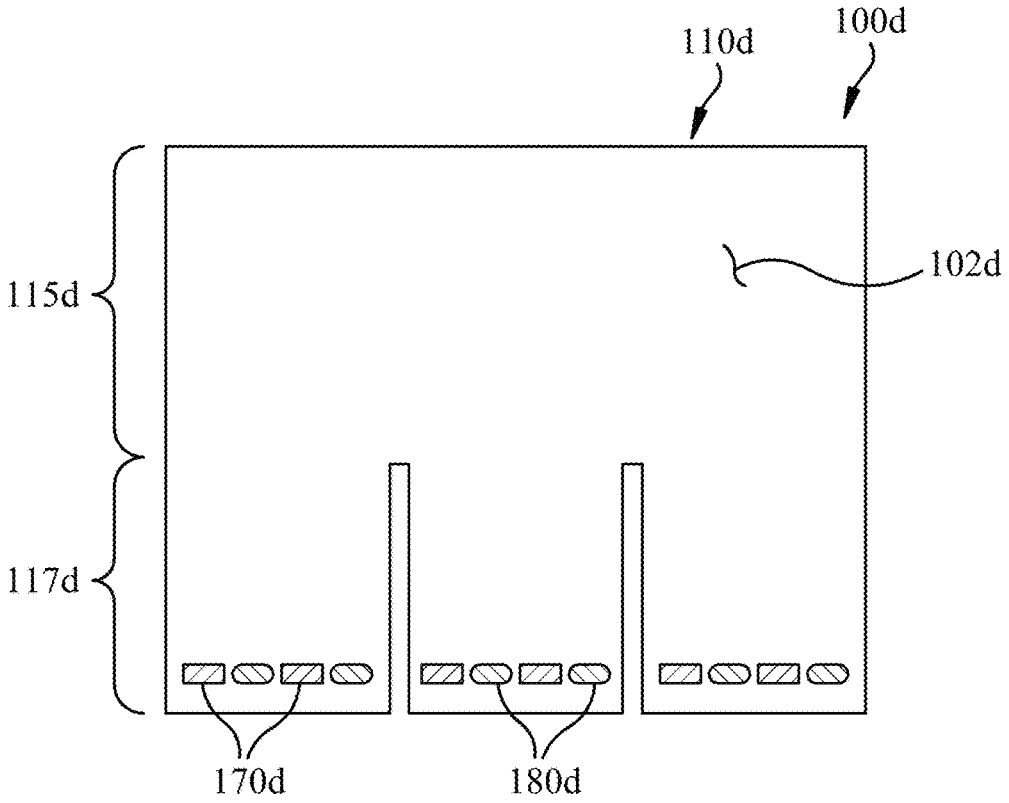
FIG. 7 is a bottom view of another exemplary embodiment of a single layer shingle.
Figure 8A:
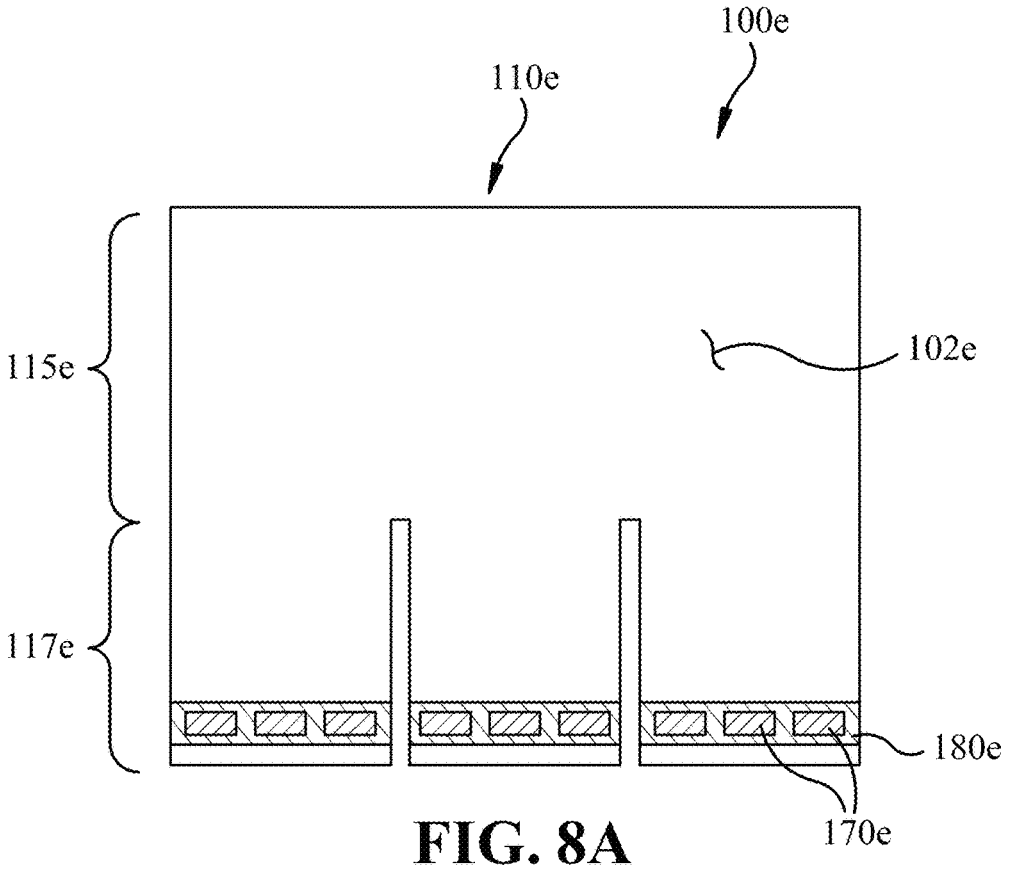
FIG. 8A is a bottom view of the shingle of FIG. 8.
Figure 9A:
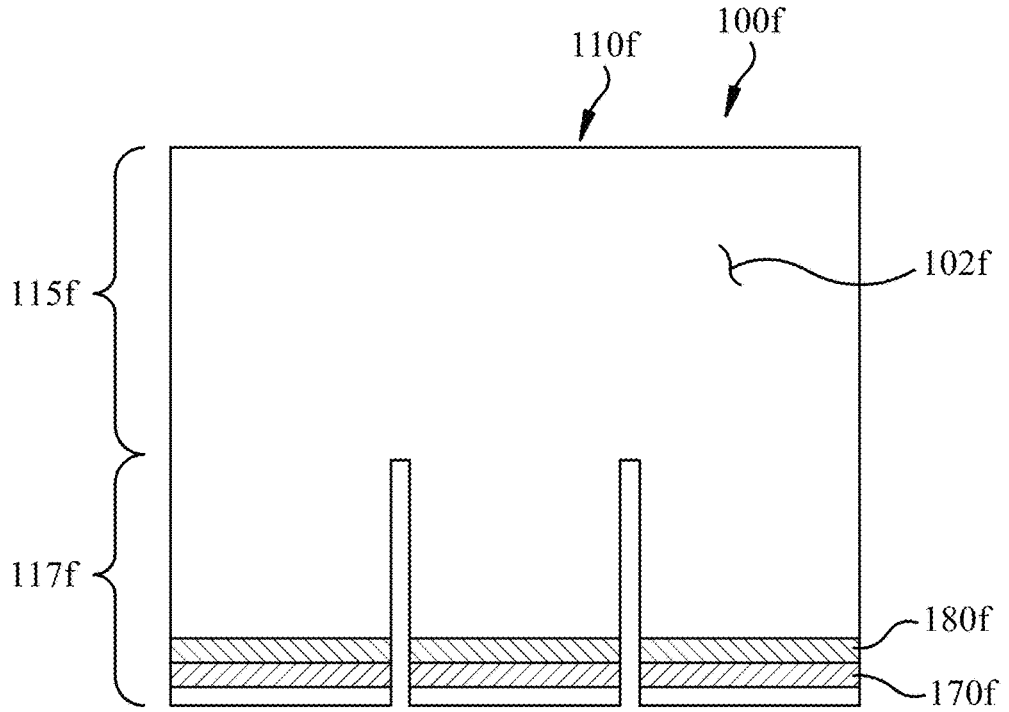
FIG. 9A is a bottom view of the shingle of FIG. 9.
Figure 9:
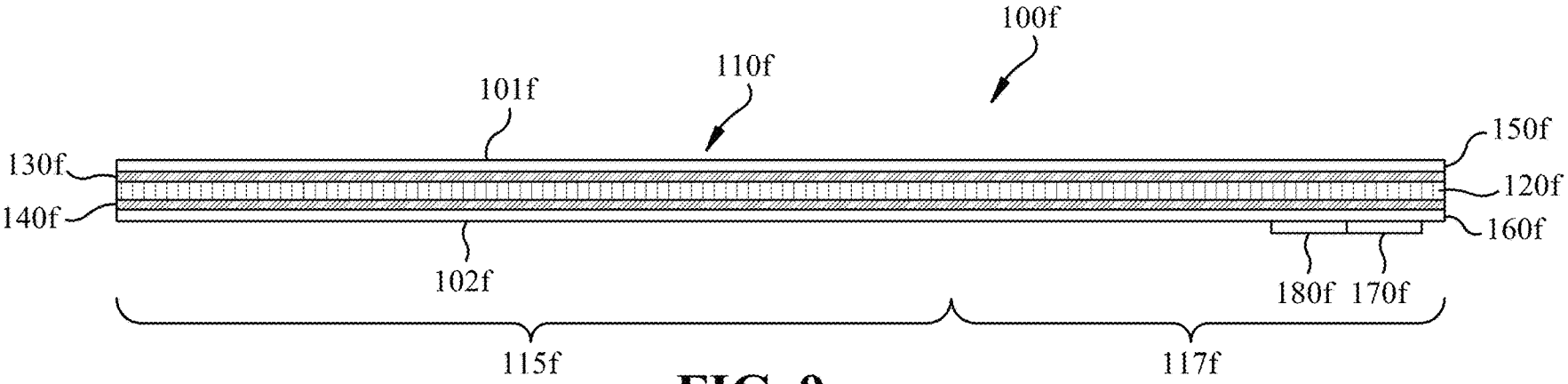
FIG. 9 is a cross-sectional side view of another exemplary embodiment of a single layer shingle.

In the illustrated embodiment of FIGS. 3 and 3A, the first and second lines of adhesive 170, 180 are continuous and laterally spaced. In other exemplary embodiments, as shown in FIG. 6, one or both of the first and second lines of adhesive 170*c*, 180*c* may be intermittent or discontinuous, with spots or bands of adhesive forming segments of the lines of adhesive. In another exemplary embodiment, as shown in FIG. 7, the first and second lines of adhesive 170*d*, 180*d* may be collinear, with alternating segments of the first and second adhesive materials extending along the adhesive line. In another exemplary embodiment, as shown in FIGS. 8 and 8A, the first and second lines of adhesive 170*e*, 180*e* may be collinear, with the first line of adhesive 170*e* being adhered to an exterior surface of the second line of adhesive 180*e*. In another embodiment, as shown in FIGS. 9 and 9A, the first and second lines of adhesive 170*f*, 180*f* may be in side-by-side abutment, and may partially overlap. Any of the adhesive arrangements of FIGS. 6-9A may be applied to the upper surface of the headlap portion (similar to the embodiment of FIGS. 4 and 4A), or to both the lower surface of the tab portion and the upper surface of the headlap portion (similar to the embodiment of FIGS. 5 and 5A).

In the illustrated embodiment of FIGS. 3 and 3A, the first, lower activation temperature line of adhesive 170 is proximate to the front edge of the shingle tab portion 117, for example, to shorten the amount of the tab portion front end that is non-adhered when only the first, lower activation temperature line of adhesive 170 has been activated (thereby reducing the front end portion of the tabs that may be exposed to wind). Similarly, in the illustrated embodiment of FIGS. 4 and 4A, the first, lower activation temperature line of adhesive 170*a* is proximate to the junction between the shingle headlap portion 115*a* and the shingle tab portion 117*a*. In other embodiments, the second, higher activation temperature line of adhesive may be disposed proximate to the front edge of the shingle tab portion (or proximate to the junction between the shingle headlap portion and the shingle tab portion), for example, to provide the eventual stronger adhesive bond closer to the front edge of the shingle.

In the illustrated embodiment of FIGS. 3 and 3A, the first and second lines of adhesive 170, 180 are shown as having substantially the same thickness. In other embodiments, the first, lower temperature line of adhesive 170 may have a greater thickness than the second, higher temperature line of adhesive 180, for example, to provide for or ensure increased contact between the first line of adhesive 170 and the adjacent shingle prior to activation of the first adhesive material.

Figure 2A:
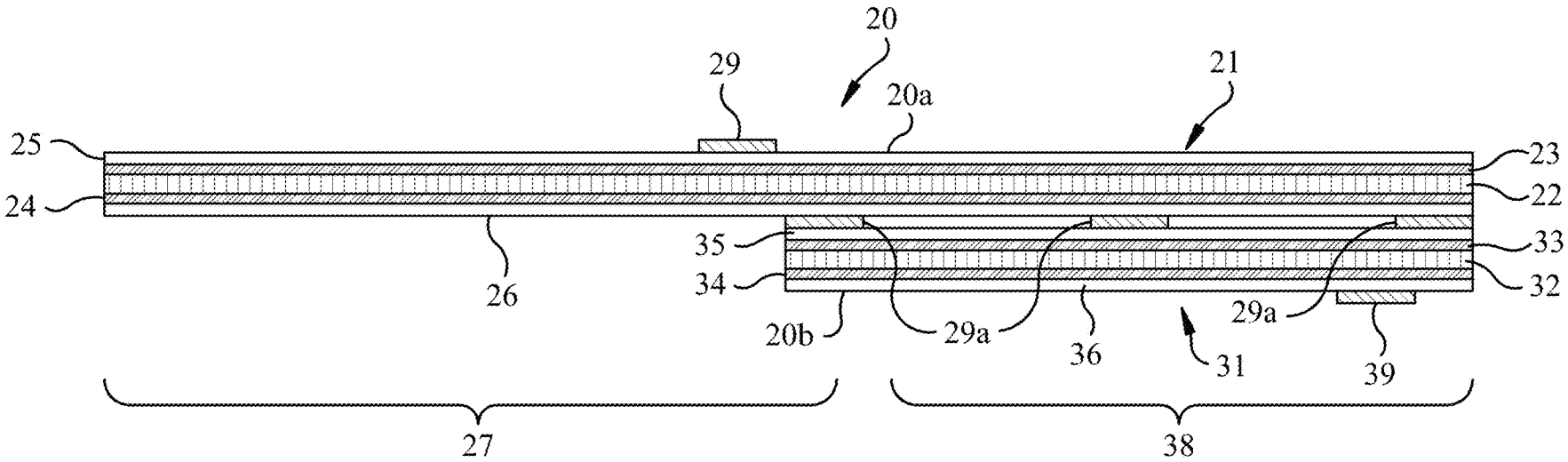
FIG. 2A (Prior Art)
FIG. 2A is a cross-sectional side view of the shingle of FIG. 2.
Figure 2:
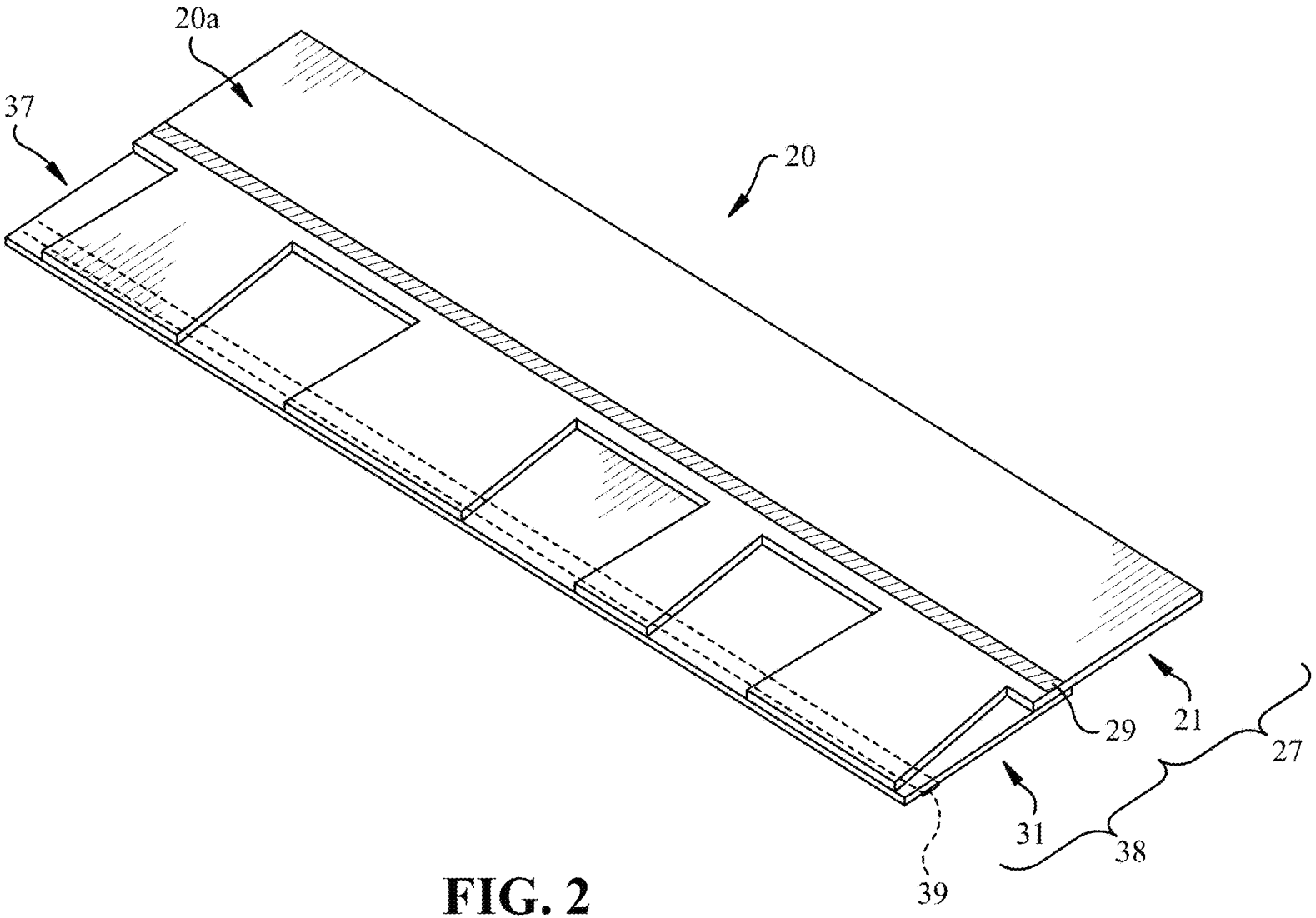
FIG. 2 (Prior Art)
FIG. 2 is an upper perspective view of an exemplary embodiment of a two-layer, laminated shingle.
Figure 10A:
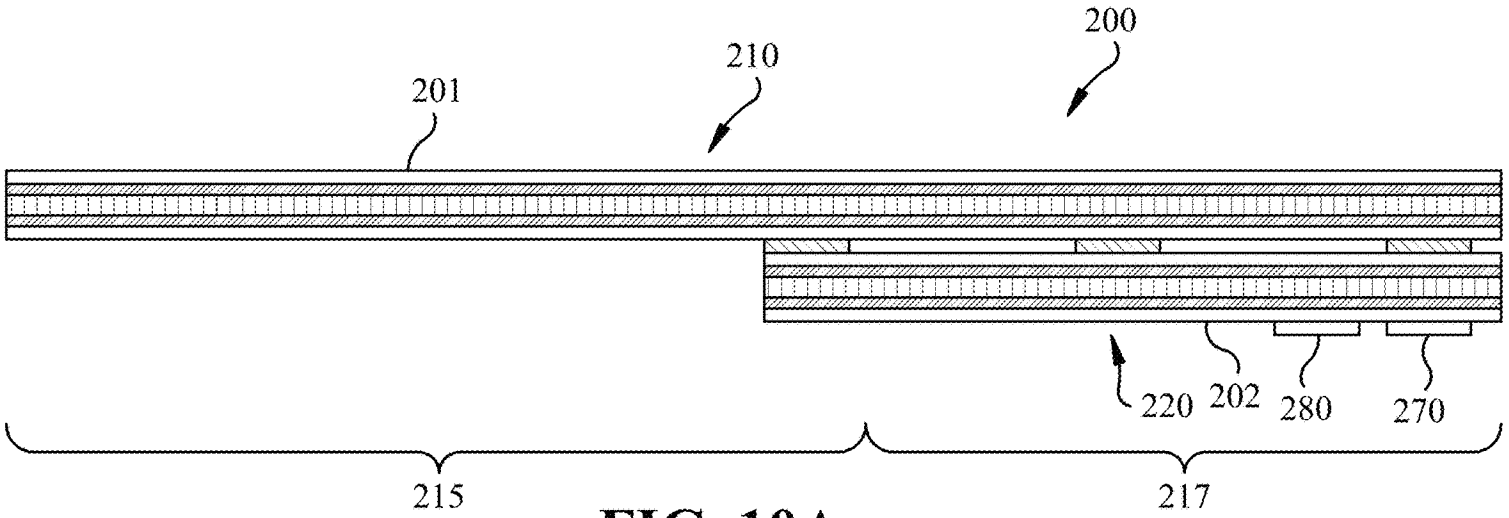
FIG. 10A is a bottom view of the shingle of FIG. 10.
Figure 10:
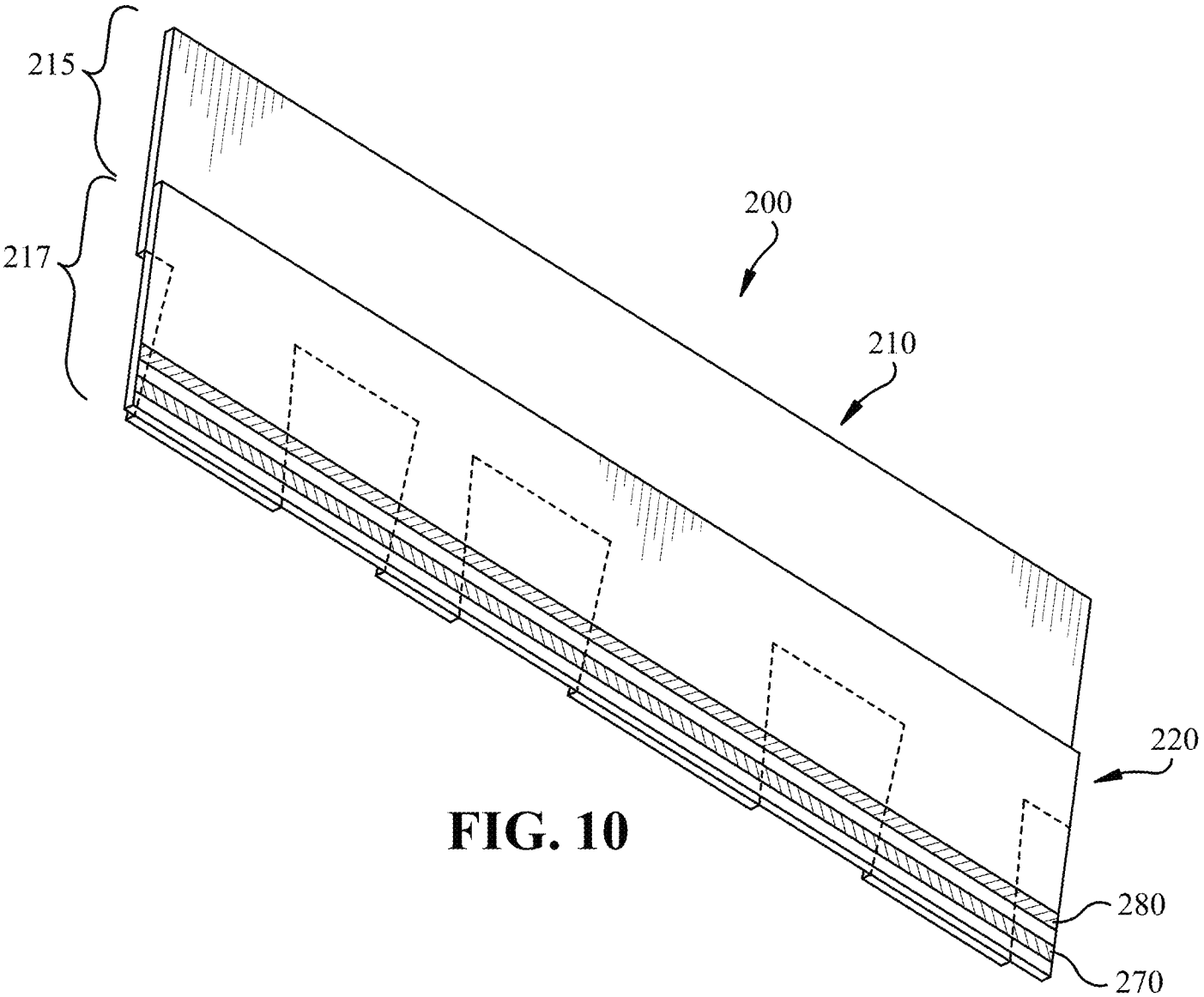
FIG. 10 is a cross-sectional side view of an exemplary embodiment of a two-layer, laminated shingle.

The adhesive arrangements described above and shown, for example, in FIGS. 3-9A, may likewise be applied to a multi-layer laminated shingle, such as, for example, the shingle 20 of FIGS. 2 and 2A. FIGS. 10 and 10A illustrate an exemplary two-layer laminated shingle 200 (which may, but need not, be similar to the laminated shingle 20 of FIGS. 2 and 2A, and uses similar reference numbers accordingly) having a first, lower activation temperature line of adhesive 270 and a second, higher activation temperature line of adhesive 280 adhered to a lower surface 202 of an underlay sheet 220, in accordance with an exemplary embodiment of the present application. The first and second lines of adhesive may be applied to the shingle in a variety of configurations, including, for example, configurations similar to the various configurations shown in the single layer shingle embodiments shown in FIGS. 4-9A and described above.

Conventional heat activated adhesives (e.g., asphalt adhesives), as applied to a shingle, are plastically compressible, flowable materials that are susceptible to being flattened (i.e., spread out and thinned) on the surface of the shingle when subjected to a compressive force, as may be expected when the shingle is included in a conventional bundle of roofing shingles (weighing about 80 pounds), and stacked under one or more other shingle bundles (e.g., on a pallet). While additional adhesive material may improve adhesion of the flattened line of adhesive, this additional material increases shingle costs and the increased original adhesive thickness to compensate for this flattening may result in shingle shape distortion of stacked shingles when stored for long periods of time.

According to another aspect of the present application, a shingle may be provided with a heat activated adhesive that is mechanically or chemically foamed, or otherwise elastically compressible, allowing for compression of the adhesive pattern during storage of the stacked shingles, and subsequent recovery or expansion of the adhesive after release or removal of this compressive force, such that the adhesive recovers, after compression, to a thickness substantially or nearly that of (e.g., at least 75% of, at least 80% of, or at least 90% of) its original thickness, to provide effective bonding of the shingle to an adjacent shingle when installed on a roof. Many different types of elastically compressible adhesive materials may be used, including, for example, thermoplastic or crosslinkable polymers or crosslinkable polymer modified asphalts.

In one such embodiment, the polymeric foam material (or other elastically compressible material) is configured such that the line of adhesive is compressible from a first, original thickness to a second thickness that is less than 25% of the first thickness when the shingle is subjected to a compressive force of about 6 psi, and subsequently expandable to a third thickness that is at least 75% of the first thickness when the compressive force is removed from the shingle.

Figure 1A:
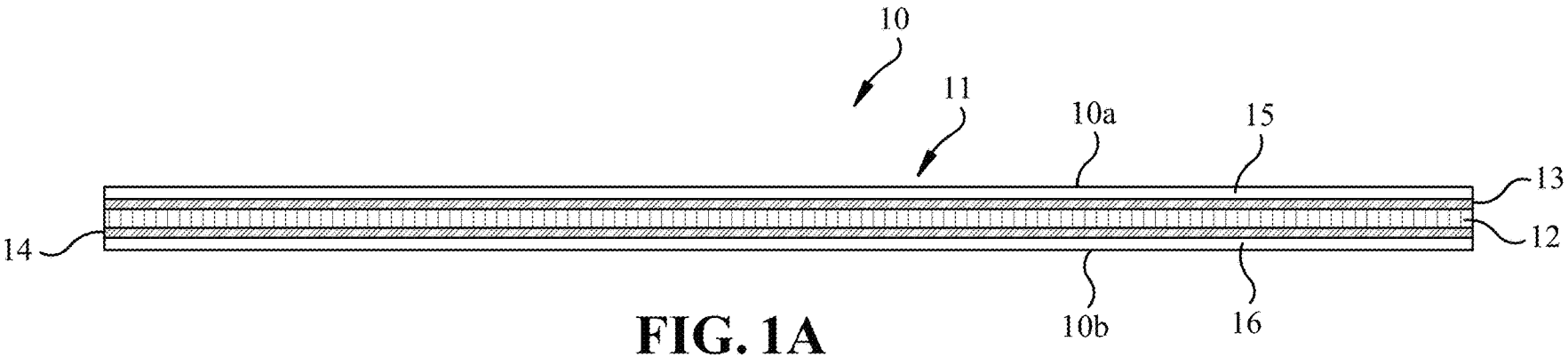
FIG. 1A (Prior Art)
FIG. 1A is a cross-sectional side view of the shingle of FIG. 1.
Figure 11A:
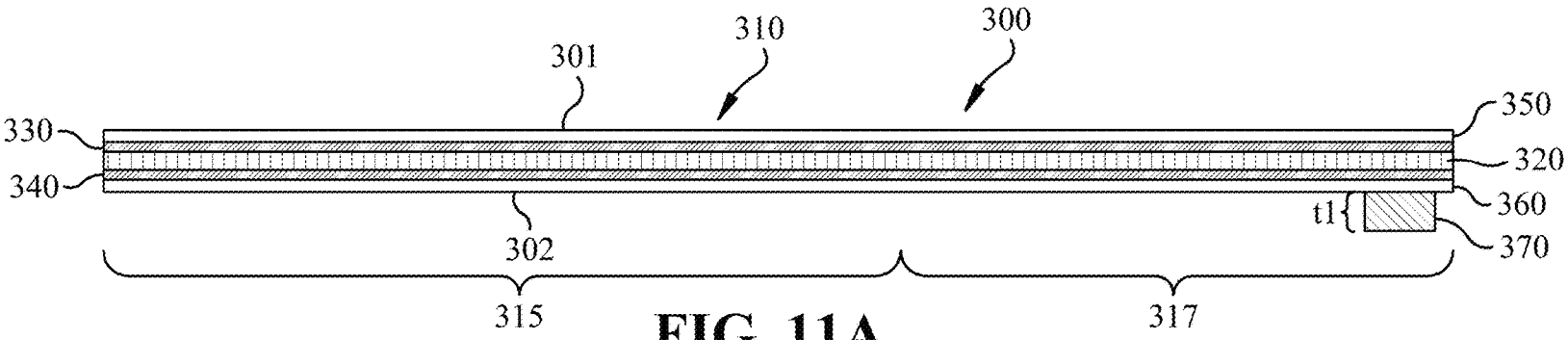
FIG. 11A is a cross-sectional side view of an exemplary embodiment of a single layer shingle, shown in an original pre-stacked condition.

FIG. 11A illustrates a single layer shingle 300 (which may, but need not, be similar to the single layer shingle 10 of FIGS. 1 and 1A) having an elastically compressible line of adhesive 370, in accordance with an exemplary embodiment of the present application. The shingle 300 includes a shingle sheet 310 defining a continuous rear headlap portion 315 and a slotted or discontinuous front tab portion 317 (having any suitable arrangement of slots or cutouts defining one or more shingle tabs). The shingle sheet 310 includes a substrate layer 320, upper and lower asphalt coating layers 330, 340 adhered to the substrate layer, a layer of granules 350 adhered to the upper asphalt coating 330 to define an upper surface 301 of the shingle, and a layer of backdust 360 adhered to the lower asphalt coating 340 to define a lower surface 302 of the shingle 300.

The line of adhesive 370 may be applied to the shingle in a variety of configurations. In the illustrated embodiment of FIG. 11A, the line of adhesive 370 is disposed on the lower surface 302 of the shingle tab portion 317, proximate the front edge of the tabs, for adhesion to an upper surface of a headlap portion of an underlying shingle. Similar to other exemplary embodiments described and shown herein, the line of adhesive may be differently positioned (e.g., on an upper surface of the headlap portion proximate the junction with the tab portion), and may be continuous or discontinuous.

Figure 11B:
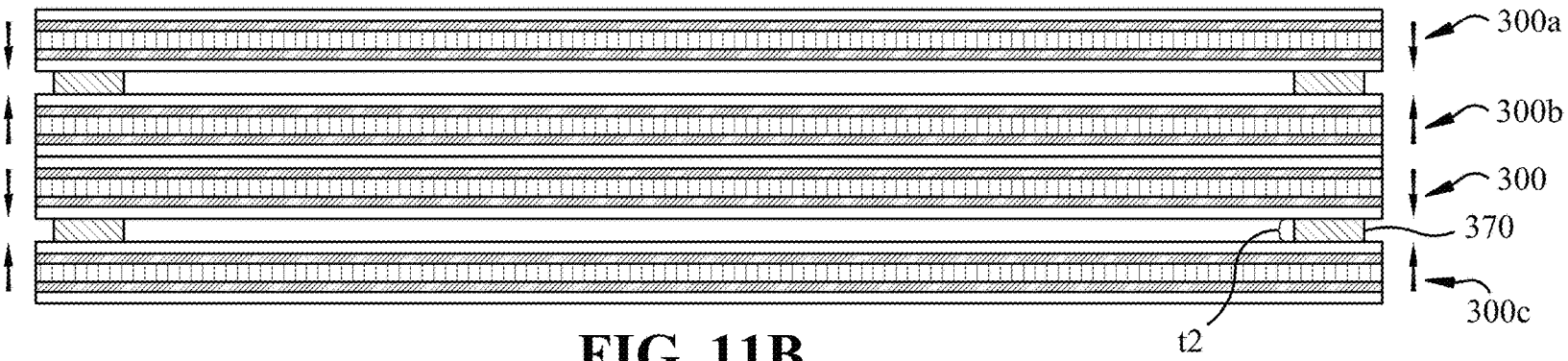
FIG. 11B is a cross-sectional side view of the shingle of FIG. 11A, shown stacked with other shingles.
Figure 11C:
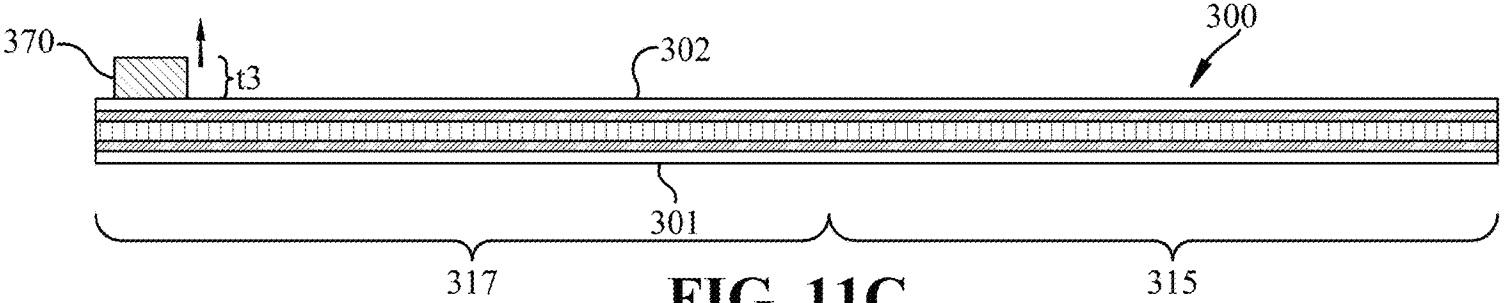
FIG. 11C is a cross-sectional side view of the shingle of FIG. 11A, shown after removal from a stack of shingles.

As shown, the line of adhesive 370 as originally provided (e.g., sprayed, pumped, printed, dispensed, or otherwise applied) has a first thickness t1. When the shingle 300 is stacked and/or bundled with other shingles 300*a*, 300*b*, 300*c* (optionally with the shingles stacked such that every other of the shingles is inverted and turned 180 degrees relative to an adjacent shingle), as shown in FIG. 11B, the line of adhesive 370 is compressible to a second thickness t2 (for example, a thickness that is less than about 50% of the first thickness t1, or less than about 25% of the first thickness t1), for example, due to compressive forces applied to the adhesive as a result of the weight of the shingles stacked on top of the shingle 300, or the tightness of the bundling (e.g., a compressive force of about 5 or 6 psi). When the shingle 300 is separated from the stack of shingles, for example, for installation on a roof, as shown in FIG. 11C, the line of adhesive 370 expands or recovers to a third thickness t3 that may be substantially, nearly, or approaching that of (e.g., at least about 75% of, at least about 80% of, or at least about 90% of) the original, first thickness t1. When applying the line of adhesive 370 to the shingle 300, the original thickness t1 of the adhesive may be selected based on the expected expansion or recovery of the compressed line of adhesive, to provide a recovered thickness t3 that is sufficient to provide an effective adhesive bond with the adjacent installed shingle. In an exemplary embodiment, a shingle is provided with a line of adhesive having an original, first thickness t1 of about 0.04 inches to about 0.05 inches, a compressed, second thickness t2 (e.g., resulting from a compressive force of about 6 psi) of less than about 0.01 inches to less than about 0.0125 inches, and a recovered, third thickness of at least about 0.03 inches to at least about 0.0375 inches.

Figure 12A:
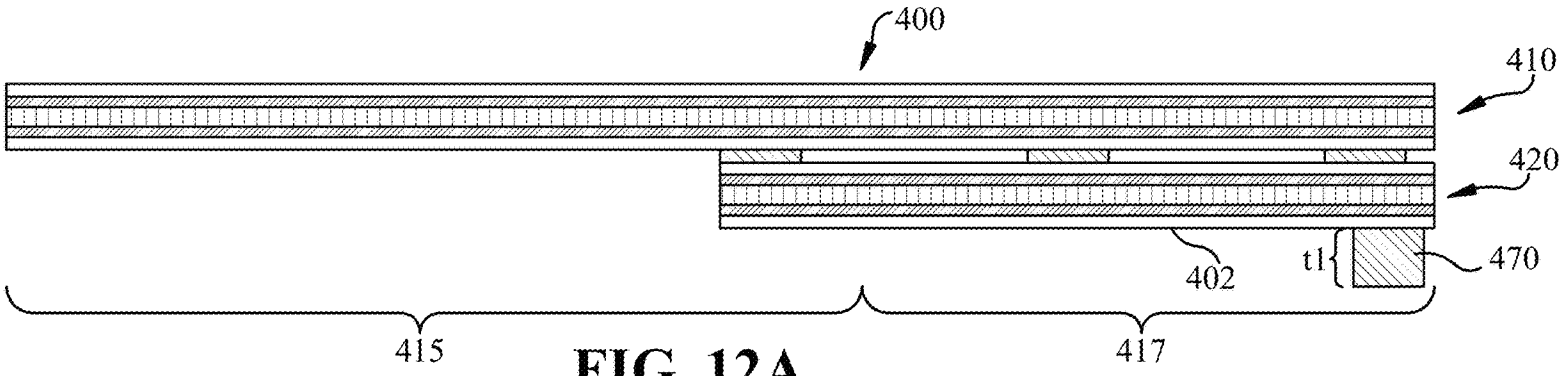
FIG. 12A is a cross-sectional side view of an exemplary embodiment of a two-layer, laminated shingle, shown in an original pre-stacked condition.

FIG. 12A illustrates a two-layer, laminated shingle 400 (which may, but need not, be similar to the laminated shingle 20 of FIGS. 2 and 2A, and uses similar reference numbers accordingly) having an elastically compressible line of adhesive 470, in accordance with an exemplary embodiment of the present application. The line of adhesive 470 is disposed on the lower surface 402 of the underlay sheet 420 in the shingle tab portion 417, proximate the front edge of the tabs, for adhesion to an upper surface of a headlap portion of an underlying shingle. Similar to other exemplary embodiments described and shown herein, the line of adhesive may be differently positioned (e.g., on an upper surface of the headlap portion proximate the junction with the tab portion), and may be continuous or discontinuous.

Figure 12B:
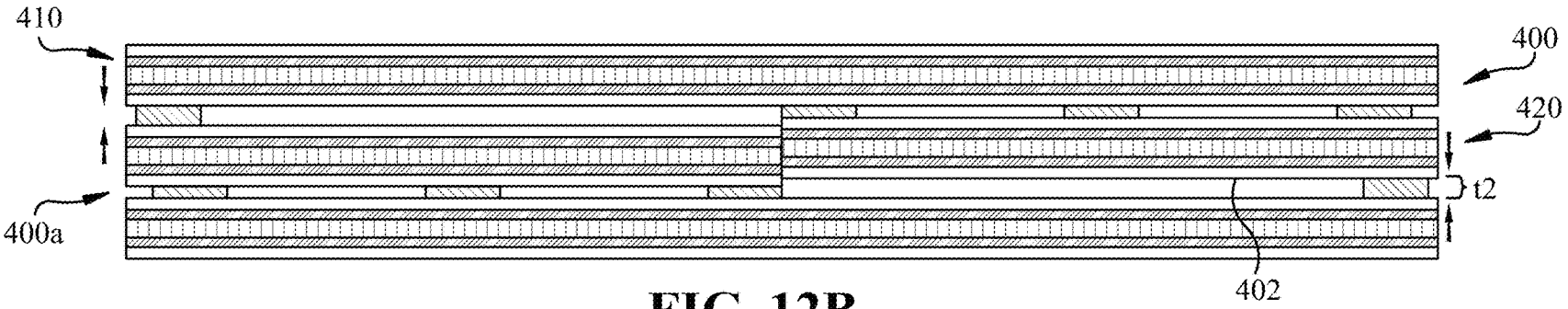
FIG. 12B is a cross-sectional side view of the shingle of FIG. 12A, shown stacked with other shingles.
Figure 12C:
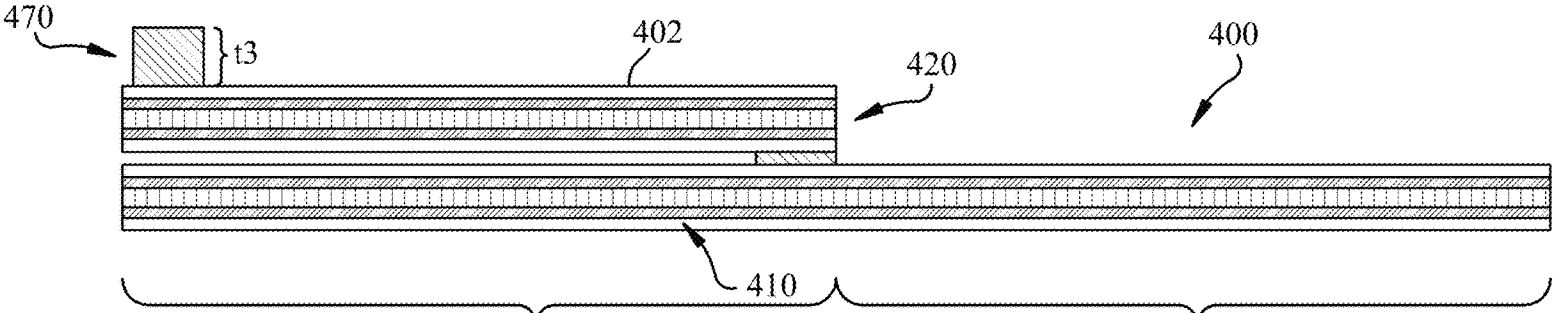
FIG. 12C is a cross-sectional side view of the shingle of FIG. 11A, shown after removal from a stack of shingles.

As shown, the line of adhesive 470 as originally provided (e.g., sprayed, pumped, printed, dispensed, or otherwise applied) has a first thickness t1. When the shingle 400 is stacked and/or bundled with other shingles 400*a* (optionally with the shingles stacked such that every other of the shingles is inverted and turned 180 degrees relative to an adjacent shingle), as shown in FIG. 12B, the line of adhesive 470 is compressible to a second thickness t2 (for example, a thickness that is less than about 50% of the first thickness t1 or a thickness that is less than about 25% of the first thickness t1), for example, due to compressive forces applied to the adhesive as a result of the weight of the shingles stacked on top of the shingle 400, or the tightness of the bundling (e.g., a compressive force of about 5 or 6 psi). When the shingle 400 is separated from the stack of shingles, for example, for installation on a roof, as shown in FIG. 12C, the line of adhesive 470 expands or recovers to a third thickness t3 that may be substantially, nearly, or approaching that of (e.g., at least about 75% of, at least about 80% of, or at least about 90% of) the original, first thickness t1. When applying the line of adhesive 470 to the shingle 400, the original thickness t1 of the adhesive may be selected based on the expected expansion or recovery of the compressed line of adhesive, to provide a recovered thickness t3 that is sufficient to provide an effective adhesive bond with the adjacent installed shingle.

In other embodiments, a second line of adhesive may be provided, in addition to the elastically compressible line of adhesive, to adapt the shingle for bonded installation in a variety of environments (e.g., a variety of temperature conditions). For example, a shingle may include a first line of sealant formed from a heat sensitive or thermally activated foamed adhesive material having a first minimum activation temperature (e.g., about 135° F.), and a second line of sealant formed from a non-foamed (i.e., substantially plastically compressible) adhesive material having a second activation temperature (e.g., about 20° F.) lower than the first minimum activation temperature. In one such embodiment, the exterior surface of the first, higher activation temperature line of foamed adhesive may be coated with a second, lower activation temperature line of non-foamed adhesive, such that initial adhesive contact with an adjacent shingle is made by the lower activation temperature line of adhesive, for more immediate adhesion at lower temperatures.

In an alternative embodiment, a shingle may be provided with a polymer foam material that includes an adhesive on a top surface and/or a bottom surface thereof. The polymer foam material is capable of being compressed during storage of the stacked shingles, and subsequently recovering or expanding after release or removal of the compressive forces due to the weight of the stacked shingles. The polymer foam material may be applied to the shingle in any of various arrangements described herein with respect to the lines, beads, or segments of adhesive. For example, a first line of polymer foam material may be adhered to one of an upper surface of a headlap portion of a shingle and a lower surface of a tab portion of a shingle, and a second line of polymer foam material may be adhered to one of the upper surface of the headlap portion of the shingle and the lower surface of the tab portion of the shingle. The first line of polymer foam material may include a first adhesive comprising a first thermally activated adhesive material on a top surface and/or a bottom surface thereof. The second line of polymer foam material may include a second adhesive comprising a second thermally activated adhesive material having a minimum activation temperature less than a minimum activation temperature of the first thermally activated adhesive material. Exemplary polymer foam materials include, but are not limited to, acrylic foams, polyethylene foams, urethane foams, sponge rubber foams, and vinyl foams. The polymer foam may be an open-cell foam or a closed-cell foam. The adhesive applied to a surface of the polymer foam may be any of the adhesives or sealants described herein.

According to another aspect of the present application, a shingle may be provided with a heat activated adhesive or sealant that comprises an inert material to resist compression or flattening. The adhesive has a lower activation temperature. The inert material may be sea sand or another inert, substantially spherical, proppant-type material, non-limiting examples of which include: limestone, talc, dolomite, sand (including sea sand), glass spheres, granule fines, and other like materials. In certain embodiments, the inert material has a particle size such that preferably 100% passing 100 mesh. In certain embodiments, the inert material has a particle size from 100% passing 40 mesh screens, including 100% retained on the 140 mesh screen to 100% passing 20 mesh, 100% retained on 50 mesh screen and preferably in the range of 100% passing 40 mesh, 100% retained on 100 mesh.

The purpose of the inert material is to reduce or minimize the compressibility of the bead. Desirable properties of the inert material include reinforcement strength, provide little impact on viscosity of the adhesive, non-absorbancy, and it should not reduce the tack of the adhesive at activation temperature. In certain embodiments, a bead (or line) of first adhesive has a first thickness. In certain embodiments, the first bead of adhesive comprises an inert material and resists compression such that it is compressible to at least about 75% of, at least about 80% of, or at least about 90% of the original, first thickness t1. In certain embodiments, a bead of a first adhesive comprises an inert material in an amount of 10% to 70% by weight of the first adhesive. In certain embodiments, a bead of a first adhesive comprises an inert material in an amount of 20% to 60% by weight of the first adhesive.

As another example, a shingle may include a first line of sealant formed from a first, higher activation temperature foamed adhesive material, and a second line of sealant formed from a second, lower activation temperature foamed adhesive material. The first and second lines of foamed thermally activated adhesive may be provided in a variety of arrangements and locations on single layer or two-layer shingles as described above and shown in the exemplary embodiments of FIGS. 3-10A. While the first and second lines of adhesive may have substantially the same original (pre-compression) thickness (t1), and/or substantially the same post-recovery thickness (t3), in other embodiments, the second, lower temperature line of adhesive may have a greater thickness than the first, higher temperature line of adhesive, for example, to provide for or to ensure increased contact between the first line of adhesive and the adjacent shingle prior to activation of the first adhesive material.

Figure 13:
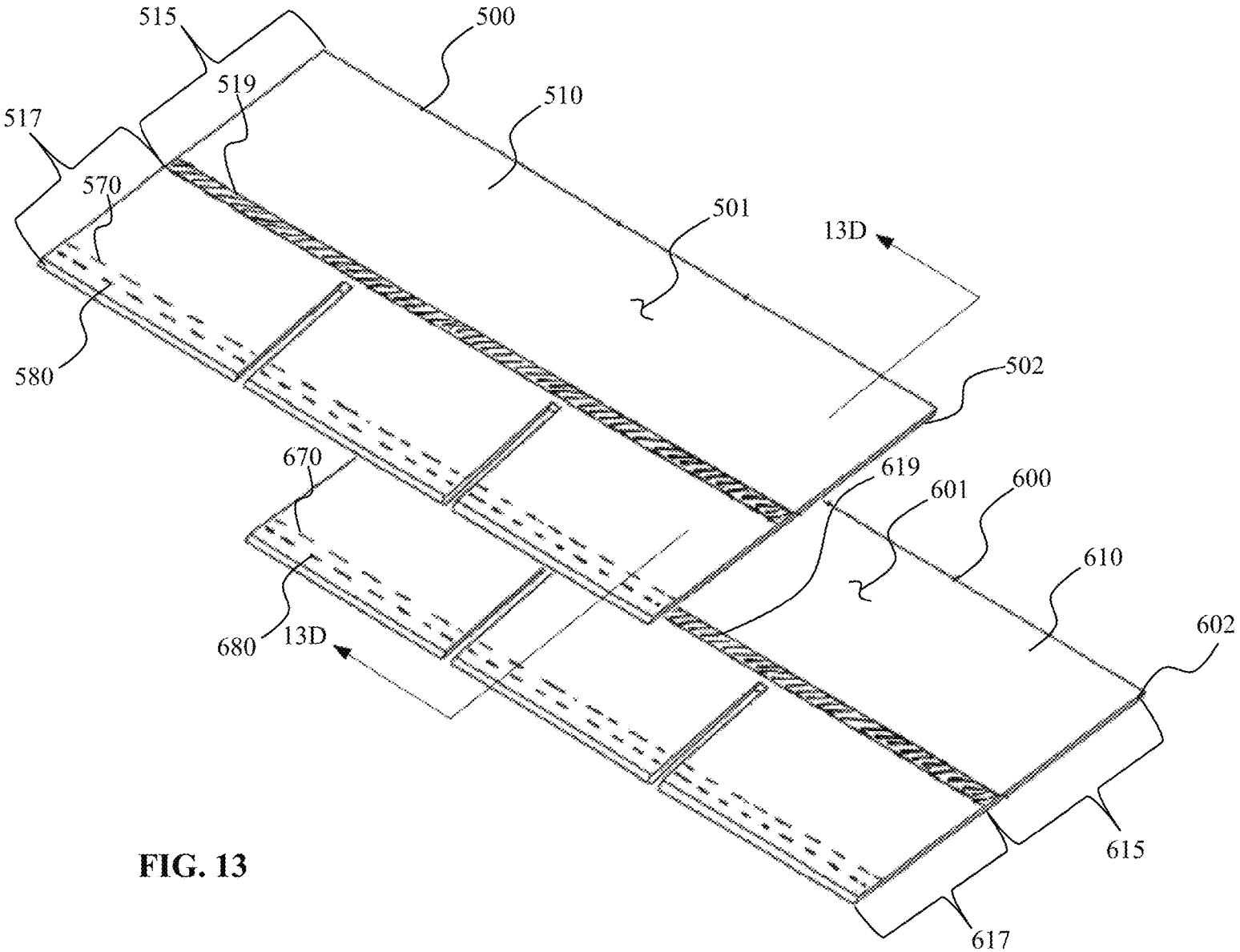
FIG. 13 is an upper perspective view of an exemplary embodiment of a pair of single layer shingles.

FIG. 13 illustrates exemplary single layer shingles 500, 600 which may, but need not, be similar to the single layer shingle 10 of FIG. 1, each having a first sealant 570, 670 (shown in phantom) and a second sealant 580, 680 (shown in phantom) in accordance with an exemplary embodiment of the present application. As shown, each shingle 500, 600 includes a shingle sheet 510, 610 defining a continuous rear headlap portion 515, 615 and a slotted or discontinuous front tab portion 517, 617. Each shingle sheet 510, 610 may include a substrate layer, upper and lower asphalt coating layers adhered to the substrate layer (e.g., a non-woven web of glass fibers), a layer of granules adhered to the upper asphalt coating to define an upper surface 501, 601 of the shingle sheets 510, 610, and a layer of backdust adhered to the lower asphalt coating to define a lower surface 502, 602 of the shingle sheets 510, 610.

With continued reference to FIG. 13, each shingle 500, 600 may also include a channel or recess 519, 619 formed on the headlap portion 515, 615 of the upper surface 501, 601 of the shingle sheet 510, 610. The channel 519, 619 defines or is positioned in a "nail zone" of the shingle 500, 600, which, among other things, provides a visual indication to the shingle installer as to the proper location on the shingle to secure the shingle to a roof deck with nails. In other embodiments, the nail zone can be identified by other visual indicators, such as paint.

The channel 519, 619 may be formed in a variety of ways. In certain embodiments, the channel 519, 619 may be formed by attaching a reinforcement material to the shingle sheet 510, 610 by the upper asphalt coating layer. However, the reinforcement material may be attached to the shingle sheet 510, 610 by any suitable means, such as other adhesives. When attached to the shingle sheet 510, 610, the reinforcement material is recessed with respect to the upper surface 501, 601 of the shingle sheet 510, 610. In other words, the reinforcement material defines the channel 519, 619 on the upper surface 501, 601 of the shingle sheet 510, 610.

The reinforcement material may be formed from a variety of materials that reinforce and strengthen the nail zone of a shingle. In certain embodiments, the reinforcement material may be formed from paper, polymer film, scrim material, woven glass, or non-woven glass. In one embodiment, the reinforcement material is formed from polyester. In another embodiment, the reinforcement material is formed from polyolefin, such as polypropylene or polyethylene. In yet another embodiment, the reinforcement material is formed from non-woven glass. In certain embodiments, the reinforcement material may be perforated or otherwise porous.

In certain embodiments, the channel 519, 619 may be formed by a layer of granules on the upper surface 501, 601 of the shingle sheet 510, 610 that comprise granules which are at least 50% smaller than granules applied to the remainder of the upper surface 501, 601 of the shingle sheet 500, 600. In certain embodiments, the layer of granules forming the channel 519, 619 comprise granules which are at least 75% smaller, including at least 80% smaller, at least 85% smaller, and also including at least 90% smaller than the granules applied to the remainder of the upper surface 501, 601 of the shingle sheet 510, 610. In certain embodiments, the layer of small granules forming the channel 519, 619 may be the same material used for the layer of backdust (e.g., pulverized sand, talc, mica, calcium carbonate, ground recycled glass).

In certain embodiments, the channel 519, 619 can be achieved by reducing the thickness and/or the amount of asphalt coating applied to a portion of the headlap portion 515, 615 of the upper surface 501, 601 of the shingle sheet 510, 610. In certain embodiments, the channel 519, 619 can be achieved by a combination of a layer of small granules and a reduction in the thickness and/or the amount of asphalt coating applied to a portion of the headlap portion 515, 615 of the upper surface 501, 601 of the shingle sheet 510, 610. In certain embodiments, the channel 519, 619 can be achieved by a combination of a reinforcement material and a reduction in the thickness and/or the amount of asphalt coating applied to a portion of the headlap portion 515, 615 of the upper surface 501, 601 of the shingle sheet 510, 610.

The first sealant 570, 670 and the second sealant 580, 680 may be applied to the shingle 500, 600 in a variety of configurations. As seen in FIG. 13, the first sealant 570 and the second sealant 580 of shingle 500 are disposed (e.g., sprayed, pumped, printed, dispensed, or otherwise applied) on the lower surface 502 of the shingle tab portion 517 for adhesion to the upper surface 601 of the headlap portion 615 of underlying shingle 600, such as on the channel 619 of underlying shingle 600. In other embodiments, the first sealant 570, 670 and the second sealant 580, 680 may be disposed (e.g., sprayed, pumped, printed, dispensed, or otherwise applied) on the upper surface 601 of the shingle headlap portion 615 for adhesion to the lower surface 502 of the shingle tab portion 517 of overlying shingle 500.

The first sealant 570, 670 comprises an adhesive material that is capable of sealing, bonding, or otherwise adhering together asphalt shingles at a low temperature. As used in this context, the term "low temperature" refers to a temperature of less than 70° F. In certain embodiments, the first sealant 570, 670 is capable of sealing, bonding, or otherwise adhering together asphalt shingles at a temperature of from 0° F. to 70° F., including from 20° F. to 60° F., from 20° F. to 50° F., from 20° F. to 40° F., and also including from 20° F. to 32° F.

The second sealant 580, 680 may comprise a heat sensitive or thermally activated adhesive that bonds shingles together when the shingles are exposed to a minimum activation temperature of the adhesive, for example, due to warmer ambient temperatures and/or direct sun exposure. In certain embodiments, the second sealant 580, 680 may comprise filled asphalt, which typically has a minimum activation temperature of about 135° F. In other embodiments, the second sealant 580, 680 may comprise a polymer modified asphalt, which may have a minimum activation temperature ranging from 70° F. to 100° F. Typically, the second sealant 580, 680 will have a higher resistance to creep deformation than the first sealant 570, 670 and will be more stiff than the first sealant 570, 670. However, the first sealant 570, 670 will typically be more tacky than the second sealant 580, 680, particularly at temperatures less than 100° F.

Figure 13A:
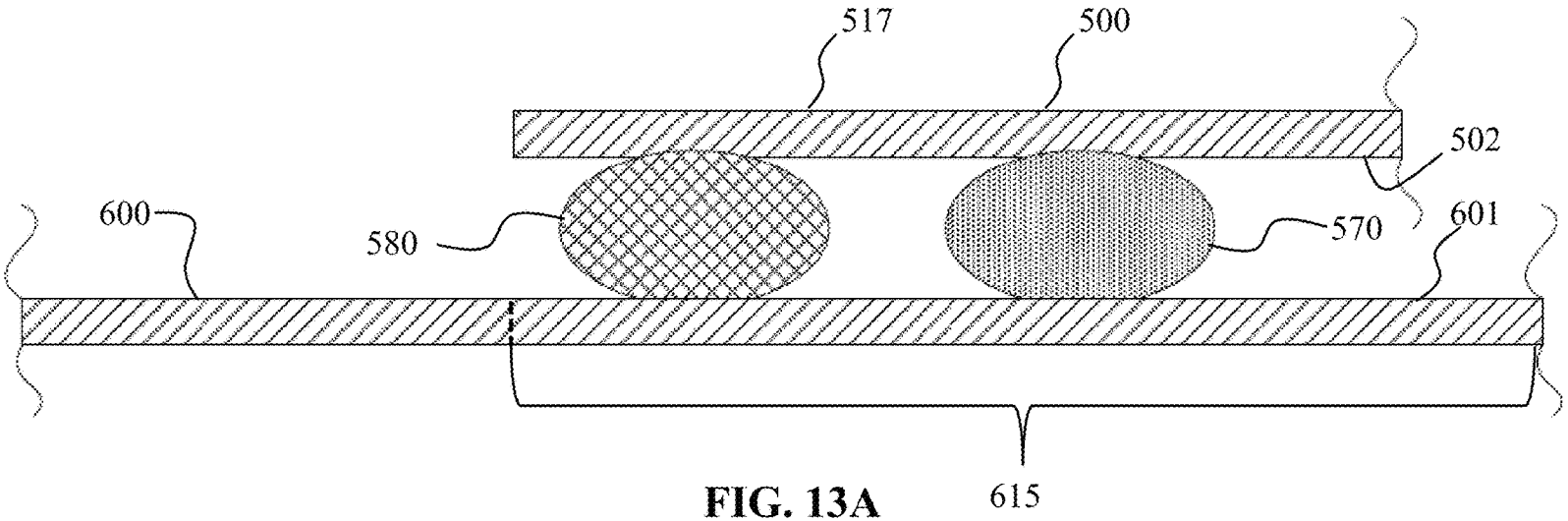
FIG. 13A is a partial cross-sectional side view of a pair of single layer shingles.

FIGS. 13A-13D illustrate the importance of the size and spacing of a bead of the first sealant 570 with respect to a bead of the second sealant 580. As seen in FIGS. 13A-13D, overlying shingle 500 includes a bead of the first sealant 570 and a bead of the second sealant 580 disposed on the lower surface 502 of the shingle tab portion 517 for adhesion to the upper surface 601 of the headlap portion 615 of underlying shingle 600. In FIG. 13A, the bead of the first sealant 570 and the bead of the second sealant 580 are spaced apart on the lower surface 502 of the shingle tab portion 517 and are substantially the same size. In the configuration illustrated in FIG. 13A, the first sealant 570 of overlying shingle 500 will be prone to immediately sticking or adhering to the upper surface 601 of underlying shingle 600, which hinders sliding and/or repositioning of overlying shingle 500 during installation.

Figure 13B:
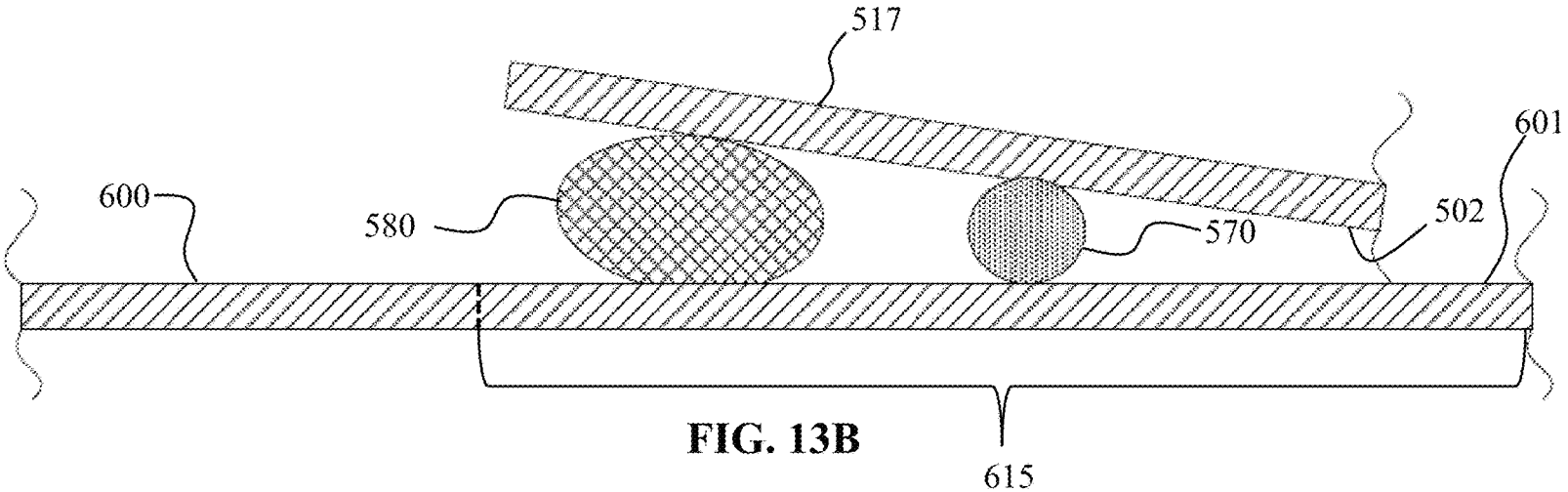
FIG. 13B is a partial cross-sectional side view of a pair of single layer shingles.

In FIG. 13B, the bead of the first sealant 570 and the bead of the second sealant 580 are spaced apart on the lower surface 502 of the shingle tab portion 517, and the bead of the first sealant 570 has a smaller size compared to the bead of the second sealant 580. In the configuration illustrated in FIG. 13B, although the bead of the first sealant 570 is smaller in size compared to the bead of the second sealant 580, the shingle tab portion 517 of overlying shingle 500 will tend to flex or bend which may cause the first sealant 570 of overlying shingle 500 to come into contact with and immediately stick or adhere to the upper surface 601 of underlying shingle 600, which hinders sliding and/or repositioning of overlying shingle 500 during installation.

Figure 13C:
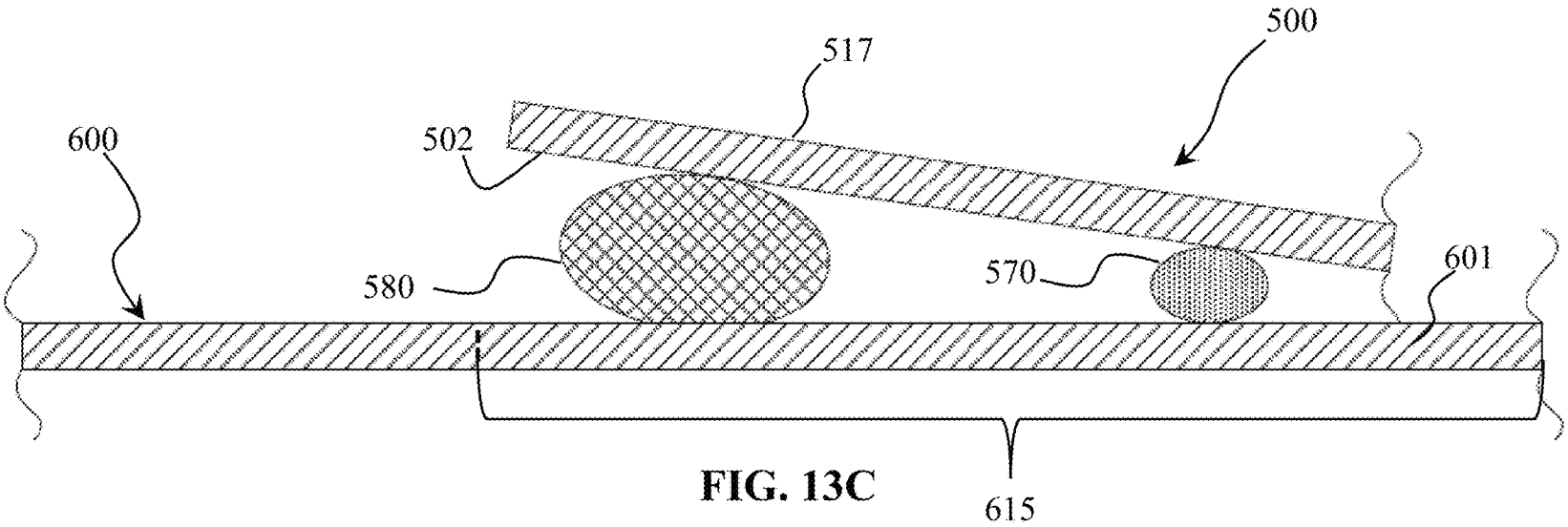
FIG. 13C is a partial cross-sectional side view of a pair of single layer shingles.

As seen in FIG. 13C, the bead of the first sealant 570 and the bead of the second sealant 580 are spaced apart on the lower surface 502 of the shingle tab portion 517, and the bead of the first sealant 570 has a smaller size compared to the bead of the second sealant 580. In the configuration illustrated in FIG. 13C, while the bead of the first sealant 570 is smaller in size compared to the bead of the second sealant 580, the spacing between the bead of the first sealant 570 and the bead of the second sealant 580 is too great such that the first sealant 570 of overlying shingle 500 would contact and immediately stick or adhere to the upper surface 601 of underlying shingle 600, which would also hinder sliding and/or repositioning of overlying shingle 500 during installation.

To address the problem associated with the bead of the first sealant 570 of the overlying shingle 500 sticking or adhering to the underlying shingle 600 (or a roof deck), the bead of the first sealant 570 is sized and spaced with respect to the bead of the second sealant 580 such that the bead of the first sealant 570 is spaced apart from the upper surface 601 of the underlying shingle 600 (or roof deck) when the overlying shingle 500 is placed upon the underlying shingle 600 (or roof deck). An example of this configuration is illustrated in FIG. 13D.

Figure 13D:
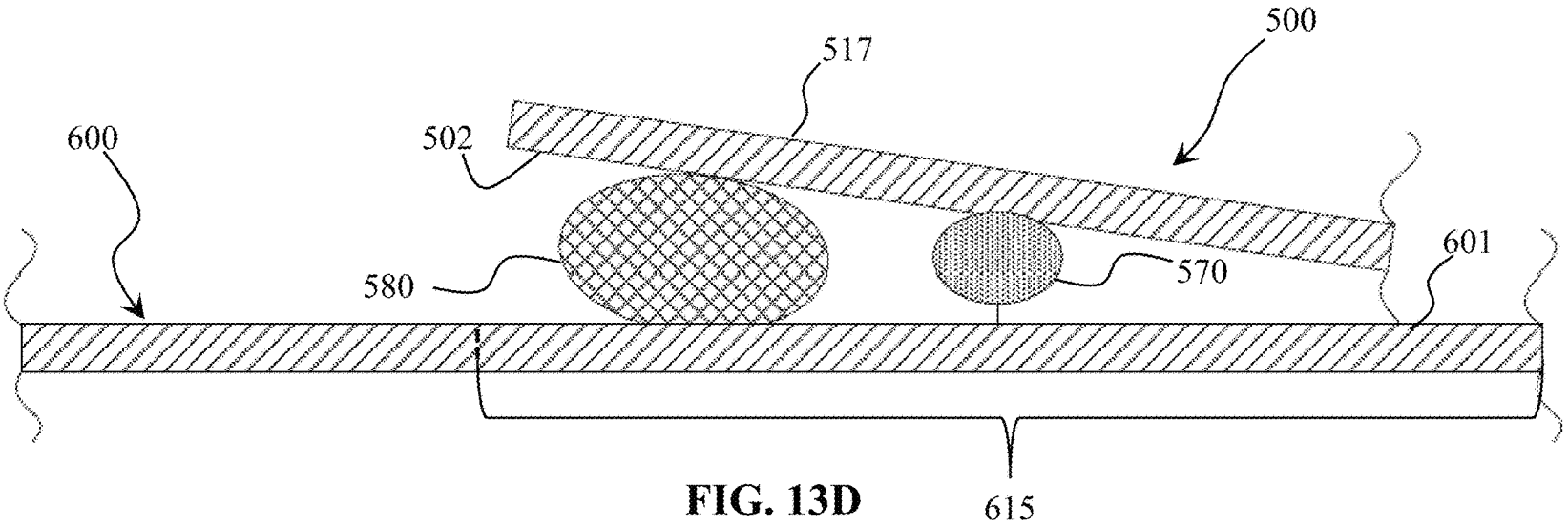
FIG. 13D is a partial cross-sectional side view of the pair of shingles shown in FIG. 13 along section line 13D-13D.

As seen in FIG. 13D, the bead of the first sealant 570 has a smaller size compared to the bead of the second sealant 580 and is spaced from the bead of the second sealant 580 such that the bead of the first sealant 570 is spaced apart from the upper surface 601 of the underlying shingle 600 when the overlying shingle 500 is placed upon the underlying shingle 600 (or roof deck or other planar surface). The bead of the second sealant 580 contacts the upper surface 601 of the underlying shingle 600 (or roof deck), but since the second sealant 580 is much less tacky than the first sealant 570, particularly at temperatures less than 70° F. (i.e., low temperatures), the overlying shingle 500 remains capable of sliding and/or being repositioned during installation without sticking or adhering to the underlying shingle 600 (or roof deck). The same is true for temperatures greater than 70° F. At temperatures greater than 70° F., the bead of the first sealant 570 will typically be very tacky compared to the bead of the second sealant 580. In certain embodiments, the bead of the second sealant 580 does not become too tacky (so as to interfere with the ability of the shingle to slide or be repositioned) until a temperature of about 160° F. to about 180° F., whereas the bead of the first sealant 570 becomes too tacky at a temperature of 70° F. or higher. In one exemplary embodiment, the sealant 570 in the configuration illustrated by FIG. 13D is intentionally brought into contact with the underlying shingle 600 when the overlying shingle 500 is installed. For example, the sealant 580 can be placed in a channel 619 (see FIGS. 13 and 14) to cause the sealant 570 to contact the shingle 600 adjacent to the channel 619 (e.g., on the upper surface 601). Or, the end of the shingle may be pressed or stepped on to bring the sealant 570 into contact with the underlying shingle 600.

Figure 14:
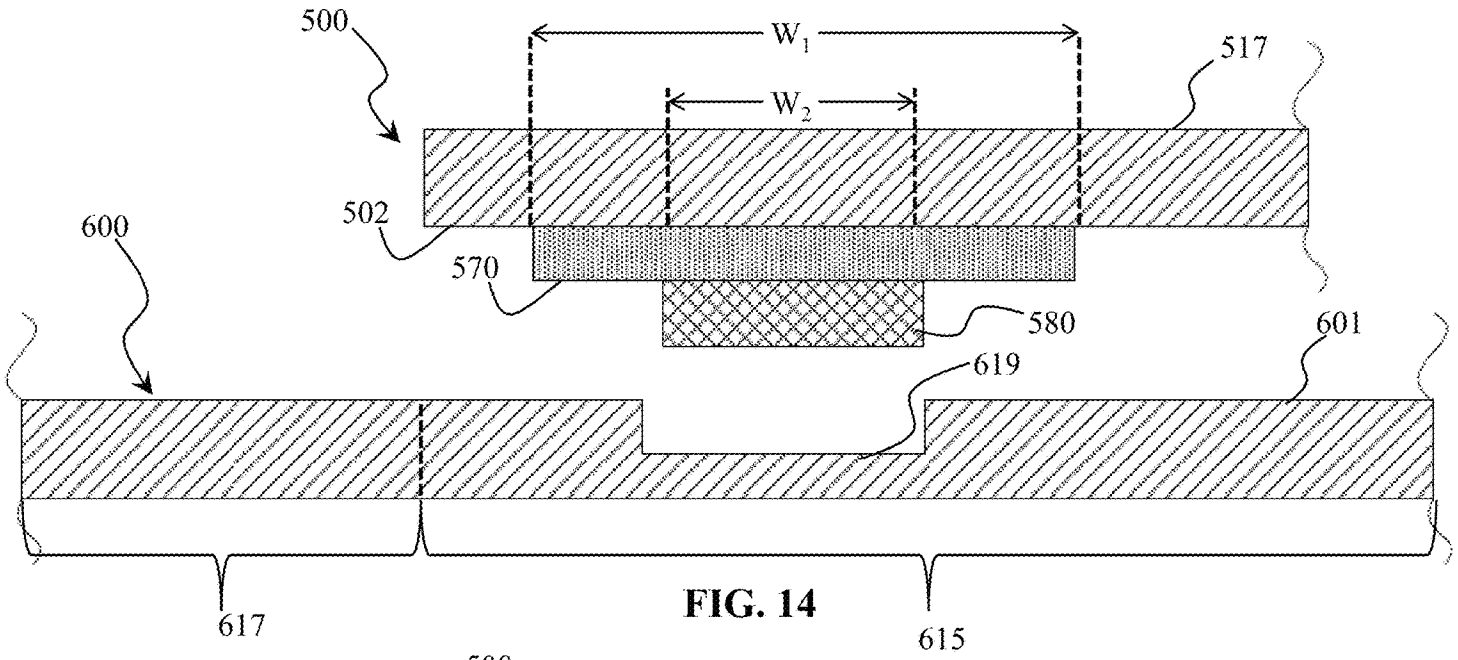
FIG. 14 is a partial cross-sectional side view of an exemplary embodiment of a pair of single layer shingles.
Figure 14A:
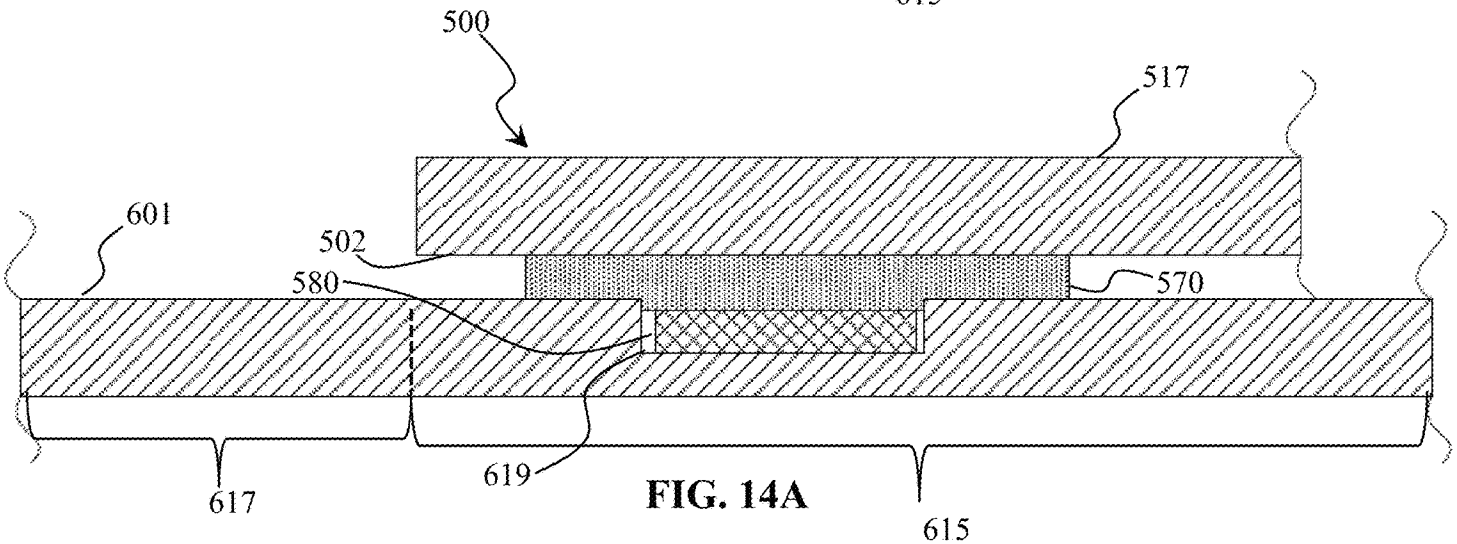
FIG. 14A is a partial cross-sectional side view of the pair of single layer shingles of FIG. 14, showing the shingles in an installed position sealed together.

Referring now to FIGS. 14 and 14A, an alternative configuration of the first sealant 570 and the second sealant 580 for addressing the problem associated with the bead of the first sealant 570 of the overlying shingle 500 sticking or adhering to the underlying shingle 600 (or roof deck) is illustrated. As seen in FIG. 14, overlying shingle 500 includes a bead of the first sealant 570 disposed (e.g., sprayed, pumped, printed, dispensed, or otherwise applied) on the lower surface 502 of the shingle tab portion 517 and a bead of the second sealant 580 disposed (e.g., sprayed, pumped, printed, dispensed, or otherwise applied) on a surface of the bead of the first sealant 570 opposite the surface contacting the lower surface 502 of the shingle tab portion 517. As shown in FIG. 14, a width $W_1$ of the bead of the first sealant 570 is greater than a width $W_2$ of the bead of the second sealant 580. For example, in certain embodiments, the width $W_1$ of the bead of the first sealant 570 is from 10% to 200% greater than the width $W_2$ of the bead of the second sealant 580, including from 25% to 175%, from 50% to 150%, and also including from 75% to 125% greater than the width $W_2$ of the bead of the second sealant 580.

In the configuration illustrated in FIG. 14, only the bead of the second sealant 580 of overlying shingle 500 contacts the upper surface 601 of underlying shingle 600 (or roof deck) when the overlying shingle 500 is placed upon the underlying shingle 600 (or roof deck). As discussed above, because the second sealant 580 is much less tacky than the first sealant 570, the overlying shingle 500 is capable of sliding and/or being repositioned during installation without sticking or adhering to the underlying shingle 600 (or roof deck).

With continued reference to FIGS. 14 and 14A, the underlying shingle 600 may include a channel or a recess 619 on the upper surface 601 of the underlying shingle 600. The channel 619 may be formed using any of the manners described above (e.g., a reinforcement material, small granules, reduced thickness/amount of asphalt coating, or combinations thereof). As seen in FIG. 14A, the bead of the second sealant 580 is configured to fit within and to contact the channel 619 during installation of the overlying shingle 500 on the underlying shingle 600. In addition, the bead of the first sealant 570 makes contact with the upper surface 601 of the underlying shingle 600 and promotes bonding between the overlying shingle 500 and the underlying shingle 500 when the bead of the second sealant 580 is positioned within the channel 619. The ability of the first sealant 570 to bond at low temperatures allows shingles configured as shown in FIGS. 14 and 14A to be installed during low temperature conditions where an initial bond between the overlying shingle 500 and the underlying shingle 600 is formed. When the temperature conditions increase to the minimum activation temperature of the second sealant 580, an additional bond between the overlying shingle 500 and the underlying shingle is formed to further secure the overlying shingle 500 to the underlying shingle 600.

Figure 15:
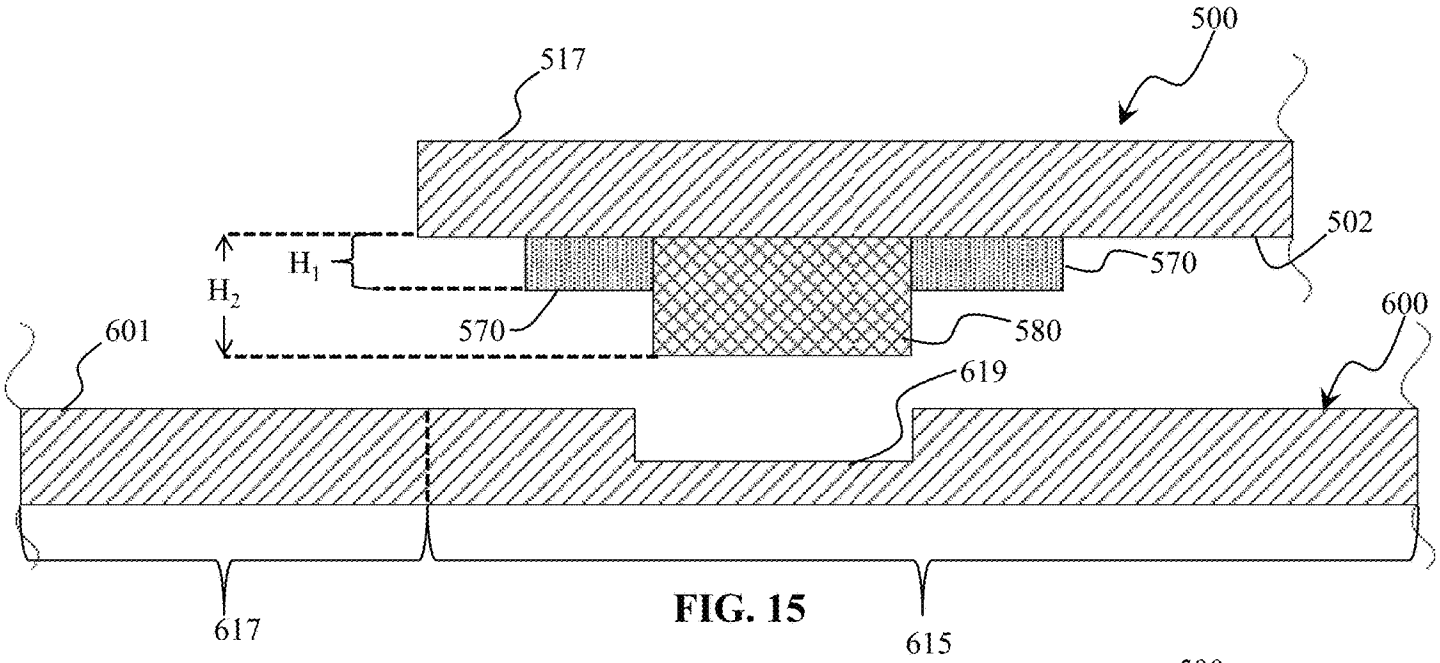
FIG. 15 is a partial cross-sectional side view of an exemplary embodiment of a pair of single layer shingles.
Figure 15A:
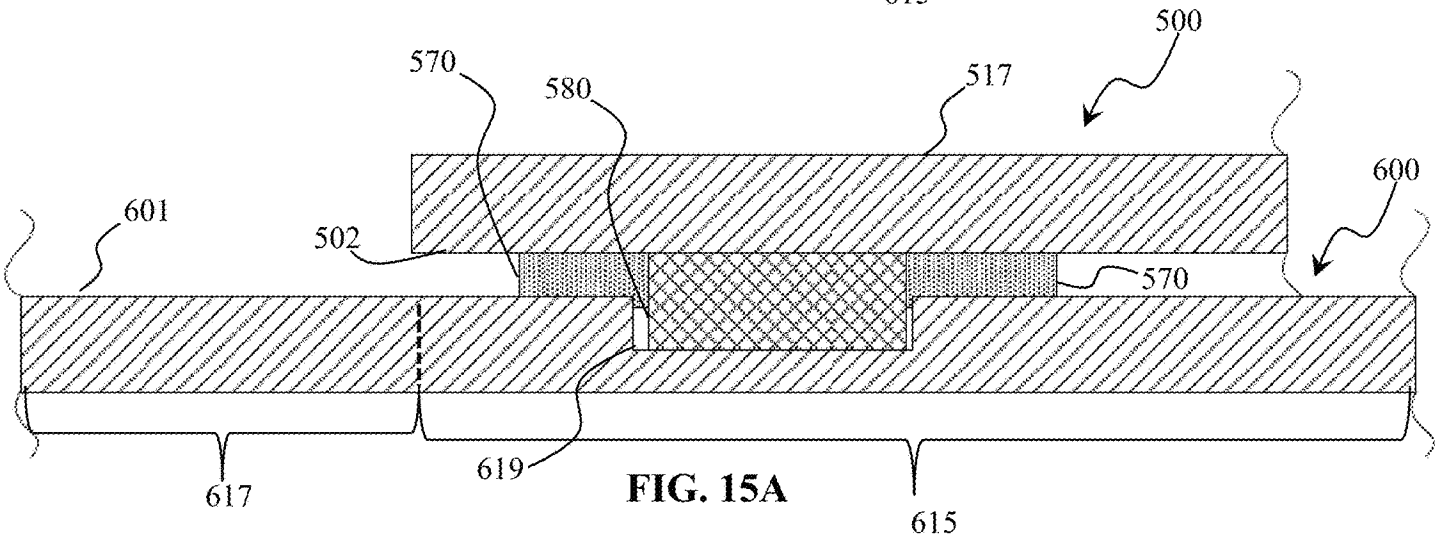
FIG. 15A is a partial cross-sectional side view of the pair of single layer shingles of FIG. 15, showing the shingles in an installed position sealed together.

FIGS. 15 and 15A illustrate an additional configuration of the first sealant 570 and the second sealant 580 for addressing the problem associated with the bead of the first sealant 570 of the overlying shingle 500 sticking or adhering to the underlying shingle 600 (or roof deck). As seen in FIG. 15, overlying shingle 500 includes two beads of the first sealant 570 disposed (e.g., sprayed, pumped, printed, dispensed, or otherwise applied) on the lower surface 502 of the shingle tab portion 517 and a bead of the second sealant 580 disposed (e.g., sprayed, pumped, printed, dispensed, or otherwise applied) between the two beads of the first sealant 570. As shown in FIG. 15, a height $H_1$ of the beads of the first sealant 570 is less than a height $H_2$ of the bead of the second sealant 580. For example, in certain embodiments, the height $H_1$ of the beads of the first sealant 570 is from 5% to 95% less than the height $H_2$ of the bead of the second sealant 580, including from 10% to 90%, from 25% to 80%, and also including from 50% to 75% less than the height $H_2$ of the bead of the second sealant 580.

In the configuration illustrated in FIG. 15, only the bead of the second sealant 580 of overlying shingle 500 contacts the upper surface 601 of underlying shingle 600 (or roof deck) when the overlying shingle 500 is placed upon the underlying shingle 600 (or roof deck). As discussed above, because the second sealant 580 is much less tacky than the first sealant 570, the overlying shingle 500 is capable of sliding and/or being repositioned during installation without sticking or adhering to the underlying shingle 600 (or roof deck).

As with the embodiment illustrated in FIGS. 14 and 14A, the underlying shingle 600 illustrated in FIGS. 15 and 15A may include a channel 619 on the upper surface 601 of the underlying shingle 600. The channel 619 may be formed using any of the manners described above (e.g., a reinforcement material, small granules, reduced thickness/amount of asphalt coating, or combinations thereof). As seen in FIG. 15A, the bead of the second sealant 580 is configured to fit within and to contact the channel 619 during installation of the overlying shingle 500 on the underlying shingle 600. In addition, the bead of the first sealant 570 makes contact with the upper surface 601 of the underlying shingle 600 and promotes bonding between the overlying shingle 500 and the underlying shingle 500 when the bead of the second sealant 580 is positioned within the channel 619. The ability of the first sealant 570 to bond at low temperatures allows shingles configured as shown in FIGS. 15 and 15A to be installed during low temperature conditions where an initial bond between the overlying shingle 500 and the underlying shingle 600 is formed. When the temperature conditions increase to the minimum activation temperature of the second sealant 580, an additional bond between the overlying shingle 500 and the underlying shingle is formed to further secure the overlying shingle 500 to the underlying shingle 600.

As compared to the sealant bead configuration illustrated in FIGS. 14 and 14A, the particular configuration of the beads of the first sealant 570 and the bead of the second sealant 580 shown in FIGS. 15 and 15A may also reduce the costs associated with manufacturing the shingles 500, 600, particularly the costs associated with the first sealant 570. For example, by disposing the bead of the second sealant 580 between the two beads of the first sealant 570, the total amount of the first sealant 570, which may be significantly more expensive than the second sealant 580, can be reduced and replaced with the second sealant 580. Along those lines, in certain embodiments, the overlying shingle 500 may include only one bead of the first sealant 570 disposed (e.g., sprayed, pumped, printed, dispensed, or otherwise applied) on the lower surface 502 of the shingle tab portion 517 and a bead of the second sealant 580 disposed (e.g., sprayed, pumped, printed, dispensed, or otherwise applied) adjacent to the bead of the first sealant 570. The bead of the first sealant 570 may be disposed on the lower surface 502 of the shingle tab portion 517 adjacent to either side of the bead of the second sealant 580.

In addition to preventing a bead of the first sealant 570 of an overlying shingle 500 from sticking or adhering to an underlying shingle 600 (or a roof deck), the configurations of the bead of the first sealant 570 and the bead of the second sealant 580 shown in FIGS. 13D, 14, and 15 can also prevent the shingle 500 from sticking or adhering to other shingles when stacked, bundled, or otherwise packaged. Furthermore, the configurations of the bead of the first sealant 570 and the bead of the second sealant 580 also provide protection against bead flattening, which can reduce the ability of the sealants 570, 580 to seal, bond, or otherwise adhere to a shingle.

Figure 16:
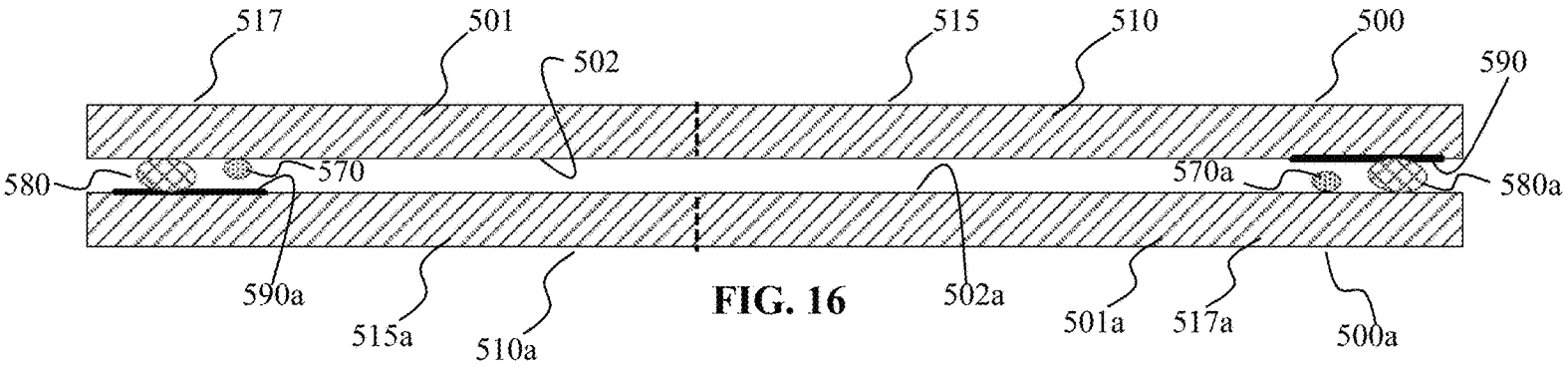
FIG. 16 is a cross-sectional side view of an exemplary embodiment of a pair of single layer shingles, showing the shingles stacked together.
Figure 17:
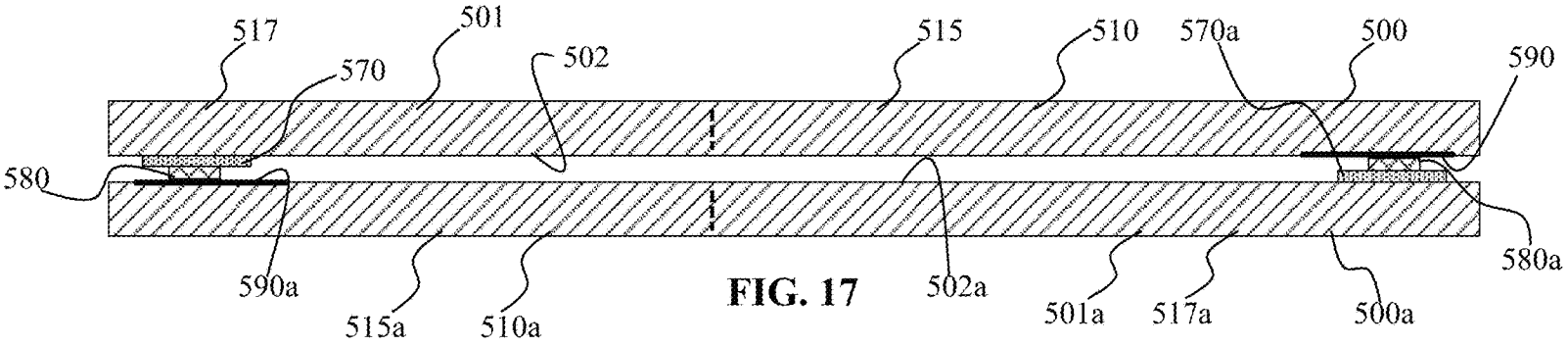
FIG. 17 is a cross-sectional side view of an exemplary embodiment of a pair of single layer shingles, showing the shingles stacked together.
Figure 18:
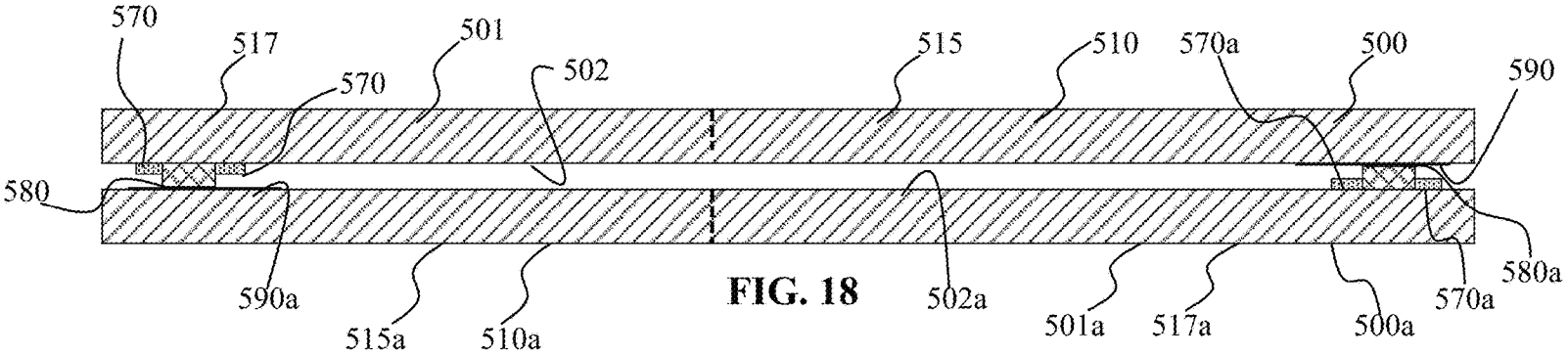
FIG. 18 is a cross-sectional side view of an exemplary embodiment of a pair of single layer shingles, showing the shingles stacked together.

FIGS. 16-18 illustrate a pair of single layer shingles 500, 500*a* stacked such that shingle 500*a* is inverted and turned 180 degrees relative to shingle 500. Additional shingles may be stacked with shingles 500, 500*a* such that every other of the shingles is inverted and turned 180 degrees relative to an adjacent shingle. As shown in FIGS. 16-18, each shingle 500, 500*a* may include a shingle sheet 510, 510*a* defining a continuous rear headlap portion 515, 515*a* and a slotted or discontinuous tab portion 517, 517*a* (having any suitable arrangement of slots or cutouts defining one or more shingle tabs). The shingle sheets 510, 510*a* may include a substrate layer, upper and lower asphalt coating layers adhered to the substrate layer, a layer of granules adhered to the upper asphalt coating to define an upper surface 501, 501*a* of the shingle 500, 500*a*, and a layer of backdust adhered to the lower asphalt coating to define a lower surface 502, 502*a* of the shingle 500, 500*a*. Each shingle 500, 500*a* may also include a release layer 590, 590*a* attached to the lower surface 502, 502*a* of the headlap portion 515, 515*a*. As seen in FIGS. 16-18, the release layer 590, 590*a* is positioned on the lower surface 502, 502*a* of the headlap portion 515, 515*a* to align with the sealants 570, 570*a*, 580, 580*a* disposed on the lower surface 502, 502*a* of the tab portion 517, 517*a* of an adjacent shingle 500, 500*a* when the shingles 500, 500*a* are stacked, bundled, or otherwise packaged. The release layer 590, 590*a* may be any conventional release tape or coating known to one of skill in the art.

Alternative shingle stacking arrangements are also contemplated. For example, the shingles 500, 500*a* may be stacked such that shingle 500*a* is turned 180 degrees relative to shingle 500 and placed on top of shingle 500. In this particular arrangement, the upper surface 501 of shingle 500 faces the lower surface 502*a* of shingle 500*a*. In other words, the shingles 500, 500*a* may be stacked with their upper surfaces 501, 501*a* facing up and their lower surfaces 502, 502*a* facing down, and vice versa. Additional shingles may be stacked with shingles 500, 500*a* such that every other of the shingles is turned 180 degrees relative to an adjacent shingle. Each shingle 500, 500*a* may also include a release layer 590, 590*a* attached to the upper surface 501, 501*a* of the headlap portion 515, 515*a*. The release layer 590, 590*a* is positioned on the upper surface 501, 501*a* of the headlap portion 515, 515*a* to align with the sealants 570, 570*a*, 580, 580*a* disposed on the lower surface 502, 502*a* of the tab portion 517, 517*a* of an adjacent shingle 500, 500*a* when the shingles 500, 500*a* are stacked, bundled, or otherwise packaged. The release layer 590, 590*a* may be any conventional release tape or coating known to one of skill in the art.

The shingles 500, 500*a* illustrated in FIG. 16 have a sealant arrangement as shown in FIG. 13D and described above. As seen in FIG. 16, the bead of the second sealant 580, 580*a* is sized such that when the shingles 500, 500*a* are stacked, bundled, or otherwise packaged, the bead of the first sealant 570, 570*a* is spaced from the corresponding release layer 590, 590*a*, which prevents the bead of the first sealant 570, 570*a* from sticking or otherwise adhering to an adjacent shingle in a stack, bundle, or package of shingles. When the shingles 500, 500*a* having the sealant arrangement of FIG. 16 are stacked, bundled, or otherwise packaged, the beads of the second sealant 580, 580*a*, which is typically stiffer than the first sealant 570, 570*a*, serve as the pressure points in the stack, bundle, or package of shingles, thereby protecting the beads of the first sealant 570, 570*a* from being flattened or deformed by the compressive forces caused by the weight of the shingle stack, bundle, or package. By protecting the beads of the first sealant 570, 570*a*, the shingles 500, 500*a* can maintain their ability to seal, bond, or otherwise adhere to another shingle after being packaged and stored.

The shingles 500, 500*a* illustrated in FIG. 17 have a sealant arrangement as shown in FIG. 14 and described above. As seen in FIG. 17, the bead of the first sealant 570, 570*a* is disposed on the lower surface 502, 502*a* of the tab portion 517, 517*a* and the bead of the second sealant 580, 580*a* is disposed on the surface of the bead of the first sealant 570, 570*a* opposite the surface contacting the lower surface 502, 502*a* of the tab portion 517, 517*a*. Accordingly, when the shingles 500, 500*a* having the sealant arrangement of FIG. 17 are stacked, bundled, or otherwise packaged, the beads of the second sealant 580, 580*a* contact the corresponding release layer 590, 590*a*, and the bead of the first sealant 570, 570*a* is spaced from the corresponding release layer 590, 590*a*, which prevents the bead of the first sealant 570, 570*a* from sticking or otherwise adhering to an adjacent shingle in a stack, bundle, or package of shingles.

The shingles 500, 500*a* illustrated in FIG. 18 have a sealant arrangement as shown in FIG. 15 and described above. As seen in FIG. 18, two beads of the first sealant 570, 570*a* are disposed on the lower surface 502, 502*a* of the tab portion 517, 517*a* and a bead of the second sealant 580, 580*a* is disposed on the lower surface 502, 502*a* of the tab portion 517, 517*a* between the two beads of the first sealant 570. As with the sealants described with respect to FIG. 15, the beads of the first sealant 570, 570*a* illustrated in FIG. 18 have a height that is less than the bead of the second sealant 580, 580*a*. Accordingly, when shingles 500, 500*a* having the sealant arrangement of FIG. 18 are stacked, bundled, or otherwise packaged, the beads of the second sealant 580, 580*a* contact the corresponding release layer 590, 590*a*, and the beads of the first sealant 570, 570*a* are spaced from the corresponding release layer 590, 590*a*, which prevents the bead of the first sealant 570, 570*a* from sticking or otherwise adhering to an adjacent shingle in a stack, bundle, or package of shingles. In addition, the beads of the second sealant 580, 580*a*, which is typically stiffer than the first sealant 570, 570*a*, serve as the pressure points in the stack, bundle, or package of shingles, thereby protecting the beads of the first sealant 570, 570*a* from being flattened or deformed by the compressive forces caused by the weight of the shingle stack, bundle, or package. By protecting the beads of the first sealant 570, 570*a*, the shingles 500, 500*a* can maintain their ability to seal, bond, or otherwise adhere to another shingle after being packaged and stored.

Turning now to FIGS. 19-25, the first sealant and the second sealant may be applied to the shingle in a variety of configurations. In particular, the first sealant and the second sealant may be applied to the shingle in a variety of geometries and patterns to improve the self-sealing properties of the shingles. Such configurations may achieve a seal and bond strength prevents wind damage and maintains the water barrier of a roof when the shingles are installed in colder temperature conditions (e.g., 20° F. to 40° F.).

Figure 19:
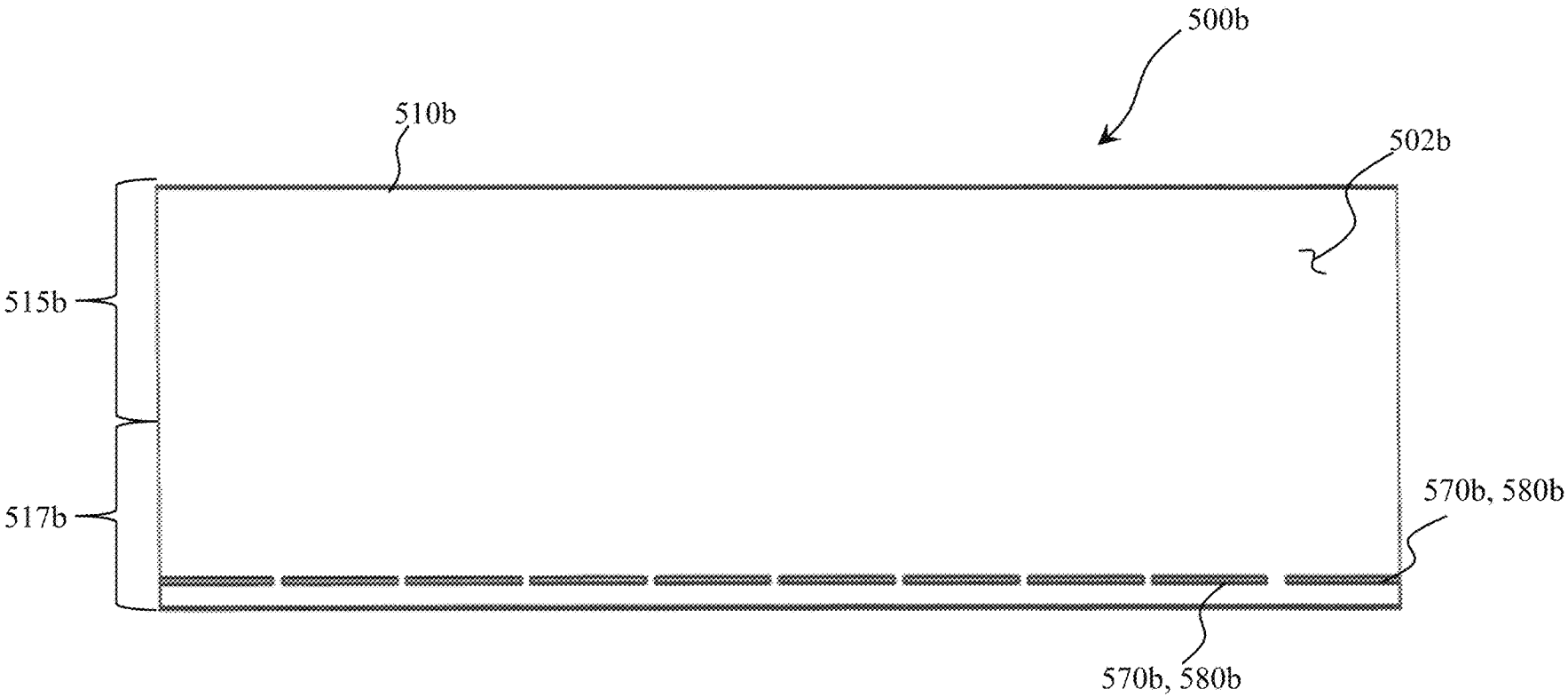
FIG. 19 is a bottom view of an exemplary embodiment of a single layer shingle.

FIG. 19 illustrates an exemplary single layer shingle 500*b* (which may, but need not, be similar to the single layer shingle 10 of FIG. 1) having a shingle sheet 510*b* defining a continuous rear headlap portion 515*b* and a tab portion 517*b*, a lower surface 502*b*, and a discontinuous line of sealant 570*b*, 580*b* (e.g., collinear dashes or segments of sealant) disposed on the lower surface 502*b* of the tab portion 517*b* of the shingle 500*b*. Each dash or segment of sealant may comprise either a first sealant 570*b* (e.g., an adhesive material that is capable of sealing, bonding, or otherwise adhering together asphalt shingles at a low temperature) or a second sealant 580*b* (e.g., a heat sensitive or thermally activated adhesive that bonds shingles together when the shingles are exposed to a minimum activation temperature of the adhesive), as previously described herein. In certain embodiments, each dash or segment of sealant comprises the first sealant 570*b*. In other embodiments, each dash or segment of sealant comprises the second sealant 580*b*. In still other embodiments, the dashes or segments of sealant alternate so that one dash or segment comprises the first sealant 570*b* and the adjacent dash or segment comprises the second sealant 580*b*. It is also contemplated that such configurations of the first sealant 570*b* and the second sealant 580*b* may be applied to an upper surface (opposite the lower surface 502*b*) of the headlap portion 515*b* of the shingle 500*b*.

Figure 20:
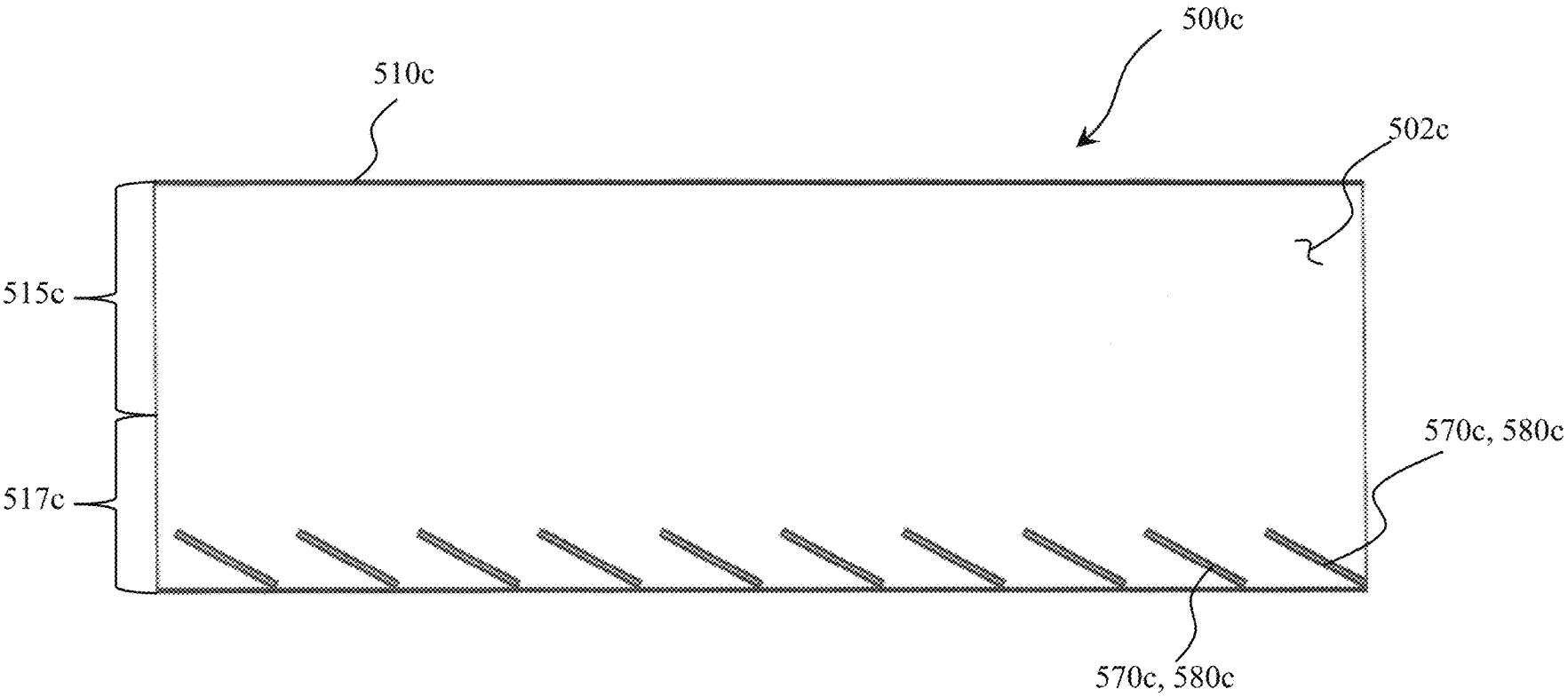
FIG. 20 is a bottom view of an exemplary embodiment of a single layer shingle.

FIG. 20 illustrates an exemplary single layer shingle 500*c* (which may, but need not, be similar to the single layer shingle 10 of FIG. 1) having a shingle sheet 510*c* defining a continuous rear headlap portion 515*c* and a tab portion 517*c*, a lower surface 502*c*, and a plurality of angled segments of sealant 570*c*, 580*c* disposed on the lower surface 502*c* of the tab portion 517*c* of the shingle 500*c*. Each angled segment of sealant may comprise either a first sealant 570*c* (e.g., an adhesive material that is capable of sealing, bonding, or otherwise adhering together asphalt shingles at a low temperature) or a second sealant 580*c* (e.g., a heat sensitive or thermally activated adhesive that bonds shingles together when the shingles are exposed to a minimum activation temperature of the adhesive), as previously described herein. In certain embodiments, each angled segment of sealant comprises the first sealant 570*c*. In other embodiments, each angled segment of sealant comprises the second sealant 580*c*. In still other embodiments, the angled segments of sealant alternate so that one angled segment comprises the first sealant 570*c* and the adjacent angled segment comprises the second sealant 580*c*. It is also contemplated that such configurations of the first sealant 570*c* and the second sealant 580*c* may be applied to an upper surface (opposite the lower surface 502*c*) of the headlap portion 515*c* of the shingle 500*c*.

Figure 21:
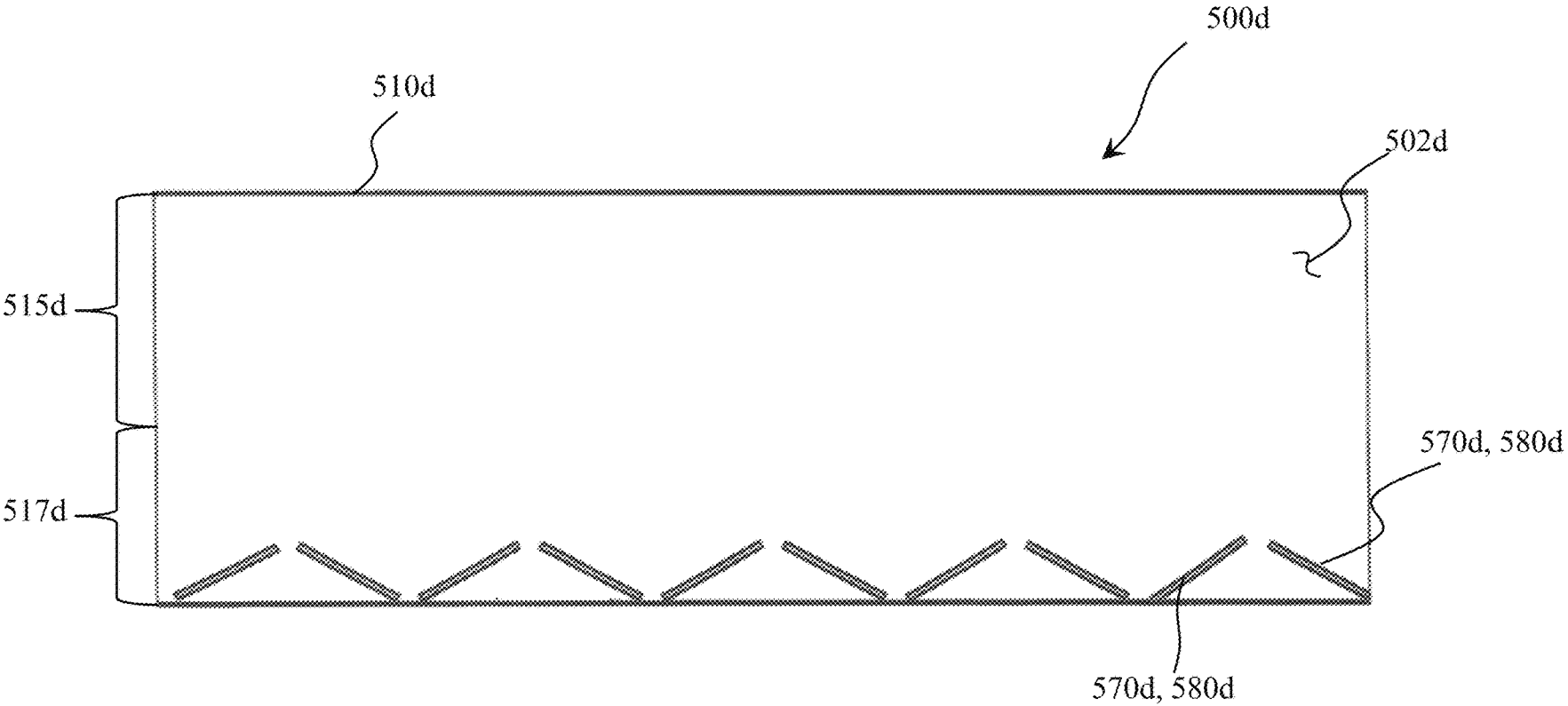
FIG. 21 is a bottom view of an exemplary embodiment of a single layer shingle.

FIG. 21 illustrates an exemplary single layer shingle 500*d* (which may, but need not, be similar to the single layer shingle 10 of FIG. 1) having a shingle sheet 510*d* defining a continuous rear headlap portion 515*d* and a tab portion 517*d*, a lower surface 502*d*, and a plurality of alternating, angled segments of sealant 570*d*, 580*d* disposed on the lower surface 502*d* of the tab portion 517*d* of the shingle 500*d*. Each segment of sealant may comprise either a first sealant 570*d* (e.g., an adhesive material that is capable of sealing, bonding, or otherwise adhering together asphalt shingles at a low temperature) or a second sealant 580*d* (e.g., a heat sensitive or thermally activated adhesive that bonds shingles together when the shingles are exposed to a minimum activation temperature of the adhesive), as previously described herein. In certain embodiments, each segment of sealant comprises the first sealant 570*d*. In other embodiments, each segment of sealant comprises the second sealant 580*d*. In still other embodiments, the segments of sealant alternate so that one segment comprises the first sealant 570*d* and the adjacent segment comprises the second sealant 580*d*. It is also contemplated that such configurations of the first sealant 570*d* and the second sealant 580*d* may be applied to an upper surface (opposite the lower surface 502*d*) of the headlap portion 515*d* of the shingle 500*d*.

Figure 22:
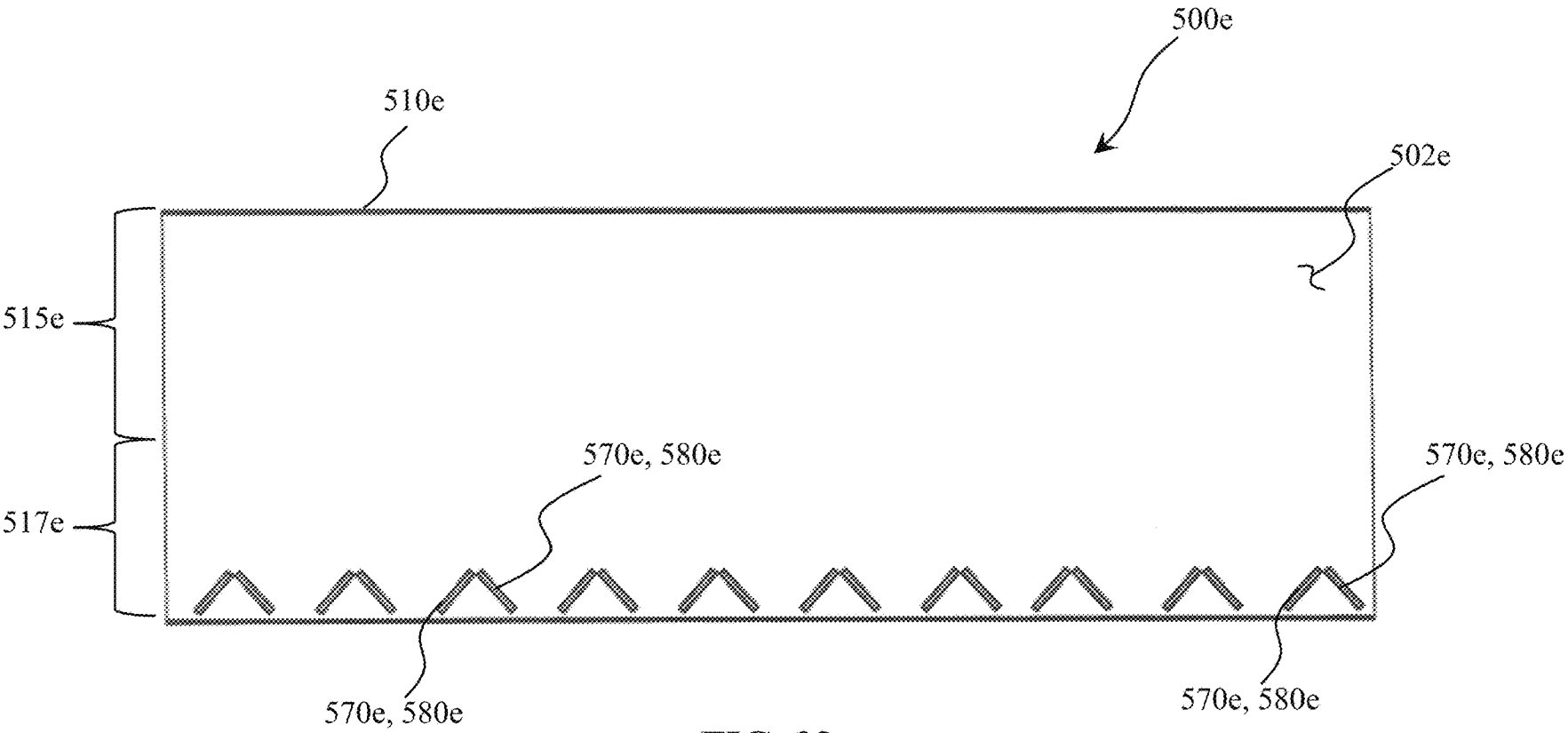
FIG. 22 is a bottom view of an exemplary embodiment of a single layer shingle.

FIG. 22 illustrates an exemplary single layer shingle 500*e* (which may, but need not, be similar to the single layer shingle 10 of FIG. 1) having a shingle sheet 510*e* defining a continuous rear headlap portion 515*e* and a tab portion 517*e*, a lower surface 502*e*, and a plurality of pairs of alternating, angled segments of sealant 570*e*, 580*e* disposed on the lower surface 502*e* of the tab portion 517*e* of the shingle 500*e*. Each segment of sealant may comprise either a first sealant 570*e* (e.g., an adhesive material that is capable of sealing, bonding, or otherwise adhering together asphalt shingles at a low temperature) or a second sealant 580*e* (e.g., a heat sensitive or thermally activated adhesive that bonds shingles together when the shingles are exposed to a minimum activation temperature of the adhesive), as previously described herein. In certain embodiments, each pair of alternating, angled segments of sealant comprise the first sealant 570*e*. In other embodiments, each pair of alternating, angled segments of sealant comprise the second sealant 580*e*. In still other embodiments, the sealant comprising a pair of alternating, angled segments alternates so that one pair of alternating, angled segments of sealant comprise the first sealant 570*e* and the adjacent pair of alternating, angled segments comprise the second sealant 580*e*. In yet other embodiments, one segment comprising a pair of alternating, angled segments comprises the first sealant 570*e*, and the other segment of the pair comprises the second sealant 580*e*. It is also contemplated that such configurations of the first sealant 570*e* and the second sealant 580*e* may be applied to an upper surface (opposite the lower surface 502*e*) of the headlap portion 515*e* of the shingle 500*e*.

Figure 23:
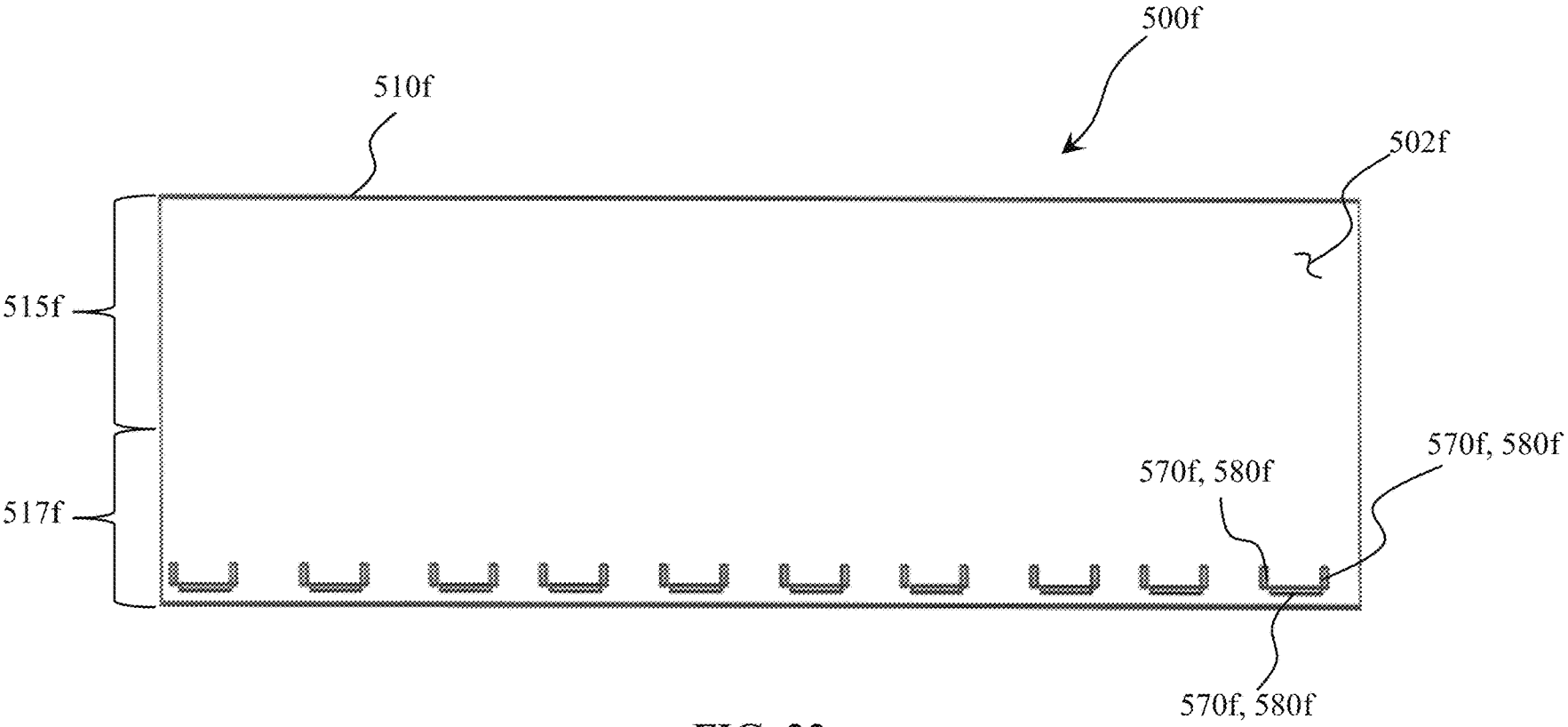
FIG. 23 is a bottom view of an exemplary embodiment of a single layer shingle.

Referring now to FIG. 23, an exemplary single layer shingle 500*f* (which may, but need not, be similar to the single layer shingle 10 of FIG. 1) having a shingle sheet 510*f* defining a continuous rear headlap portion 515*f* and a tab portion 517*f*, a lower surface 502*f*, and a plurality of substantially U-shaped configurations of sealant 570*f*, 580*f* disposed on the lower surface 502*f* of the tab portion 517*f* of the shingle 500*f* is illustrated. As seen in FIG. 23, each substantially U-shaped configuration of sealant includes a pair of parallel vertically aligned segments of sealant and a horizontally aligned segment of sealant disposed between the pair of parallel vertically aligned segments of sealant. Each segment of sealant shown in FIG. 23 may comprise either a first sealant 570*f* (e.g., an adhesive material that is capable of sealing, bonding, or otherwise adhering together asphalt shingles at a low temperature) or a second sealant 580*f* (e.g., a heat sensitive or thermally activated adhesive that bonds shingles together when the shingles are exposed to a minimum activation temperature of the adhesive), as previously described herein. In certain embodiments, each segment of the plurality of substantially U-shaped sealant comprises the first sealant 570*f* In other embodiments, each segment of the plurality of substantially U-shaped sealant comprises the second sealant 580*f* In still other embodiments, each pair of parallel vertically aligned segments of sealant comprise the first sealant 570*f*, and each horizontally aligned segment comprises the second sealant 580*f*. In yet other embodiments, each pair of parallel vertically aligned segments of sealant comprise the second sealant 580*f*, and each horizontally aligned segment comprises the first sealant 570*f*. It is also contemplated that such configurations of the first sealant 570*f* and the second sealant 580*f* may be applied to an upper surface (opposite the lower surface 502*f*) of the headlap portion 515*f* of the shingle 500*f*.

Figure 24:
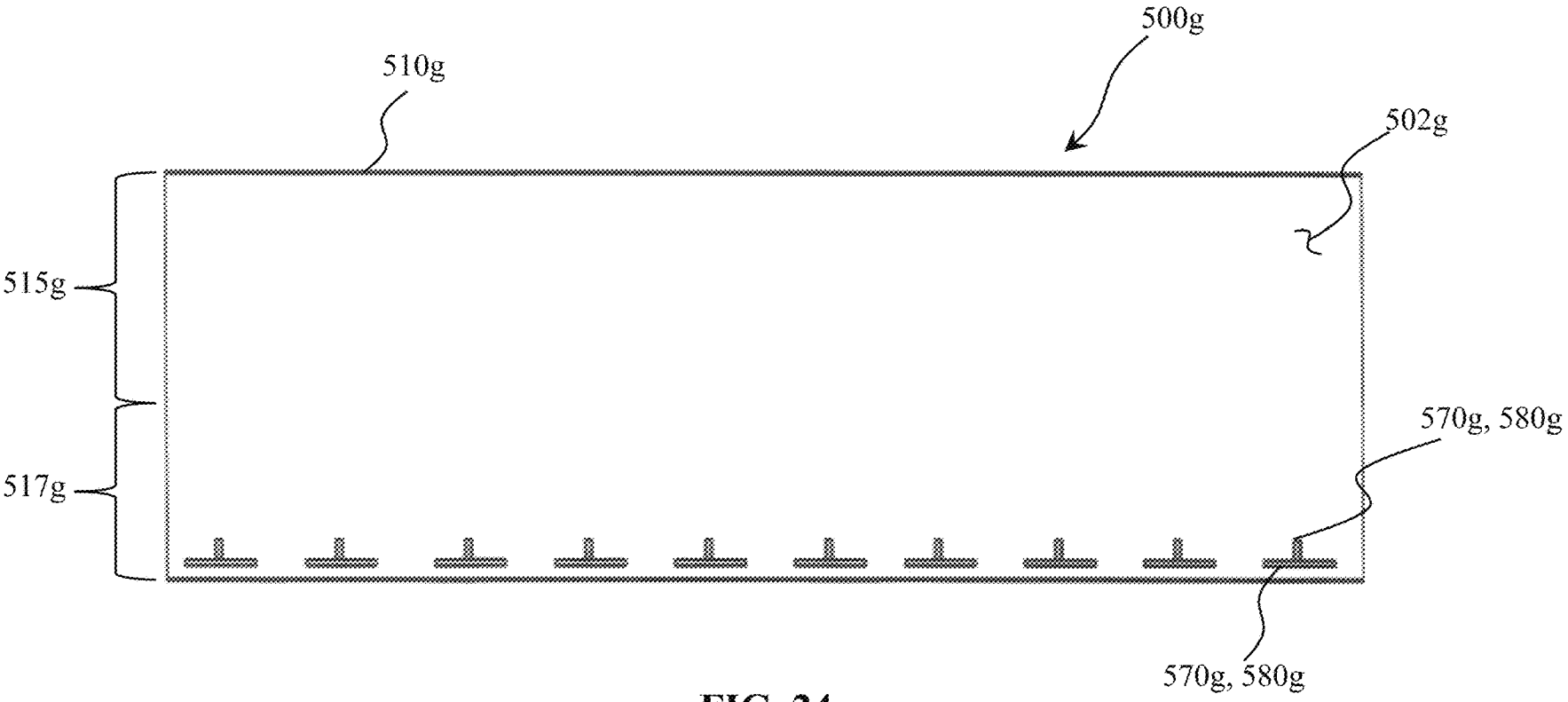
FIG. 24 is a bottom view of an exemplary embodiment of a single layer shingle.

With reference now to FIG. 24, an exemplary single layer shingle 500*g* (which may, but need not, be similar to the single layer shingle 10 of FIG. 1) having a shingle sheet 510*g* defining a continuous rear headlap portion 515*g* and a tab portion 517*g*, a lower surface 502*g*, and a plurality of substantially T-shaped configurations of sealant 570*g*, 580*g* disposed on the lower surface 502*g* of the tab portion 517*g* of the shingle 500*g* is illustrated. As seen in FIG. 24, each substantially T-shaped configuration of sealant includes a substantially vertically aligned segment of sealant positioned orthogonal to and in contact with a horizontally aligned segment of sealant. Each segment of sealant shown in FIG. 24 may comprise either a first sealant 570*g* (e.g., an adhesive material that is capable of sealing, bonding, or otherwise adhering together asphalt shingles at a low temperature) or a second sealant 580*g* (e.g., a heat sensitive or thermally activated adhesive that bonds shingles together when the shingles are exposed to a minimum activation temperature of the adhesive), as previously described herein. In certain embodiments, each segment of the plurality of substantially T-shaped sealant comprises the first sealant 570*g*. In other embodiments, each segment of the plurality of substantially T-shaped sealant comprises the second sealant 580*g*. In still other embodiments, each vertically aligned segment of sealant comprises the first sealant 570*g*, and each horizontally aligned segment of sealant comprises the second sealant 580*g*. In yet other embodiments, each vertically aligned segment of sealant comprises the second sealant 580*g*, and each horizontally aligned segment of sealant comprises the first sealant 570*g*. It is also contemplated that such configurations of the first sealant 570*g* and the second sealant 580*g* may be applied to an upper surface (opposite the lower surface 502*g*) of the headlap portion 515*g* of the shingle 500*g*.

Figure 25:
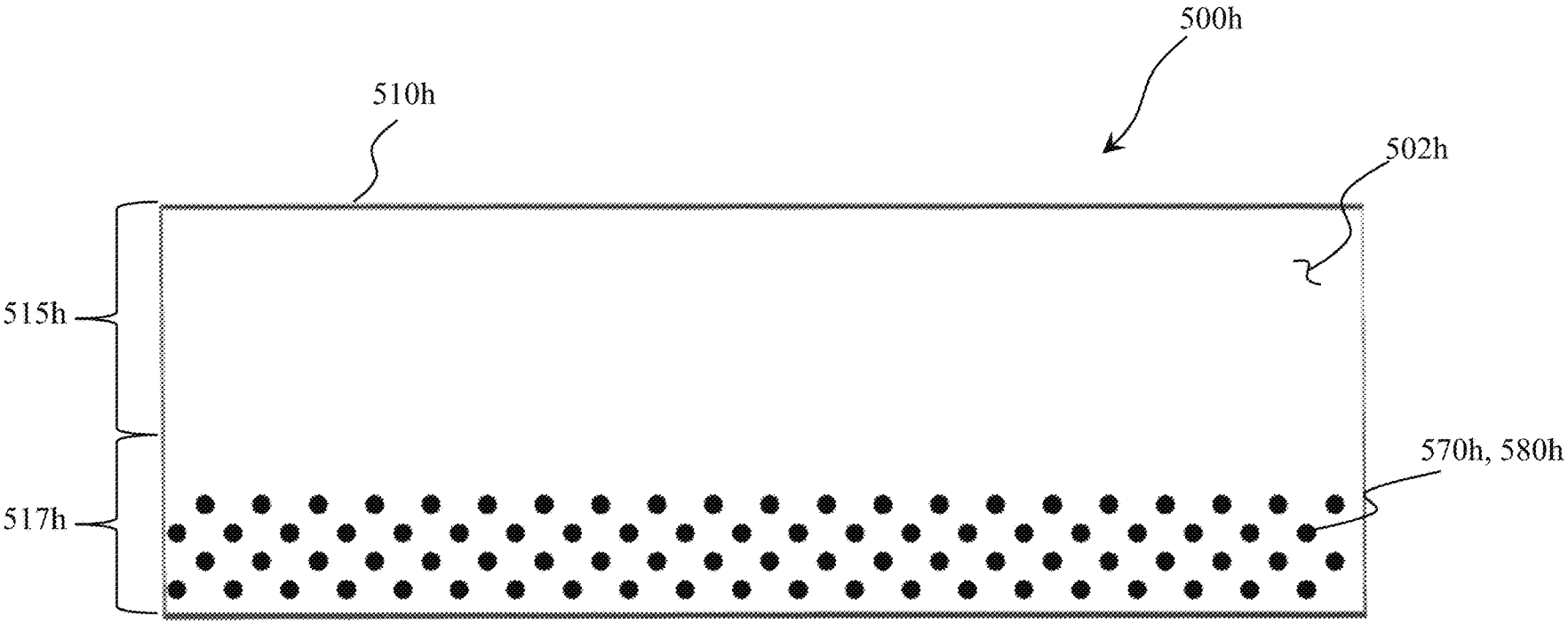
FIG. 25 is a bottom view of an exemplary embodiment of a single layer shingle.

FIG. 25 illustrates an exemplary single layer shingle 500*h* (which may, but need not, be similar to the single layer shingle 10 of FIG. 1) having a shingle sheet 510*h* defining a continuous rear headlap portion 515*h* and a tab portion 517*h*, a lower surface 502*h*, and a plurality of dots of sealant 570*h*, 580*h* disposed on the lower surface 502*h* of the tab portion 517*h* of the shingle 500*h*. Each dot of sealant may comprise either a first sealant 570*h* (e.g., an adhesive material that is capable of sealing, bonding, or otherwise adhering together asphalt shingles at a low temperature) or a second sealant 580*h* (e.g., a heat sensitive or thermally activated adhesive that bonds shingles together when the shingles are exposed to a minimum activation temperature of the adhesive), as previously described herein. In certain embodiments, each dot of sealant comprises the first sealant 570*h*. In other embodiments, each dot of sealant comprises the second sealant 580*h*. In still other embodiments, the dots of sealant alternate so that one dot of sealant comprises the first sealant 570*h* and the adjacent dot comprises the second sealant 580*h*. It is also contemplated that such configurations of the first sealant 570*h* and the second sealant 580*h* may be applied to an upper surface (opposite the lower surface 502*h*) of the headlap portion 515*h* of the shingle 500*h*.

Figure 26:
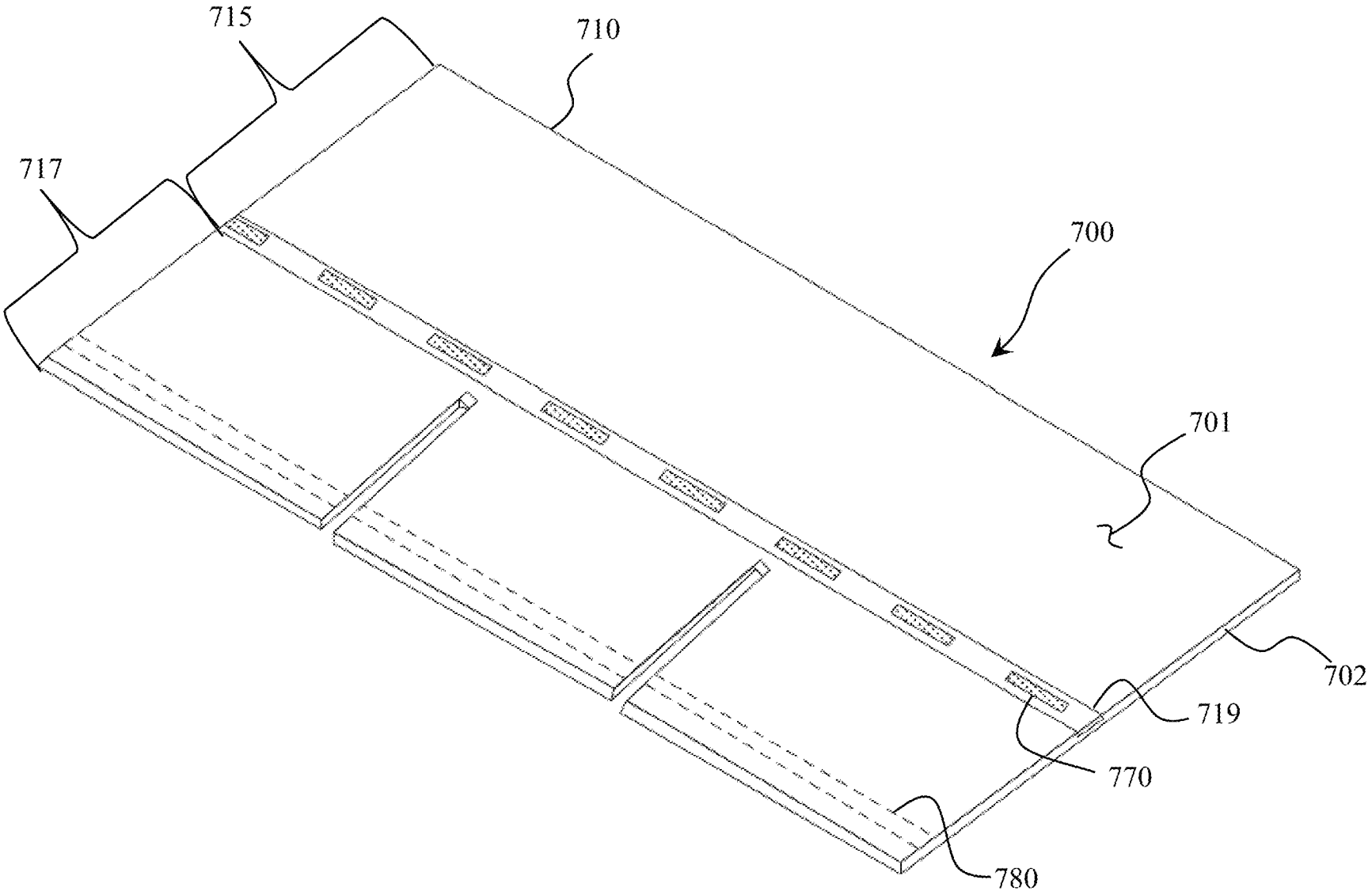
FIG. 26 is an upper perspective view of an exemplary embodiment of a single layer shingle.

Referring now to FIG. 26, an exemplary single layer shingle 700 (which may, but need not, be similar to the single layer shingle 10 of FIG. 1) having a first sealant 770 and a second sealant 780 (shown in phantom) in accordance with an exemplary embodiment of the present application is illustrated. The shingle 700 includes a shingle sheet 710 defining a continuous rear headlap portion 715 and a slotted or discontinuous front tab portion 717. The shingle sheet 710 may include a substrate layer, upper and lower asphalt coating layers adhered to the substrate layer (e.g., a non-woven web of glass fibers), a layer of granules adhered to the upper asphalt coating to define an upper surface 701 of the shingle sheet 710, and a layer of backdust adhered to the lower asphalt coating to define a lower surface 702 of the shingle sheet 710. The shingle 700 may also include a channel 719, as previously described herein, on the headlap portion 715 of the upper surface 701 of the shingle sheet 710.

The channel 719 on the upper surface of the shingle sheet makes it more difficult, particularly at low temperatures, for an overlying shingle to seal to an underlying shingle since the sealant on the tab portion of the overlying shingle must overcome the channel depth to contact and seal to the underlying shingle. To address this issue, the shingle 700 illustrated in FIG. 26 includes a bead of a first sealant 770 (e.g., an adhesive material that is capable of sealing, bonding, or otherwise adhering together asphalt shingles at a low temperature) disposed in the channel 719, which provides a raised surface to promote bonding with an overlying shingle. In certain embodiments, a height of the bead of the first sealant 770 is less than a depth of the channel 719, as can be seen in FIG. 27A. When the height of the bead of the first sealant 770 is less than a depth of the channel 719, the bead of the first sealant 770 avoids contacting and sticking to an overlying or underlying shingle when stacked, bundled, or packaged. As shown in FIG. 26, the bead of the first sealant 770 is a discontinuous or intermittent line (e.g., collinear dashes or collinear spaced line segments). However, the bead of the first sealant 770 may be a continuous line of sealant, a thin layer of sealant disposed in the channel 719, or any one or more of the sealant configurations and/or geometries previously described herein (e.g., the sealant configurations and/or geometries of FIGS. 19-25).

Figure 27:
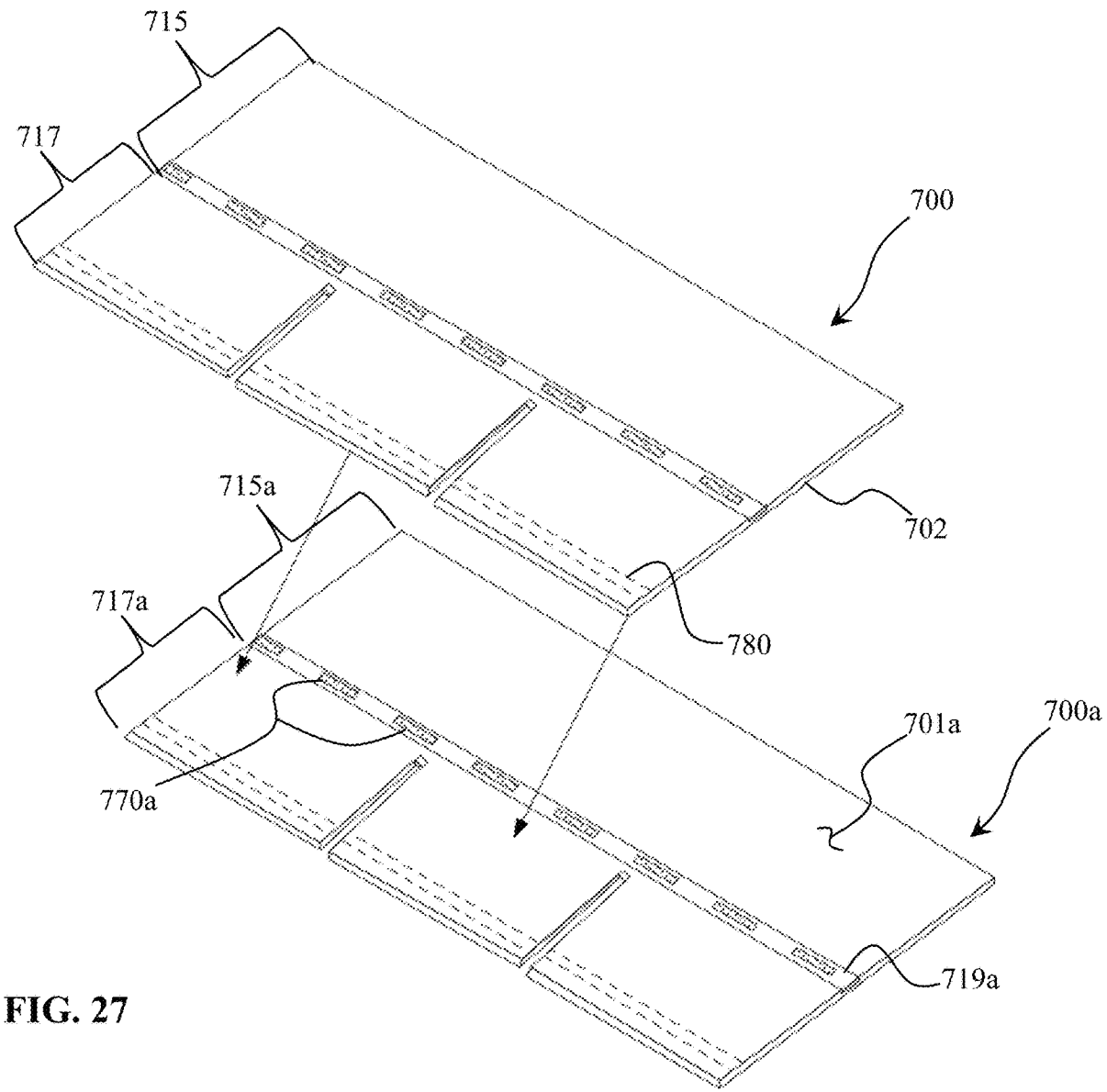
FIG. 27 is an upper perspective view of an exemplary embodiment of a pair of single layer shingles.
Figure 27A:
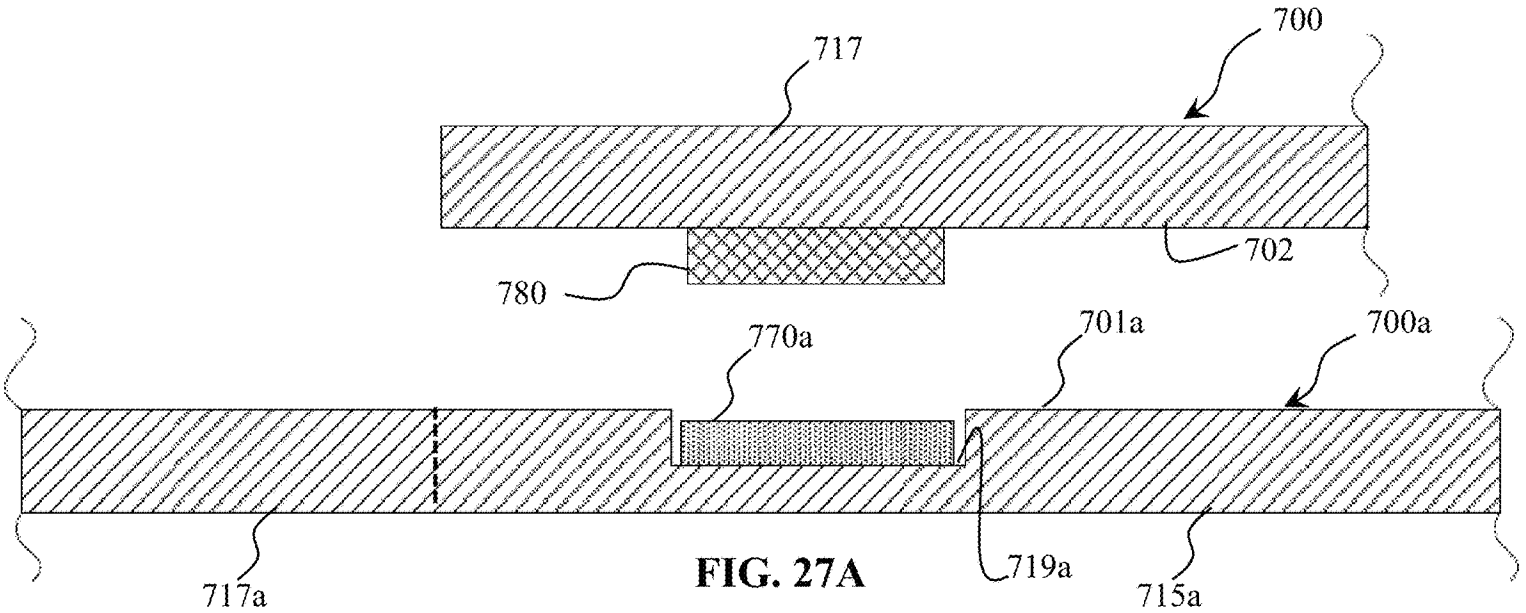
FIG. 27A is a partial cross-sectional side view of the pair of single layer shingles of FIG. 27.
Figure 27B:
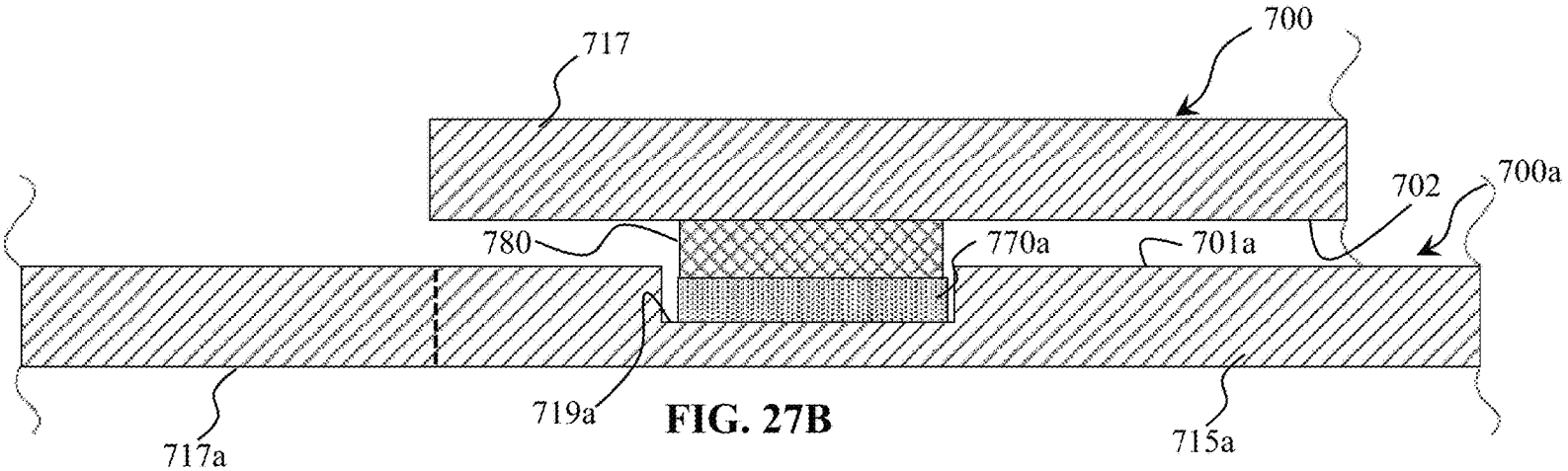
FIG. 27B is a partial cross-sectional side view of the pair of single layer shingles of FIG. 27, showing the shingles in an installed position sealed together.

FIGS. 27-27B illustrate how the bead of the first sealant disposed in the channel promotes bonding between an overlying shingle 700 and an underlying shingle 700*a*. As seen in FIGS. 27 and 27A, overlying shingle 700 includes a bead of a second sealant 780 (e.g., a heat sensitive or thermally activated adhesive that bonds shingles together when the shingles are exposed to a minimum activation temperature of the adhesive) (shown in phantom) disposed on the lower surface 702 of the shingle tab portion 717. Underlying shingle 700*a* includes a bead of the first sealant 770*a* disposed in a channel 719*a* on the upper surface 701*a* of the headlap portion 715*a*. In FIG. 27, the bead of the second sealant 780 of the overlying shingle 700 is illustrated as a continuous bead or line. In other embodiments, the bead of the second sealant 780 may be a discontinuous or intermittent line (e.g., collinear dashes or collinear spaced line segments), or any one or more of the sealant configurations and/or geometries previously described herein (e.g., the sealant configurations and/or geometries of FIGS. 19-25).

As seen in FIG. 27A, the overlying shingle 700 and the underlying shingle 700*a* are configured so that the bead of the second sealant 780 of the overlying shingle 700 aligns with the bead of the first sealant 770*a* disposed in the channel 719*a* of the underlying shingle 700*a*. The bead of the first sealant 770*a* provides a raised surface in the channel 719*a*, which promotes contact and bonding between the bead of the first sealant 770*a* of the underlying shingle 700*a* and the bead of the second sealant 780 of the overlying shingle 700, as shown in FIG. 27B. Once the activation temperature of the second sealant 780 is reached, the second sealant 780 can flow into contact with the underlying shingle 700*a*, for example, into contact with the surface of the channel 719*a* to further bond the overlying shingle 700 to the underlying shingle 700*a*.

The sealant arrangements shown in FIGS. 26-27B are particularly useful when installing shingles in low temperature conditions. For example, in low temperature conditions, the bead of the first sealant can provide a temporary seal or bond between an overlying and underlying shingle. The temporary seal or bond between the overlying and underlying shingle may last long enough until the ambient temperature increases to at least the minimum activation temperature of the bead of the second sealant to form a more permanent bond between the overlying and underlying shingle.

Figure 28:
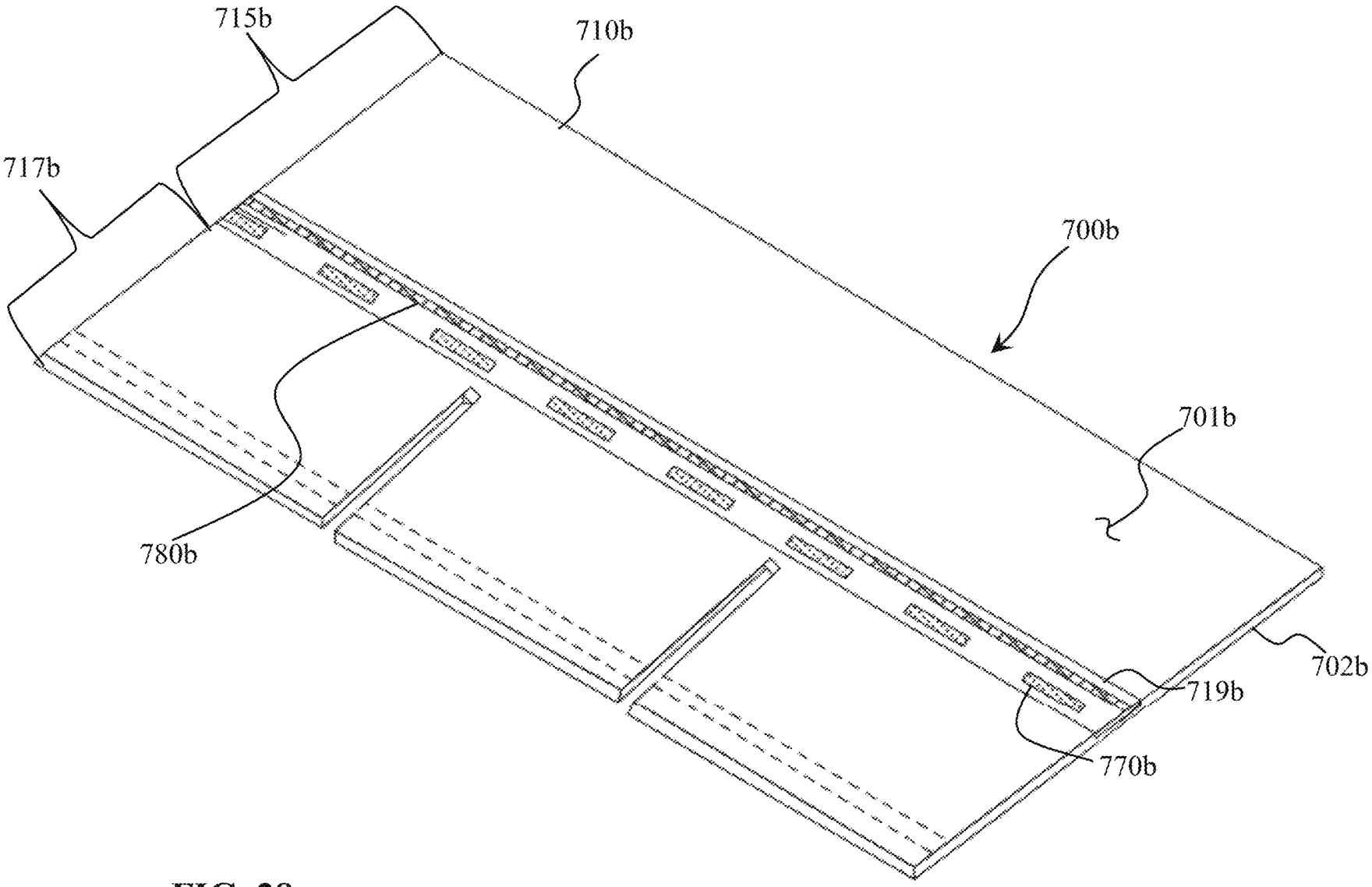
FIG. 28 is an upper perspective view of an exemplary embodiment of a single layer shingle.
Figure 28A:
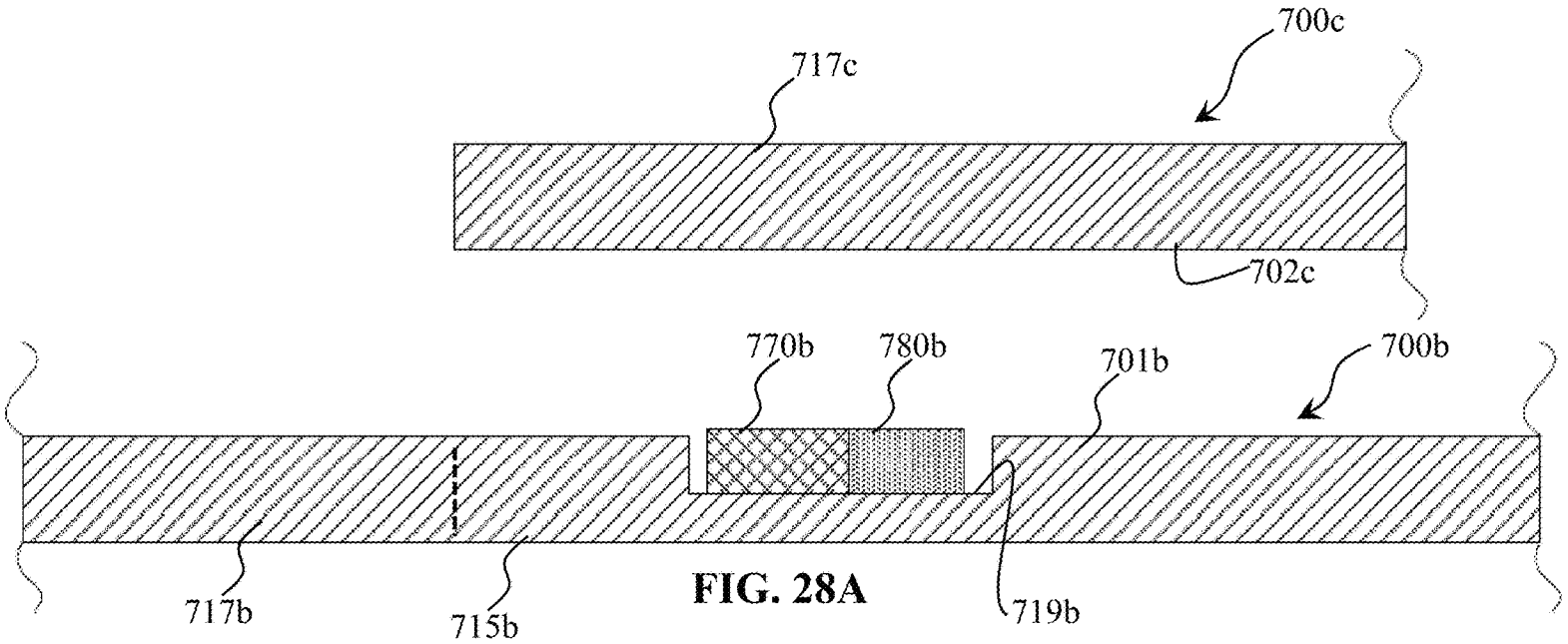
FIG. 28A is a partial cross-sectional view of a pair of the single layer shingles of FIG. 28.
Figure 28B:
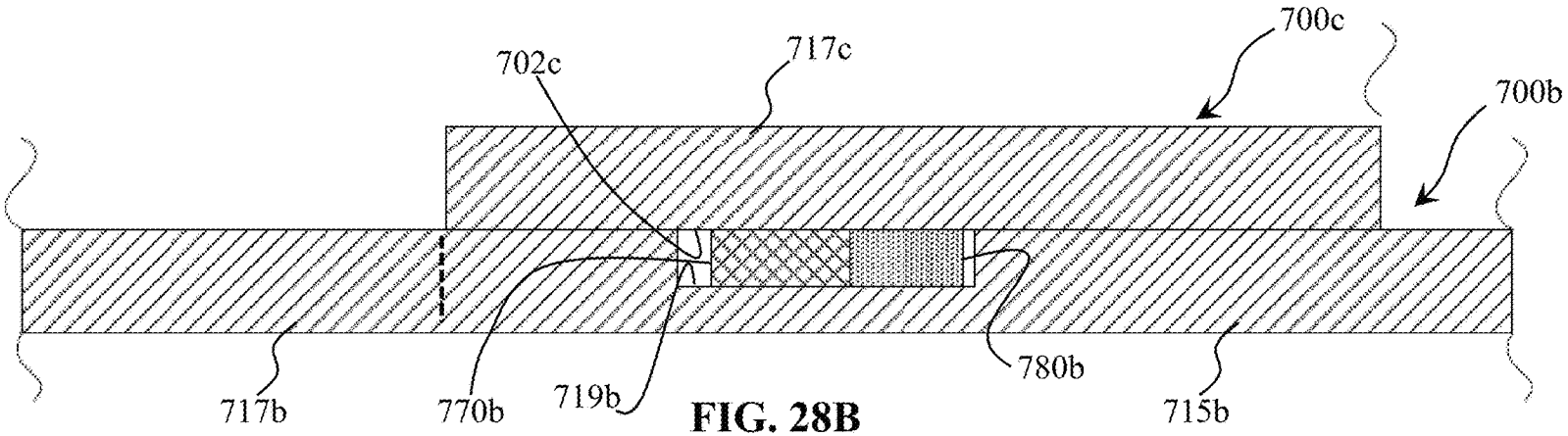
FIG. 28B is a partial cross-sectional view of a pair of the single layer shingles of FIG. 28, showing the shingles in an installed position sealed together.

In certain embodiments, a shingle 700*b* may include a bead of a first sealant 770*b* and a bead of a second sealant 780*b* disposed in a channel 719*b* on a headlap portion 715*b* of an upper surface 701*b* of a shingle sheet 710*b*, as shown in FIGS. 28-28B. The shingle 700*b* includes a shingle sheet 710*b* defining a continuous rear headlap portion 715*b* and a slotted or discontinuous front tab portion 717*b*. The shingle sheet 710*b* may include a substrate layer, upper and lower asphalt coating layers adhered to the substrate layer (e.g., a non-woven web of glass fibers), a layer of granules adhered to the upper asphalt coating to define an upper surface 701*b* of the shingle sheet 710*b*, and a layer of backdust adhered to the lower asphalt coating to define a lower surface 702*b* of the shingle sheet 710*b*. The shingle 700*b* may also include a channel 719*b*, as previously described herein, on the headlap portion 715*b* of the upper surface 701*b* of the shingle sheet 710*b*.

As shown in FIG. 28, the bead of the first sealant 770*b* is a discontinuous or intermittent line (e.g., collinear dashes or collinear spaced line segments). However, the bead of the first sealant 770*b* may be a continuous line of sealant, a thin layer of sealant disposed in the channel 719*b*, or any one or more of the sealant configurations and/or geometries previously described herein (e.g., the sealant configurations and/or geometries of FIGS. 19-25). The bead of the second sealant 780*b* is illustrated as a continuous bead or line. However, the bead of the second sealant 780*b* may be a discontinuous or intermittent line (e.g., collinear dashes or collinear spaced line segments), or any one or more of the sealant configurations and/or geometries previously described herein (e.g., the sealant configurations and/or geometries of FIGS. 19-25).

As seen in FIG. 28A, a height of the bead of the first sealant 770*b* and a height of the bead of the second sealant 780*b* may be greater than a depth of the channel 719*b*. This configuration of sealants 770*b*, 780*b* promotes contact and bonding between the sealants 770*b*, 780*b* of an underlying shingle 770*b* and a lower surface 702*c* of a tab portion 717*c* of an overlying shingle 700*c*, as illustrated in FIG. 28B.

The sealant arrangements shown in FIGS. 28-28B are particularly useful when installing shingles in low temperature conditions. For example, in low temperature conditions, the bead of the first sealant can provide a temporary seal or bond between an overlying and underlying shingle. The temporary seal or bond between the overlying and underlying shingle may last long enough until the ambient temperature increases to at least the minimum activation temperature of the bead of the second sealant to form a more permanent bond between the overlying and underlying shingle.

In other embodiments, the bead of the first sealant 770*b* may be disposed directly on the upper surface 701*b* (i.e., on the layer of granules) of the headlap portion 715*b* of the shingle sheet 710*b* and spaced from the channel 719*b*, and the bead of the second sealant 780*b* may be disposed in the channel 719*b*. In yet other embodiments, the bead of the first sealant 770*b* may be disposed directly on the upper surface 701*b* (i.e., on the layer of granules) of the tab portion 717*b* of the shingle sheet 710*b* and spaced from the channel 719*b*, and the bead of the second sealant 780*b* may be disposed in the channel 719*b*. In these embodiments, the bead of the first sealant can create a temporary seal or bond between an overlying and underlying shingle, particularly in low temperature conditions. The temporary seal or bond between the overlying and underlying shingle may last long enough until the ambient temperature increases to at least the minimum activation temperature of the bead of the second sealant to form a more permanent bond between the overlying and underlying shingle.

Figure 29:
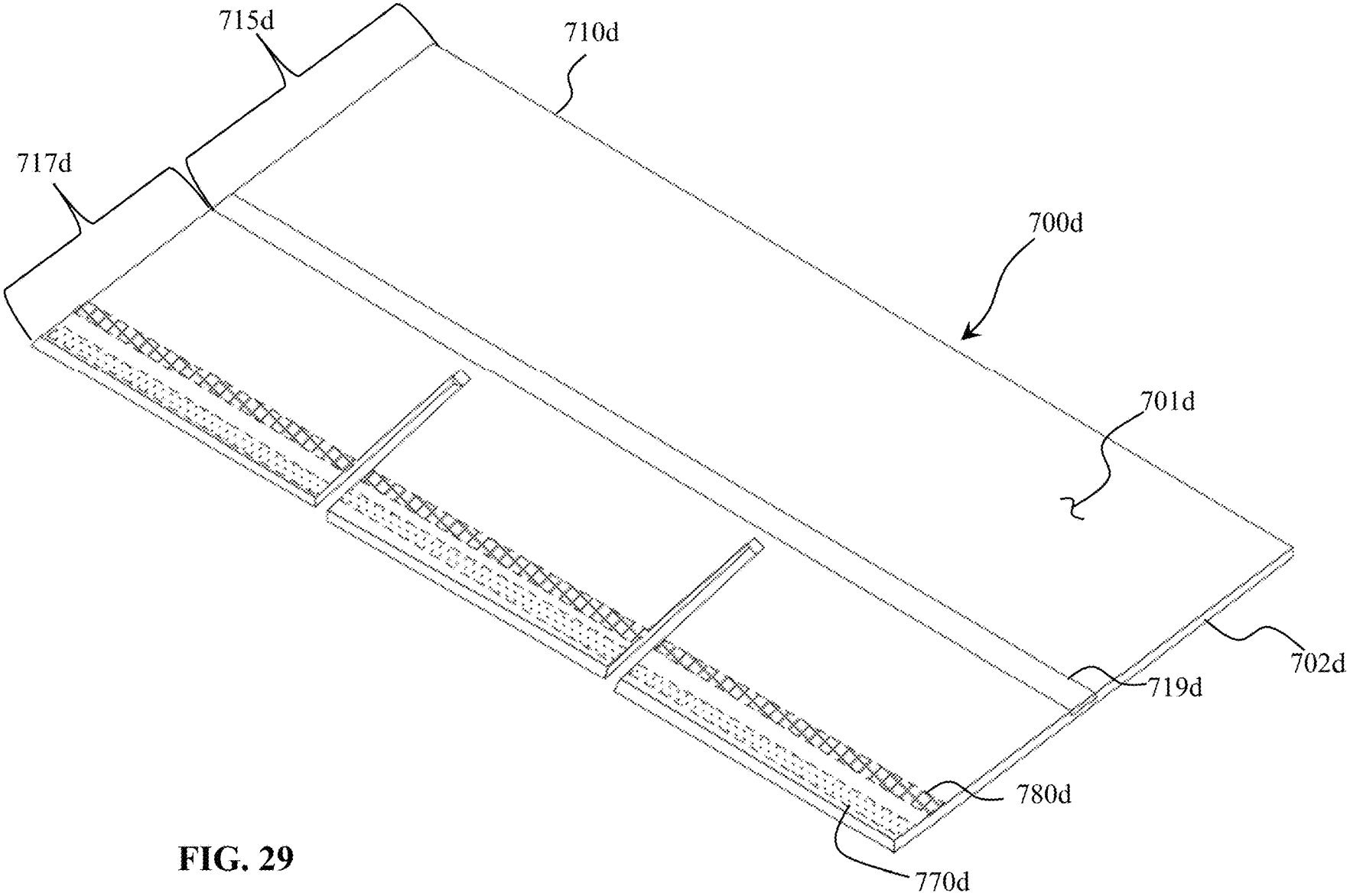
FIG. 29 is an upper perspective view of an exemplary embodiment of a single layer shingle.
Figure 29A:
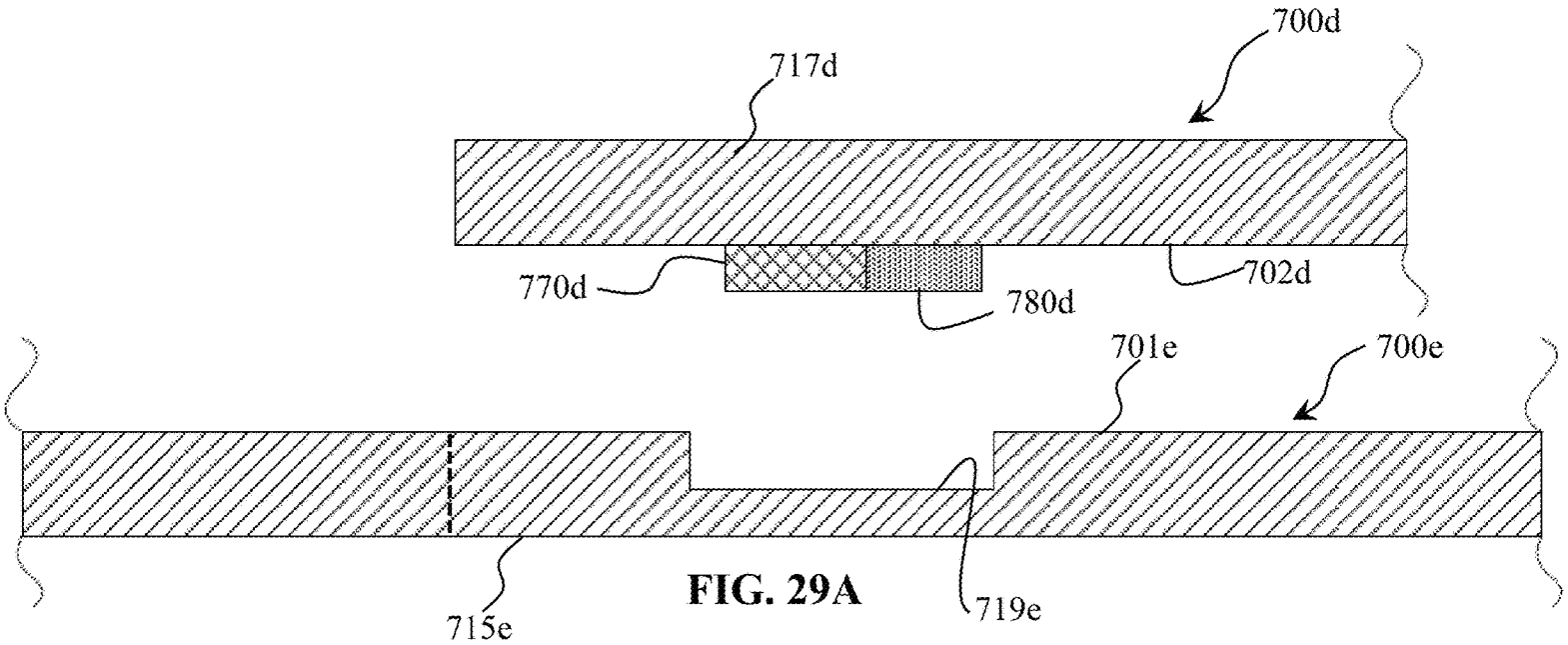
FIG. 29A is a partial cross-sectional view of a pair of the single layer shingles of FIG. 29.
Figure 29B:
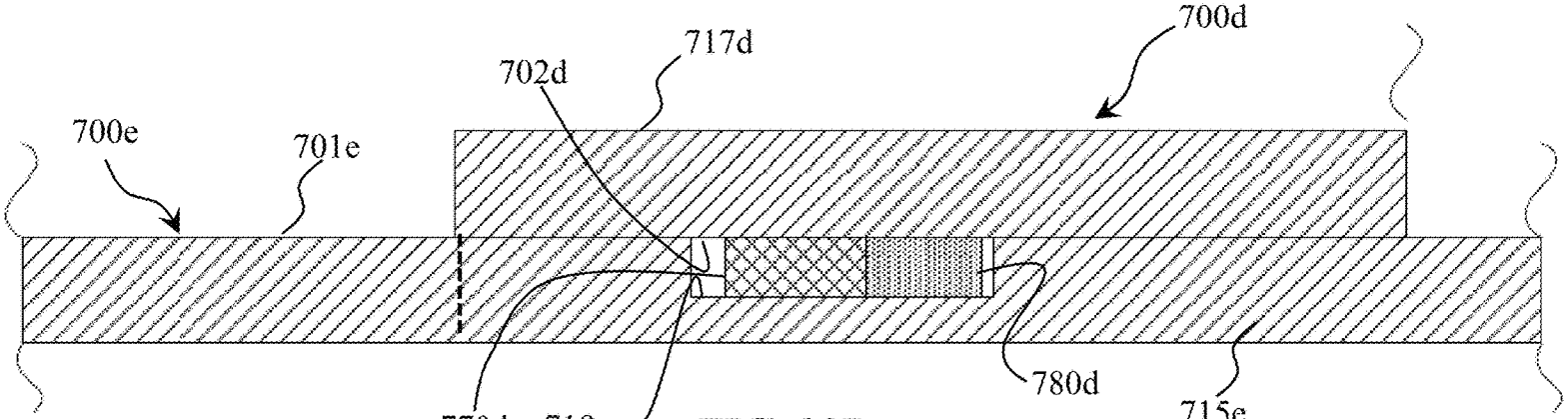
FIG. 29B is a partial cross-sectional view of a pair of the single layer shingles of FIG. 29, showing the shingles in an installed position sealed together.

In certain embodiments, a shingle 700*d* may include a bead of a first sealant 770*d* and a bead of a second sealant 780*d* disposed on a lower surface 702*d* of a tab portion 717*d* of a shingle sheet 710*d*, as shown in FIGS. 29-29B. The shingle 700*d* includes a shingle sheet 710*d* defining a continuous rear headlap portion 715*d* and a slotted or discontinuous front tab portion 717*d*. The shingle sheet 710*d* may include a substrate layer, upper and lower asphalt coating layers adhered to the substrate layer (e.g., a non-woven web of glass fibers), a layer of granules adhered to the upper asphalt coating to define an upper surface 701*d* of the shingle sheet 710*d*, and a layer of backdust adhered to the lower asphalt coating to define a lower surface 702*d* of the shingle sheet 710*d*. The shingle 700*d* may also include a channel 719*d*, as previously described herein, on the headlap portion 715*d* of the upper surface 701*d* of the shingle sheet 710*d*.

As shown in FIG. 29, the bead of the first sealant 770*d* and the bead of the second sealant 780*d* are formed as continuous lines across the lower surface 702*d* of the tab portion 717*d*. The beads of the first sealant 770*d* and the second sealant 780*d* may be spaced apart or may abut one another. Although shown as continuous lines, the beads of the first sealant 770*d* and the second sealant 780*d* may be disposed on the lower surface 702*d* of the tab portion 717*d* as discontinuous or intermittent lines (e.g., collinear dashes or collinear spaced line segments), or any one or more of the sealant configurations and/or geometries previously described herein (e.g., the sealant configurations and/or geometries of FIGS. 19-25).

As seen in FIGS. 29A and 29B, the bead of the first sealant 770*d* and the bead of the second sealant 780*d* may be disposed on the lower surface 702*d* of the tab portion 717*d* such that both the bead of the first sealant 770*d* and the bead of the second sealant 780*d* align with a channel 719*e* of an underlying shingle 700*e*. In certain embodiments, a height of the bead of the first sealant 770*d* and a height of the bead of the second sealant 780*d* may be greater than a depth of the channel 719*e* of the underlying shingle 700*e*. This configuration of sealants 770*d*, 780*d* promotes contact and bonding between the sealants 770*d*, 780*d* of the overlying shingle 770*d* and the channel 719*e* of the overlying shingle 700*c*, as illustrated in FIG. 29B.

As previously discussed, certain adhesives or sealants, including adhesives with lower activation temperatures may suffer from "bead flattening" due to softening of the adhesive prior to installation. This issue is especially problematic when the adhesive is applied to a channel or recessed portion as described in FIGS. 29A and 29B. In certain embodiments, at least one of a bead of a first sealant and a bead of a second sealant comprises an inert material. The inert material may be sea sand or another inert, substantially spherical, proppant-type material. The purpose of the inert material is to reduce or minimize the compressibility of the bead. Desirable properties of the inert material include reinforcement strength, provide little impact on viscosity of the adhesive, non-absorbancy, and it should not reduce the tack of the adhesive at activation temperature.

In other embodiments, the bead of the first sealant 770*d* may be disposed on the lower surface 702*d* of the tab portion 717*d* such that the bead of the first sealant 770*d* contacts and bonds to an upper surface 701*e* of an underlying shingle 700*e* (e.g., an upper surface 700*e* of the headlap portion 715*e*) spaced from the channel 719*e*, and the bead of the second sealant 780*d* may be disposed on the lower surface 702*d* of the tab portion 717*d* to align with the channel 719*e* of the underlying shingle 700*e*. In these embodiments, the bead of the first sealant can create a temporary seal or bond between an overlying and underlying shingle, particularly in low temperature conditions. The temporary seal or bond between the overlying and underlying shingle may last long enough until the ambient temperature increases to at least the minimum activation temperature of the bead of the second sealant to form a more permanent bond between the overlying and underlying shingle. In certain embodiments, the first sealant 770*d* may be considered a "sacrificial adhesive" as the bond may be temporary in nature (i.e., the first sealant 770*d* (with low temperature sealing ability) need only adhere the shingles until the second, higher activation temperature sealant creates the more permanent bond).

Figure 30:
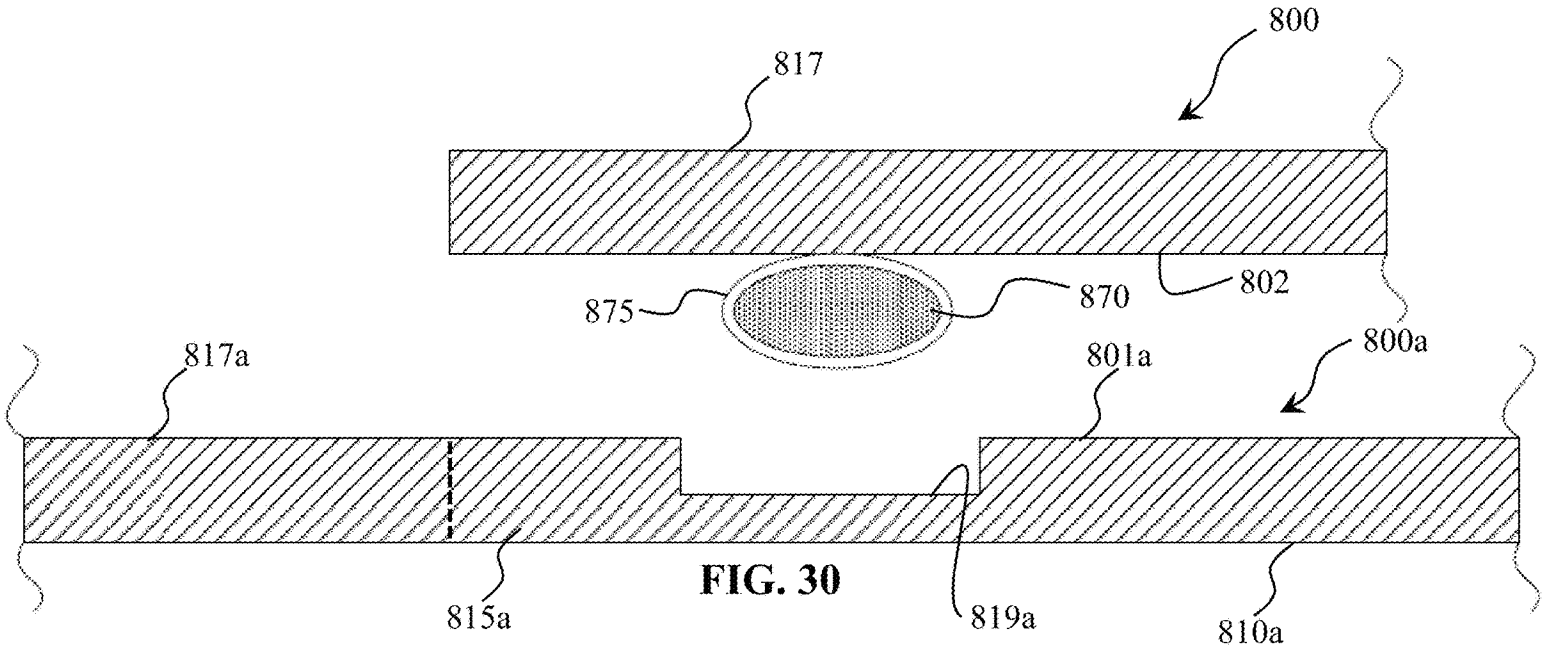
FIG. 30 is a partial cross-sectional view of an exemplary embodiment of a pair of single layer shingles.
Figure 30A:
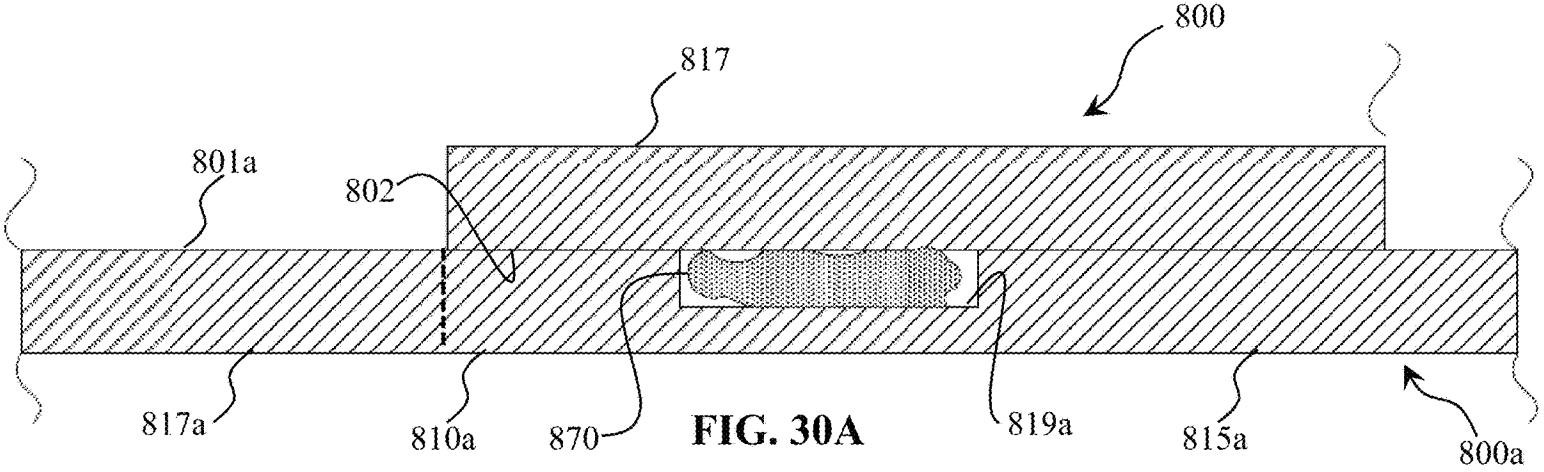
FIG. 30A is a partial cross-sectional view of the pair of single layer shingles of FIG. 30, showing the shingles in an installed position sealed together.

Referring now to FIGS. 30 and 30A, an exemplary embodiment of an overlying shingle 800 and an underlying shingle 800*a* is shown. Preferably, overlying shingle 800 and underlying shingle 800*a* are configured identically. As see in FIG. 30, overlying shingle 800 includes a sealant 870 encapsulated within a shell 875 disposed on a lower surface 802 of a tab portion 817 of the shingle 800. Preferably, the sealant 870 comprises at least one of the sealants described herein that is capable of sealing, bonding, or otherwise adhering together asphalt shingles at a low temperature. The shell 875 may be a film of polymer material or the like to encapsulate the sealant 870. Exemplary materials to form the shell 875 include, but are not limited to, polyethylene, polypropylene, ethyl cellulose, polyvinyl alcohol, gelatin, and sodium alginate. The sealant 870 encapsulated with the shell 875 may be disposed on the shingle 800 in any one or more of the sealant arrangements described herein. The shell 875 encapsulating the sealant 870 can take a wide variety of different forms. For example, the shells 875 encapsulating sealant 870 may be discrete and egg-like, sphere or spheroid, or elongated and continuous or rope-like, or combinations thereof. Encapsulating the sealant 870 with shell 875 prevents the sealant from sticking or otherwise adhering to adjacent shingles in a stack, bundle, and/or package of shingles. In addition, encapsulating the sealant 870 with shell 875 allows the shingles to slide or be repositioned without sticking or otherwise adhering to an underlying shingle or the roof deck during installation.

With continued reference to FIGS. 30 and 30A, the underlying shingle 800*a* includes a shingle sheet 810*a* defining a continuous rear headlap portion 815*a* and a slotted or discontinuous front tab portion 817*a*. The shingle sheet 810*a* may include a substrate layer, upper and lower asphalt coating layers adhered to the substrate layer (e.g., a non-woven web of glass fibers), a layer of granules adhered to the upper asphalt coating to define an upper surface 801*a* of the shingle sheet 810*a*, and a layer of backdust adhered to the lower asphalt coating to define a lower surface 802*a* of the shingle sheet 810*a*. The underlying shingle 800*a* may also include a channel 819*a*, as previously described herein, on the headlap portion 815*a* of the upper surface 801*a* of the shingle sheet 810*a*. As seen in FIG. 30, the sealant 870 encapsulated within shell 875 is disposed on the lower surface 802 of the tab portion 817 of the overlying shingle 800 so as to align with the channel 819*a* of the underlying shingle 800*a*. However, in other embodiments, the shingle may be configured such that the sealant encapsulated within the shell is disposed in the channel instead of, or in addition to, the tab portion. Furthermore, the sealant encapsulated within the shell may be applied to the shingle according to any of the sealant arrangements described herein, such as continuous lines, discontinuous or intermittent lines (e.g., collinear dashes or collinear spaced line segments), or any one or more of the sealant configurations and/or geometries shown in FIGS. 19-25.

When the underlying shingle 800*a* and the overlying shingle 800 are positioned and/or installed, the shell 875 encapsulating the sealant 870 may be broken or otherwise ruptured to release the sealant 870 to bond or otherwise form a seal between the underlying shingle 800*a* and the overlying shingle 800, as shown in FIG. 30A. The shell 875 may be broken by installation crews walking on the shingles, or by using other means to apply a sufficient amount of pressure to break or rupture the shell 875.

Figure 31:
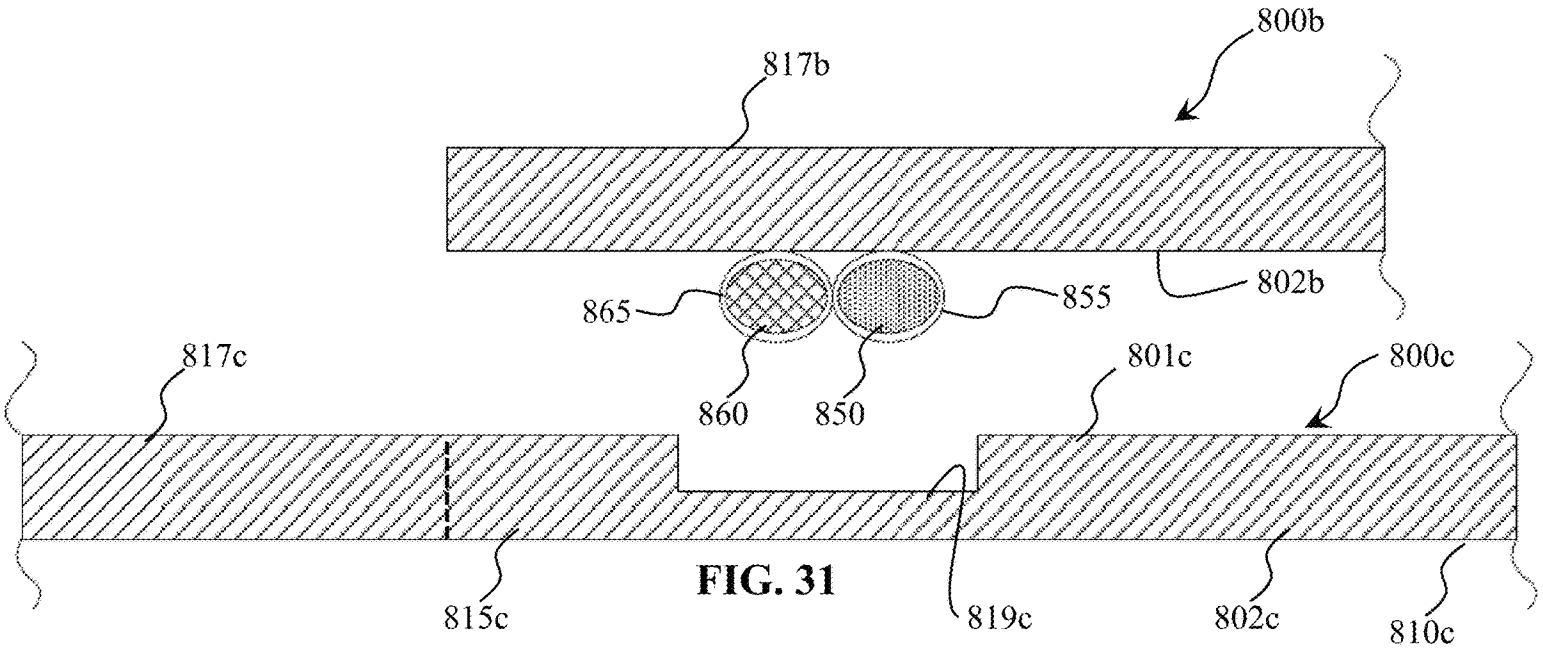
FIG. 31 is a partial cross-sectional view of an exemplary embodiment of a pair of single layer shingles.
Figure 31A:
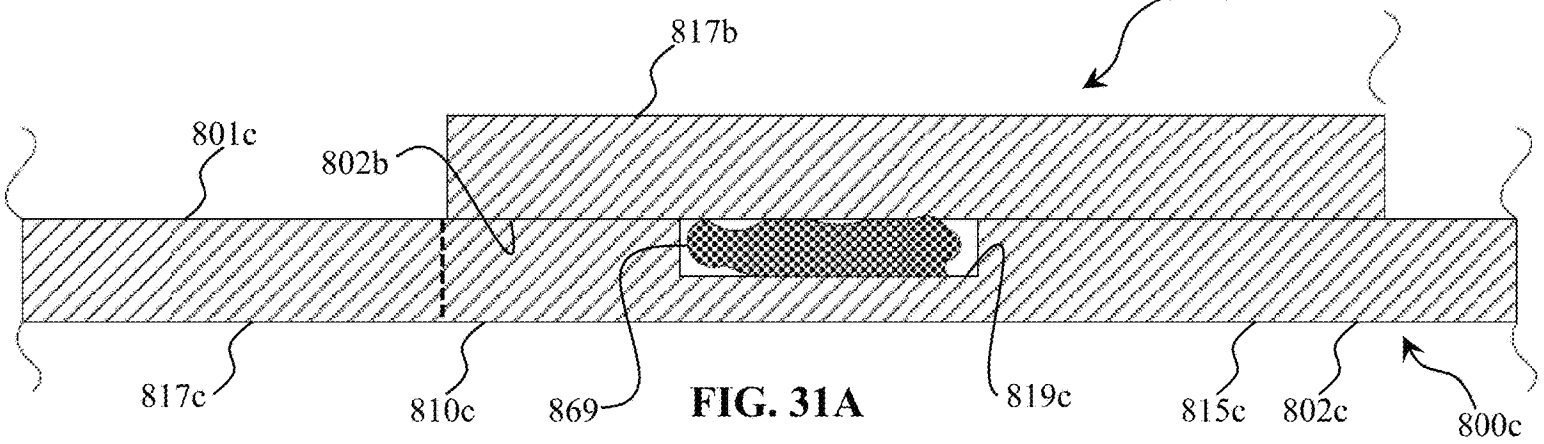
FIG. 31A is a partial cross-sectional view of the pair of single layer shingles of FIG. 31, showing the shingles in an installed position sealed together.

Referring now to FIGS. 31 and 31A, an exemplary embodiment of an overlying shingle 800*b* and an underlying shingle 800*c* is shown. Preferably, overlying shingle 800*b* and underlying shingle 800*c* are configured identically. As see in FIG. 31, overlying shingle 800*b* includes an encapsulated two-part reactive sealant disposed on a lower surface 802*b* of a tab portion 817*b* of the shingle 800*b*. The encapsulated two-part reactive sealant includes a first reactive sealant component 850 encapsulated within a first shell 855, and a second reactive sealant component 860 encapsulated within a second shell 865. Exemplary reactive sealants that may be used include, but are not limited to, two-part epoxy adhesives, two-part polysulfide adhesives, two-part polyurethane adhesives, and two-part silicone adhesives. The first shell 855 and the second shell 865 may be a film of polymer material or the like to encapsulate the first reactive sealant component 850 and the second reactive sealant component 860. Exemplary materials to form the first shell 855 and/or the second shell 865 include, but are not limited to, polyethylene, polypropylene, ethyl cellulose, polyvinyl alcohol, gelatin, and sodium alginate. The first shell 855 and the second shell 865 may be formed of the same material, or may be formed of different materials. The first and second shells 855, 865 encapsulating sealants 850, 860 can take a wide variety of different forms. For example, the first and second shells 855, 865 encapsulating the first and second sealants 850, 860 may be discrete and egg-like, sphere or spheroid, or elongated and continuous or rope-like.

The encapsulated two-part reactive sealant prevents the sealant from sticking or otherwise adhering to adjacent shingles in a stack, bundle, and/or package of shingles. Furthermore, should one of the encapsulated sealant components happen to break or rupture, the shingles would not stick or otherwise adhere together because the sealant does not activate or form an adhesive bond until the first reactive sealant component comes into contact with the second reactive sealant component. Similarly, the encapsulated two-part reactive sealant allows the shingles to slide or be repositioned without sticking or otherwise adhering to an underlying shingle or the roof deck during installation.

With continued reference to FIGS. 31 and 31A, the underlying shingle 800*c* includes a shingle sheet 810*c* defining a continuous rear headlap portion 815*c* and a slotted or discontinuous front tab portion 817*c*. The shingle sheet 810*c* may include a substrate layer, upper and lower asphalt coating layers adhered to the substrate layer (e.g., a non-woven web of glass fibers), a layer of granules adhered to the upper asphalt coating to define an upper surface 801*c* of the shingle sheet 810*c*, and a layer of backdust adhered to the lower asphalt coating to define a lower surface 802*c* of the shingle sheet 810*c*. The underlying shingle 800*c* may also include a channel 819*c*, as previously described herein, on the headlap portion 815*c* of the upper surface 801*c* of the shingle sheet 810*c*. As seen in FIG. 31, the two-part encapsulated sealant is disposed on the lower surface 802*b* of the tab portion 817*b* of the overlying shingle 800*b* so as to align with the channel 819*c* of the underlying shingle 800*c*. However, in other embodiments, the shingle may be configured such that the two-part encapsulated sealant is disposed in the channel instead of, or in addition to, the tab portion. Furthermore, the two-part encapsulated sealant may be applied to the shingle according to any of the sealant arrangements described herein, such as continuous lines, discontinuous or intermittent lines (e.g., collinear dashes or collinear spaced line segments), or any one or more of the sealant configurations and/or geometries shown in FIGS. 19-25.

When the underlying shingle 800*c* and the overlying shingle 800*b* are positioned and/or installed, the first shell 855 encapsulating the first reactive sealant component 850 and the second shell 865 encapsulating the second reactive sealant component 860 may be broken or otherwise ruptured to release the first reactive sealant component 850 and the second reactive sealant component. When the first reactive sealant component 850 and the second reactive sealant component 860 are brought into contact, the components 850, 860 react to form an adhesive 869 that bonds or otherwise forms a seal between the underlying shingle 800*c* and the overlying shingle 800*b*, as shown in FIG. 31A. The first shell 855 and the second shell 865 may be broken by installation crews walking on the shingles during or after installation, or by using other means to apply a sufficient amount of pressure to break or rupture the shells 855, 865.

Figure 32:
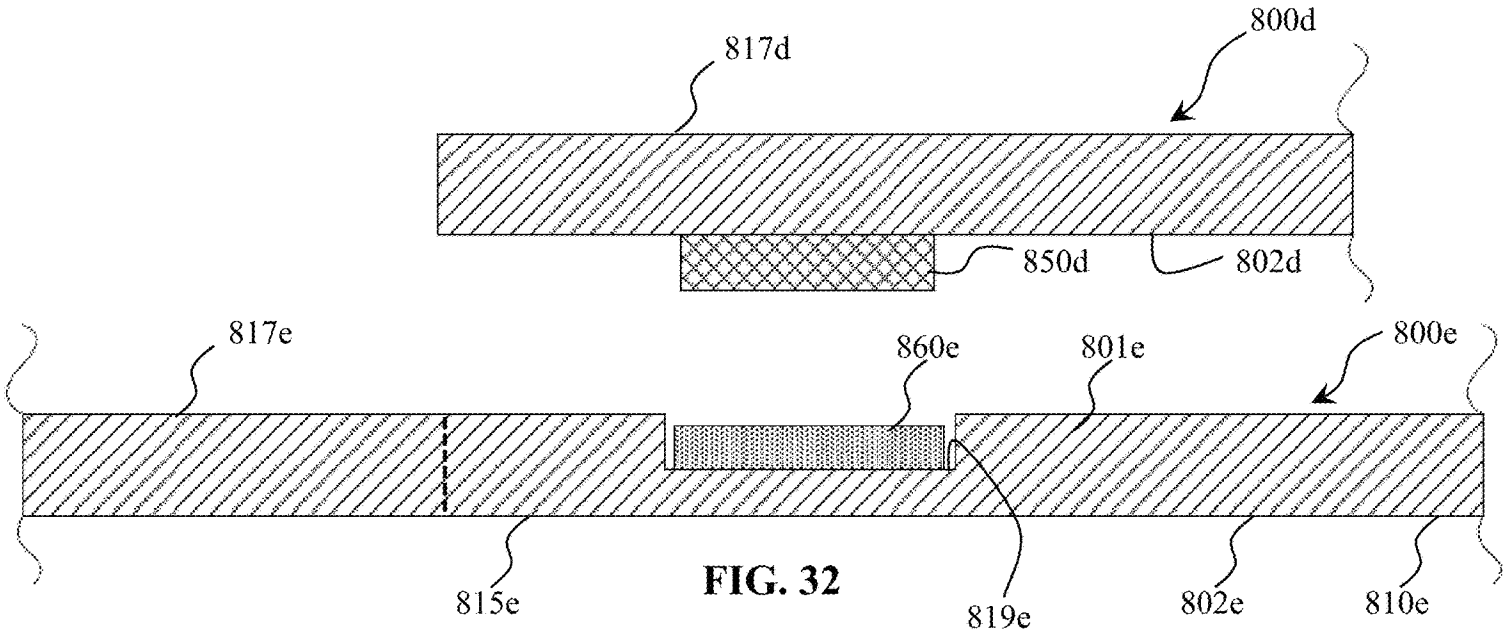
FIG. 32 is a partial cross-sectional view of an exemplary embodiment of a pair of single layer shingles.
Figure 32A:
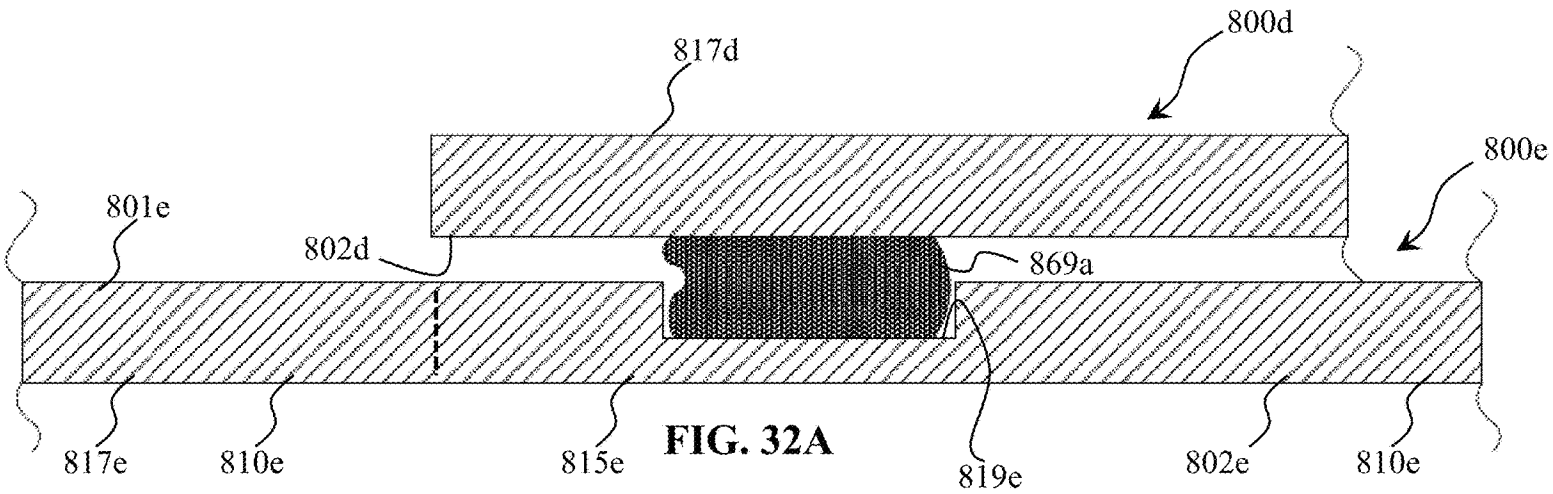
FIG. 32A is a partial cross-sectional view of the pair of single layer shingles of FIG. 32, showing the shingles in an installed position sealed together.

Referring now to FIGS. 32 and 32A, an exemplary embodiment of an overlying shingle 800*d* and an underlying shingle 800*e* is shown. Preferably, overlying shingle 800*d* and underlying shingle 800*e* are configured identically. As see in FIG. 32, overlying shingle 800*d* includes a first reactive sealant component 850*d* disposed on a lower surface 802*d* of a tab portion 817*d* of the shingle 800*d*, and underlying shingle 800*e* includes a second reactive sealant component 860*e* disposed in a channel 819*e* on a headlap portion 815*e* of an upper surface 801*e* of the shingle sheet 810*e*. Exemplary reactive sealants that may be used include, but are not limited to, two-part epoxy adhesives, two-part polysulfide adhesives, two-part polyurethane adhesives, and two-part silicone adhesives. For example, first reactive sealant component 850*d* may comprise a first part of a two-part epoxy adhesive, and second reactive sealant component 860*e* may comprise a second part of the two-part epoxy adhesive. Providing a shingle with a first reactive sealant component and a second reactive sealant component as arranged in FIG. 32 ensures that when the shingles are stacked, bundled, and/or packaged, the first and second reactive sealant will not stick or otherwise adhere to adjacent shingles in a stack, bundle, and/or package of shingles because the first and second reactive sealants do not activate or form an adhesive bond until the first reactive sealant component comes into contact with the second reactive sealant component. Similarly, the arrangement of the first reactive sealant and the second reactive sealant can allow the shingles to slide or be repositioned without sticking or otherwise adhering to an underlying shingle or the roof deck while the shingles are positioned for installation.

With continued reference to FIGS. 32 and 32A, the underlying shingle 800*e* includes a shingle sheet 810*e* defining a continuous rear headlap portion 815*e* and a slotted or discontinuous front tab portion 817*e*. The shingle sheet 810*e* may include a substrate layer, upper and lower asphalt coating layers adhered to the substrate layer (e.g., a non-woven web of glass fibers), a layer of granules adhered to the upper asphalt coating to define an upper surface 801*e* of the shingle sheet 810*e*, and a layer of backdust adhered to the lower asphalt coating to define a lower surface 802*e* of the shingle sheet 810*e*. The underlying shingle 800*e* may also include a channel 819*e*, as previously described herein, on the headlap portion 815*e* of the upper surface 801*e* of the shingle sheet 810*e*. As seen in FIG. 32, the first reactive sealant component 850*d* is disposed on the lower surface 802*d* of the tab portion 817*d* of the overlying shingle 800*d* so as to align with the second reactive sealant component 860*e* disposed in the channel 819*e* of the underlying shingle 800*e*. The first and second reactive sealant components may be applied to the shingle according to any of the sealant arrangements described herein, such as continuous lines, discontinuous or intermittent lines (e.g., collinear dashes or collinear spaced line segments), or any one or more of the sealant configurations and/or geometries shown in FIGS. 19-25, so long as the first and second reactive sealant components are able to come into contact with one another.

When the underlying shingle 800*e* and the overlying shingle 800*d* are positioned and/or installed, the first reactive sealant component 850*d* of the overlying shingle 800*d* is brought into contact with the second reactive sealant component 860*e* of the underlying shingle 800*e*. As the first reactive sealant component 850*d* and the second reactive sealant component 860*e* come into contact, the first and second reactive components 850*d*, 860*e* react to form an adhesive 869*a* that bonds or otherwise forms a seal between the underlying shingle 800*e* and the overlying shingle 800*d*, as shown in FIG. 32A. The first and second reactive components 850*d*, 860*e* may be brought into intimate contact by installation crews walking on the shingles during or after installation, or by using other means to apply pressure to bring the first and second reactive components 850*d*, 860*e* into intimate contact.

One factor that may affect the ability of a shingle sealant to form a strong bond with or seal to an adjacent shingle is flattening of the sealant or sealant bead. Sealants, such as conventional heat activated adhesives (e.g., asphalt adhesives), as applied to a shingle, are plastically compressible, flowable materials that are susceptible to being flattened (i.e., spread out and thinned) on the surface of the shingle when subjected to a compressive force, as may be expected when the shingle is included in a conventional bundle of roofing shingles (weighing about 80 pounds), and stacked under one or more other shingle bundles (e.g., on a pallet). While additional sealant material may improve adhesion of the flattened bead of sealant, the additional sealant material increases shingle costs and the increased sealant thickness to compensate for such flattening may distort the shape of the shingles when stacked and stored for long periods of time.

According to another aspect of the present application, a shingle may be provided with an area of reduced thickness on a headlap portion of the shingle and a sealant disposed on a lower surface of a tab portion of the shingle, such that when at least a pair of shingles are stacked and/or bundled together (e.g., stacked such that every other shingle is inverted and turned 180 degrees relative to an adjacent shingle, stacked such that every other shingle is turned 180 degrees relative to an adjacent shingle), the sealant of each shingle contacts the area of reduced thickness on the headlap portion of an adjacent shingle. The area of reduced thickness on the headlap portion will allow this area of the headlap portion to flex or bend to reduce the amount of pressure exerted upon the sealant, which in turn prevents or reduces flattening of the sealant.

Figure 33:
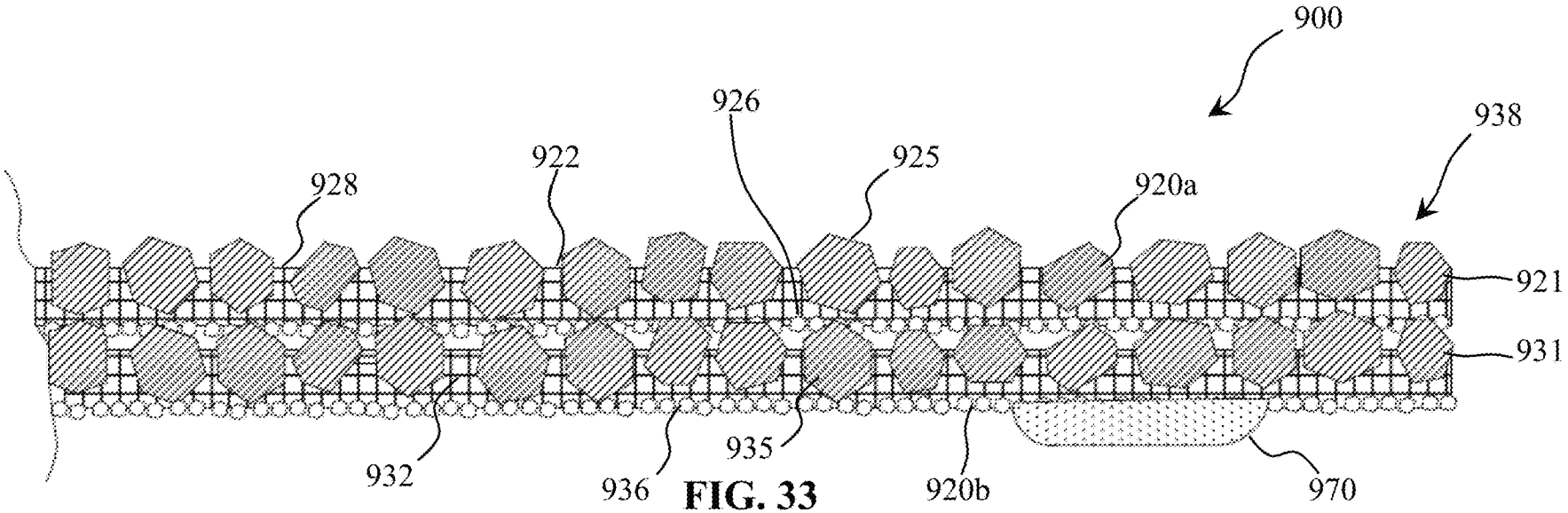
FIG. 33 is a partial cross-sectional view of an exemplary embodiment of a two-layer, laminated shingle, showing a tab portion of the shingle.
Figure 33A:
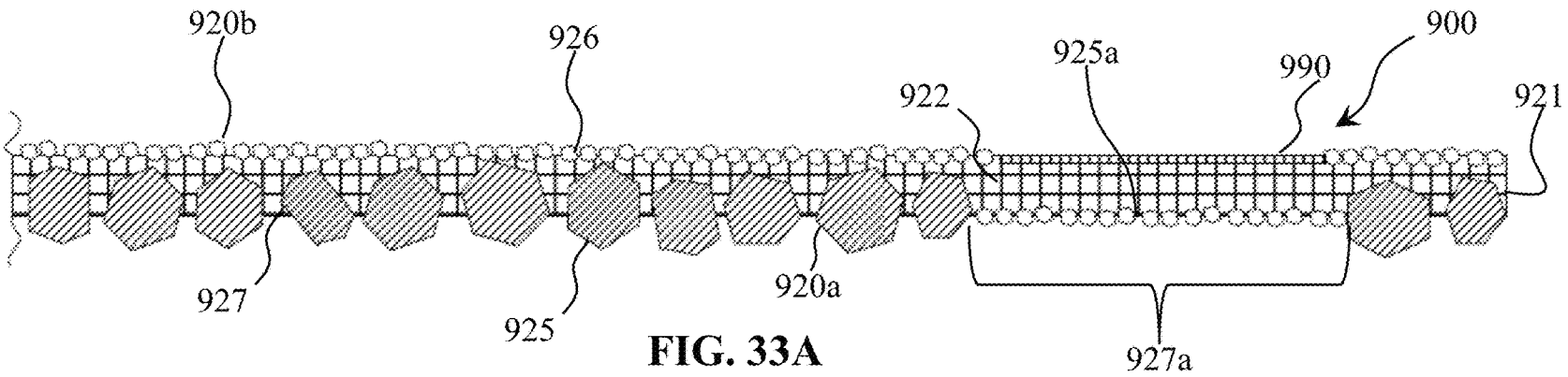
FIG. 33A is a partial cross-sectional view of the two-layer, laminated shingle of FIG. 33, showing a headlap portion of the shingle.
Figure 33B:
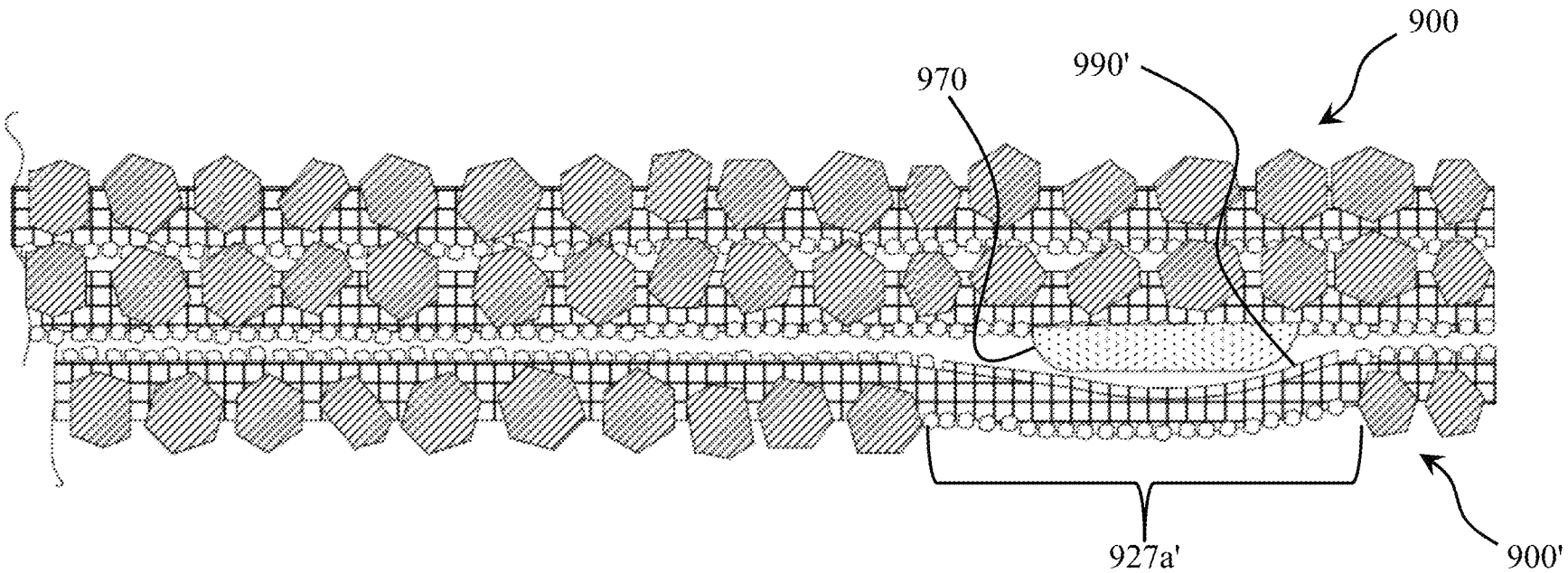
FIG. 33B is a partial cross-sectional view of an exemplary embodiment of a pair of two-layer, laminated shingles, showing the shingles stacked together.
Figure 33C:
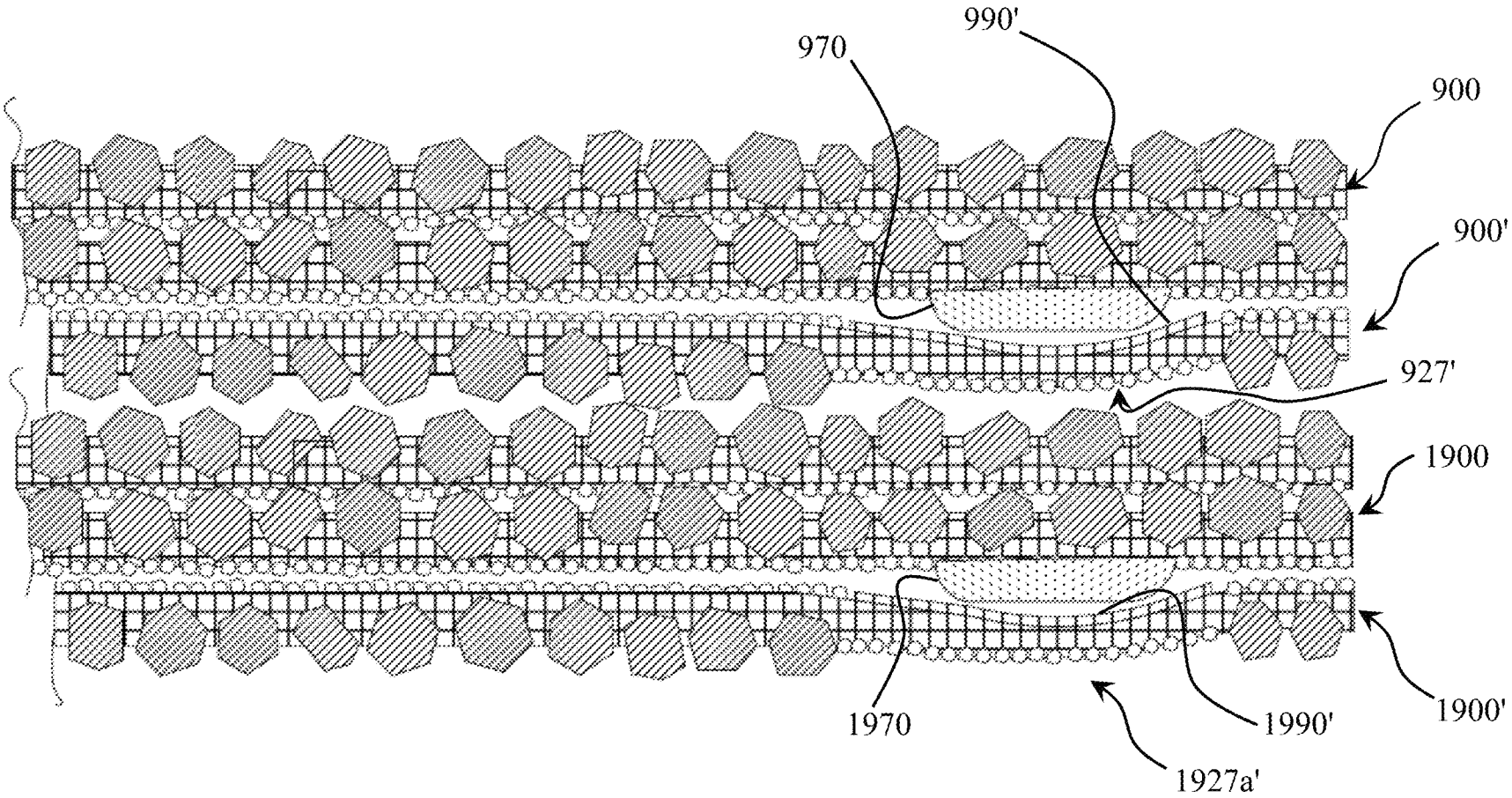
FIG. 33C is a partial cross-sectional view of an exemplary embodiment of two pairs of two-layer, laminated shingles, showing the shingles stacked together.

Referring now to FIGS. 33-33C, an exemplary embodiment of a two-layer or laminated shingle 900 having an area of reduced thickness on a headlap portion 927*a* of the shingle 900 is shown. The laminated shingle 900 includes an asphalt coated overlay sheet 921 having a continuous headlap portion 927 and a tabbed or slotted tab portion 928 adhered to an upper surface of an asphalt coated underlay sheet 931 to define a tab portion 938 of the shingle 900. The overlay and underlay sheets 921, 931 each include a substrate layer 922, 932, at least one asphalt coating layer adhered to the substrate layer 922, 932, a layer of granules 925, 935 adhered to at least an upper exposed portion of the asphalt coating to define an upper surface 920*a* of the shingle 900, and a layer of backdust 926, 936 adhered to at least a lower exposed portion of the asphalt coating to define a lower surface 920*b* of the shingle 900. The overlay and underlay sheets 921, 931 may be adhered to each other by abutting portions of the asphalt coating layers of the substrate layers 922, 932 (with these portions free of granules to allow for adhesion), or by a post-applied pattern of adhesive (e.g., asphalt adhesive).

As seen in FIG. 33, the shingle 900 includes at least one sealant 970 disposed (e.g., sprayed, pumped, printed, dispensed, or otherwise applied) on the lower surface 920*b* of the tab portion 938 proximate to the front edge of the tab portion 938 of the shingle 900. The sealant 970 and the area of reduced thickness 927*a* are positioned on the shingle 900 such that when the shingle 900 is stacked, bundled, or otherwise packaged with another shingle 900', the sealant 970 of shingle 900 is in facing alignment with an area of reduced thickness 927*a'* of shingle 900' and vice versa, as shown in FIG. 33B.

In certain embodiments, the headlap portion 927 of the shingle 900 (shown in an inverted orientation in FIG. 33A, with upper surface 20*a* facing down) may include a release layer 990 disposed on the lower surface 920*b* of the headlap portion 927 to coincide with the area of reduced thickness 927*a* so that sealant from an adjacent shingle does not stick or otherwise adhere to the shingle to thereby allow for easy separation of the shingles. The release layer 990 may be any conventional release tape or non-stick coating known to one of skill in the art.

The area of reduced thickness 927*a* of the headlap portion 927 of the shingle 900 can be achieved in a variety of ways. As seen in FIG. 33A, in certain embodiments, the area of reduced thickness 927*a* includes a layer of granules 925*a* on the upper surface 920*a* of the shingle 900 that comprise granules which are at least 50% smaller than the granules 925 applied to the remainder of the upper surface 920*a* of the shingle 900. In certain embodiments, the layer of granules 925*a* in the area of reduced thickness 927*a* comprise granules which are at least 75% smaller, including at least 80% smaller, at least 85% smaller, and also including at least 90% smaller than the granules 925 applied to the remainder of the upper surface 920*a* of the shingle 900. In certain embodiments, the layer of small granules 925*a* may be the same material used for the layer of backdust 926 (e.g., pulverized sand, talc, mica, calcium carbonate, ground recycled glass).

In certain embodiments, the area of reduced thickness 927*a* can be achieved by reducing the thickness and/or the amount of asphalt coating applied to the substrate layer 922 of the overlay sheet 921. In certain embodiments, the area of reduced thickness 927*a* can be achieved by a combination of a layer of small granules 925*a* and a reduction in the thickness and/or the amount of asphalt coating applied to the substrate layer 922 of the overlay sheet.

Referring again to FIG. 33B, a pair of stacked shingles 900, 900' is illustrated. The shingles 900, 900' are configured identically and may include the features described above with respect to FIGS. 33 and 33A. As seen in FIG. 33B, shingle 900' is inverted and turned 180 degrees relative to adjacent shingle 900. In this configuration, the sealant 970 of shingle 900 is in facing alignment with and in contact with the area of reduced thickness 927*a*' of shingle 900'. The area of reduced thickness 927*a*' of shingle 900' flexes or bends so that the amount of pressure exerted upon the sealant 970 of shingle 900 is reduced, which in turn prevents or reduces flattening of the sealant 970 and thereby preserves the ability of the sealant 970 to form a strong seal or bond between shingles, particularly in low temperature conditions.

Referring now to FIG. 33C, two pairs of stacked shingles 900, 900' and 1900, 1900' are shown. The shingles 900, 900', 1900, 1900' are configured identically and may include the features described above with respect to FIGS. 33 and 33A. As seen in FIG. 33C, every other shingle is inverted and turned 180 degrees relative to an adjacent shingle. In this configuration, the sealant 970 of shingle 900 is in facing alignment with and in contact with the area of reduced thickness 927*a*' of shingle 900', and the sealant 1970 of shingle 1900 is in facing alignment with and in contact with the area of reduced thickness 1927*a*' of shingle 1900'. The areas of reduced thickness 927*a*', 1927*a*' of shingles 900', 1900' flex or bend so that the amount of pressure exerted upon the sealants 970, 1970 of shingles 900, 1900 is reduced, which in turn prevents or reduces flattening of the sealants 970, 1970 and thereby preserves the ability of the sealants 970, 1970 to form a strong seal or bond between shingles, particularly in low temperature conditions.

EXAMPLES

A series of sealants were tested to determine their performance characteristics at various temperatures. The sealants include a first polymer modified asphalt (PMA1), a second polymer modified asphalt (PMA2) and a non-asphalt based sealant. The results of the testing are shown in the following graphs and accompanying discussion.

Formulations

PMA1=Summit MSA sealant (OC Duration) (7% radial SBS)

PMA2=new formulation A18 (93% CVR VTB Flux, 4% Calprene 411, 3% Calprene 1118, 0.4% Irgnox, 35% $CaCO_3$)

Non-asphalt base=Technomelt 9135

The rheological properties of the asphalt based and non-asphalt based sealants were characterized by performing temperature sweep measurements on dynamic shear rheometer. The measurements were performed with 8 mm parallel plates at 1 Hz frequency, 0.1% strain from −40 to 250° F. For the asphalt based sealants containing fillers, the samples were trimmed at 2100 mm gap distance and measured at 2000 mm running gap distance. For the sealant samples containing no fillers, the samples were trimmed at 1300 mm gap distance and measured at 1200 mm running gap distance.

Figure 34:
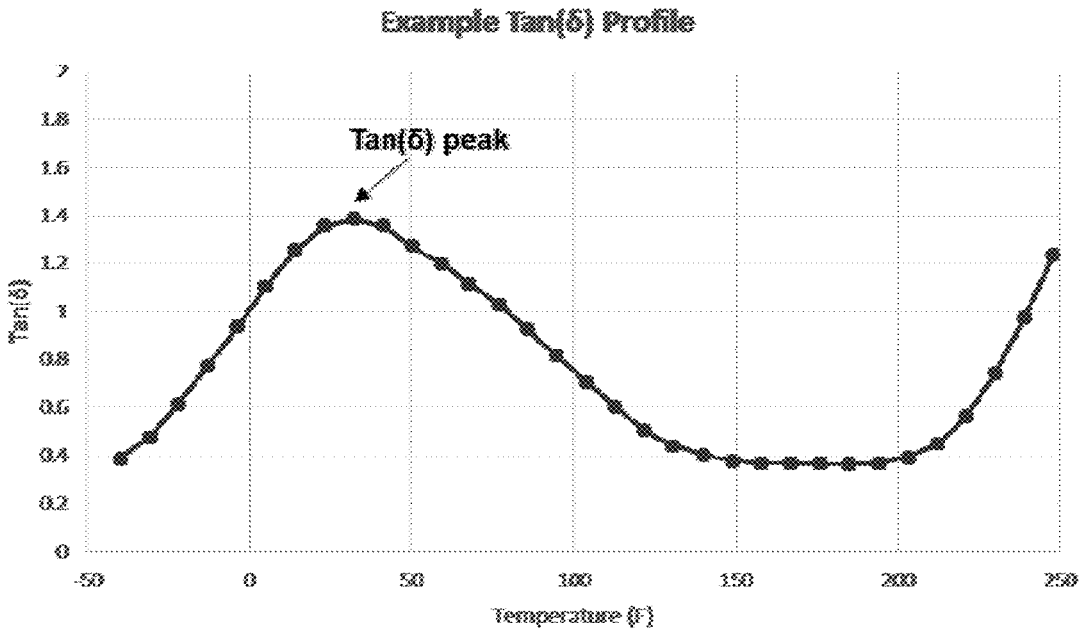
FIG. 34 is a graph showing an example Tan(δ) profile.

The tan(δ) is a value calculated from the elastic modulus (G') and loss modulus (G") obtained from the rheology measurements. The peak of tan(δ) appears within the glass transition region, where the material transitioning from rubbery plateau into its glassy state. The temperature of the tan(δ) peak represents the glass transition temperature, above which the material will have sufficient tack (the instantaneous adherence of an adhesive bonding to a substrate after short contact time and light pressure) in pressure sensitive adhesive application. FIG. 34 shows an exemplary tan(δ).

Figure 35:
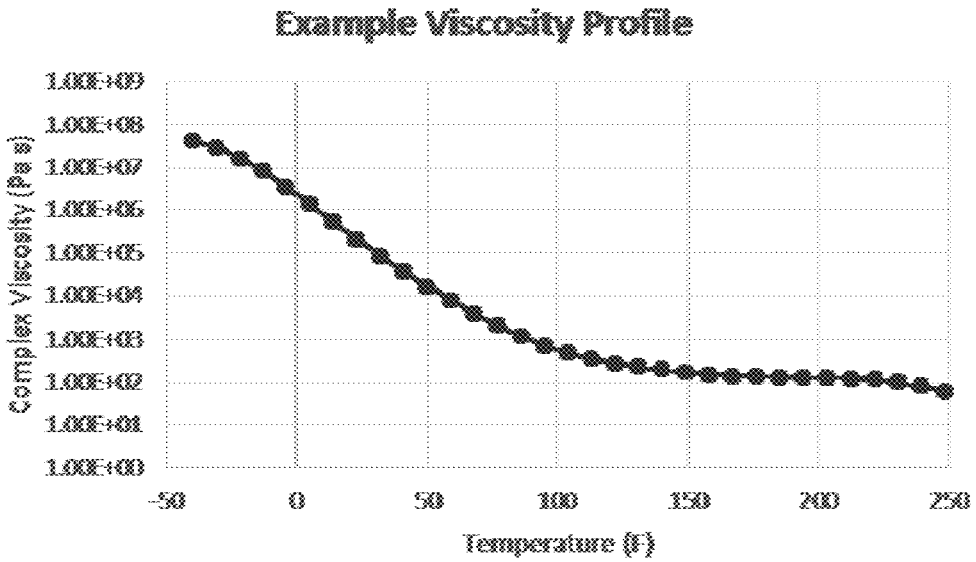
FIG. 35 is a graph showing an example viscosity profile.

The complex viscosity obtained from the rheology measurements is an indicator of the material's flow properties. The complex viscosity of a sealant can be correlated to its ability to wet out the substrate, which has direct impact on its adhesive performance. A lower viscosity indicates a liquid-like behavior in the material, and it is more likely to flow and wet out the substrate. FIG. 35 shows an exemplary complex viscosity profile.

Figure 36:
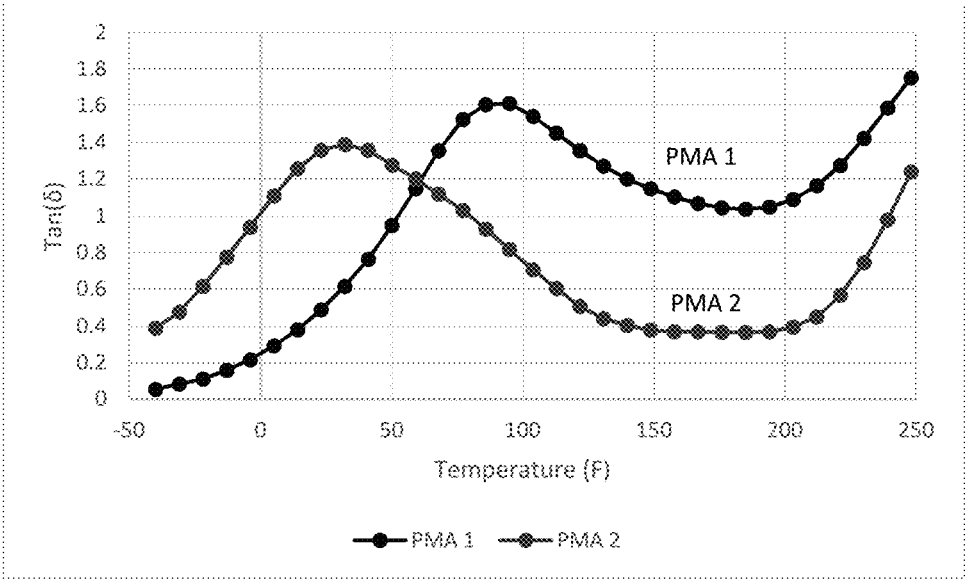
FIG. 36 is a plot of temperature versus tan(δ) at a temperature within the range of −40 to 250 F for two adhesives.

As can be seen from FIG. 36, the peak in the PMA2 plot of temperature versus tan(δ) is lower than the peak in the PMA1 plot of temperature versus tan(δ) at a temperature within the range of −40 to 250 F.

Figure 37:
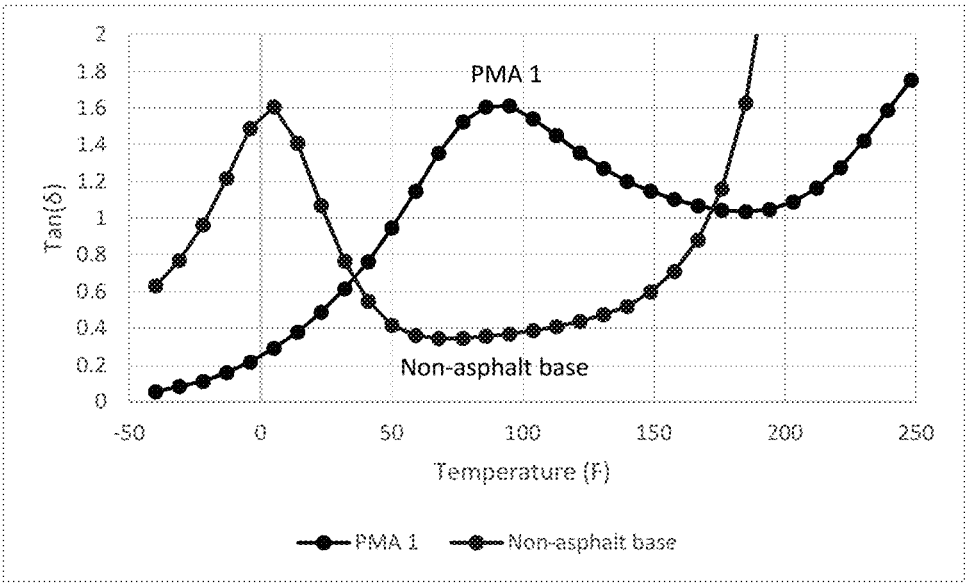
FIG. 37 is a plot of temperature versus tan(δ) at a temperature within the range of −40 to 250 F for two adhesives.

As can be seen from FIG. 37, the peak in the non-asphalt base adhesive plot of temperature versus tan(δ) is lower than the peak in the PMA 1 plot of temperature versus tan(δ) at a temperature within the range of −40 to 250 F.

Figure 38:
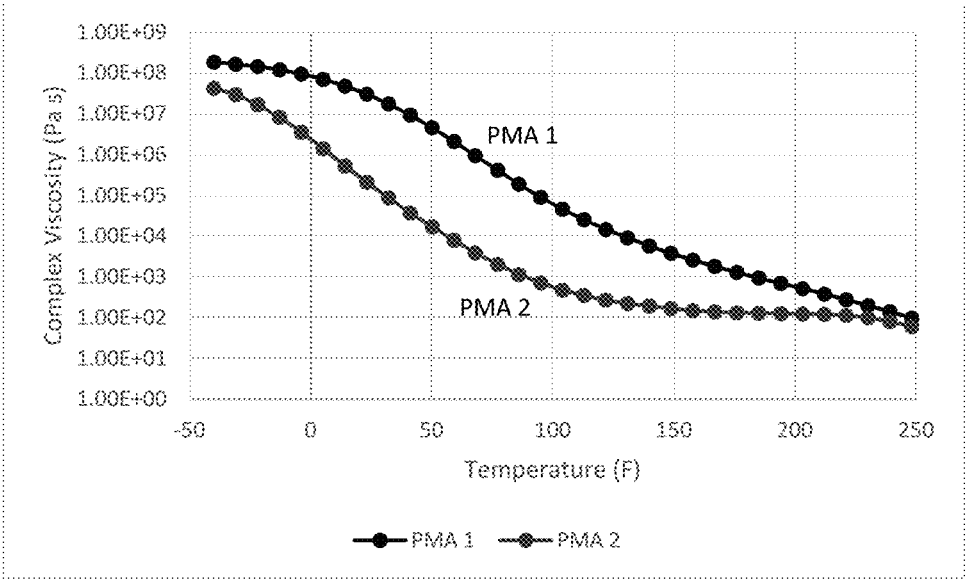
FIG. 38 is a plot of temperature versus complex viscosity at a temperature within the range of −40 to 250 F for two adhesives.

As can be seen from FIG. 38, the PMA 2 plot of temperature versus complex viscosity is lower than the PMA 1 plot of temperature versus complex viscosity at a temperature within the range of −40 to 250 F.

Figure 39:
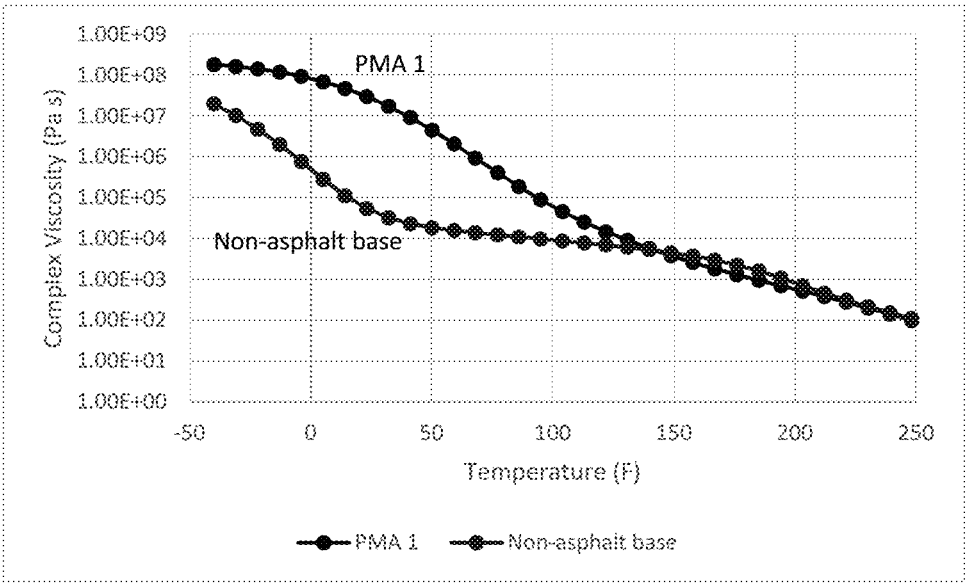
FIG. 39 is a plot of temperature versus complex viscosity at a temperature within the range of −40 to 140 F for two adhesives.

As can be seen from FIG. 39, the non-asphalt base adhesive plot of temperature versus complex viscosity is lower than the PMA 1 plot of temperature versus complex viscosity at a temperature within the range of −40 to 140 F.

Any of the various adhesives or sealants disclosed herein may be used in the embodiments described herein, either individually or in various combinations and sub-combinations thereof. For example, in embodiments that include an adhesive or sealant that adheres, bonds, or seals shingles at a low temperature, any one or more of the adhesives or sealants described herein as being able to adhere, bond, or seal shingles at a low temperature may be used. Similarly, in embodiments that include an adhesive or sealant that adheres, bonds, or seals shingles upon reaching a minimum activation temperature (i.e., a heat sensitive or thermally activated adhesive or sealant), any one or more of the adhesives or sealants described herein as being able adhere, bond, or seal shingles upon reaching a minimum activation temperature may be used.

While some embodiments of the present application have been described with respect to a single layer shingle, such embodiments may also apply to a two-layer, laminated shingle or other types of roofing material, such as asphalt-based roll roofing and commercial roofing. Similarly, while some embodiments of the present application have been described with respect to a two-layer, laminated shingle, such embodiments may also apply to a single layer shingle or other types of roofing material, such as asphalt-based roll roofing and commercial roofing.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "connector", "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. A shingle comprising:

at least one coated shingle sheet defining a headlap portion and a tab portion each having opposed upper and lower surfaces;

a bead of a first sealant having a first width and opposed upper and lower surfaces; and a bead of a second sealant having a second width and opposed upper and lower surfaces;

wherein the first sealant is formulated to seal at a temperature of 0° F. to 70° F.;

wherein the second sealant comprises a thermally activated adhesive having a minimum activation temperature of 70° F. to 140° F.;

wherein the first width is greater than the second width;

wherein the bead of the first sealant is disposed on the shingle, such that the upper surface of the bead of the first sealant is in direct contact with the lower surface of the tab portion of the shingle;

wherein the bead of the second sealant is disposed on the bead of the first sealant, such that the upper surface of the bead of the second sealant is in direct contact with the lower surface of the bead of the first sealant;

wherein placing the shingle on an underlying planar surface with the bead of the first sealant facing the underlying surface and the bead of the second sealant contacting the underlying surface, the bead of the first sealant does not contact the underlying planar surface; and wherein the bead of the second sealant is configured to be in direct contact with the bead of the first sealant prior to placing the shingle on the underlying planar surface.

2. The shingle of claim 1, wherein the at least one coated shingle sheet comprises an asphalt coated overlay sheet laminated to an asphalt coated underlay sheet.

3. The shingle of claim 2, wherein the upper surface of the headlap portion is defined entirely by the overlay sheet, and the lower surface of the tab portion is defined entirely by the underlay sheet.

4. The shingle of claim 1, wherein each of the first sealant and the second sealant is continuous.

5. The shingle of claim 1, wherein at least one of the first sealant and the second sealant is discontinuous.

6. The shingle of claim 1, further comprising a channel on the upper surface of the headlap portion.

7. The shingle of claim 6, wherein the channel comprises a reinforcement material that is formed of at least one of paper, polymer film, scrim, woven glass, and non-woven glass.

8. The shingle of claim 1, wherein the second sealant comprises a thermally activated adhesive having a minimum activation temperature of 80° F. to 140° F.

9. The shingle of claim 1, wherein the thermally activated adhesive of the second sealant is a filled asphalt adhesive comprising an inert material in an amount of 10% to 70% by weight of the filled asphalt adhesive and an antioxidant in an amount of 0.1% to 2% by weight of the filled asphalt adhesive.

10. A shingle system comprising:

at least one overlying shingle comprising at least one coated shingle sheet defining a headlap portion and a tab portion each having opposed upper and lower surfaces;

at least one underlying shingle comprising at least one coated shingle sheet defining a headlap portion and a tab portion each having opposed upper and lower surfaces;

the at least one overlying shingle having a bead of a first sealant having a first width and opposed upper and lower surfaces and a bead of a second sealant having a second width and opposed upper and lower surfaces, wherein the bead of the first sealant is disposed on the at least one overlying shingle, such that the upper surface of the bead of the first sealant is in direct contact with the lower surface of the tab portion, and wherein the bead of the second sealant is disposed on the bead of the first sealant prior to the at least one overlying shingle being in an installed position, such that the upper surface of the bead of the second sealant is in direct contact with the lower surface of the bead of the first sealant;

wherein the first sealant is formulated to seal at a temperature of 0° F. to 70° F.;

wherein the second sealant comprises a thermally activated adhesive having a minimum activation temperature of 70° F. to 140° F.;

wherein the first width is greater than the second width;

the at least one underlying shingle having a channel on the upper surface of the headlap portion; and wherein the lower surface of the bead of the second sealant of the at least one overlying shingle contacts and adheres to the channel of the at least one underlying shingle in an installed position, and the bead of the first sealant contacts and adheres to the upper surface of the headlap portion outside of the channel of the at least one underlying shingle in an installed position.

11. The shingle system of claim 10, wherein the channel comprises a reinforcement material on the upper surface of the headlap portion of the at least one underlying shingle, wherein the reinforcement material is formed of at least one of paper, polymer film, scrim, woven glass, and non-woven glass.

12. The shingle system of claim 10, wherein the second sealant comprises a thermally activated adhesive having a minimum activation temperature of 80° F. to 140° F.

13. The shingle system of claim 10, wherein the thermally activated adhesive of the second sealant is a filled asphalt adhesive comprising an inert material in an amount of 10% to 70% by weight of the filled asphalt adhesive and an antioxidant in an amount of 0.1% to 2% by weight of the filled asphalt adhesive.

14. The shingle system of claim 10, wherein the first width is 10% to 200% greater than the second width.

* * * * *